US009635483B2

(12) United States Patent
Francombe et al.

(10) Patent No.: US 9,635,483 B2
(45) Date of Patent: Apr. 25, 2017

(54) SYSTEM AND A METHOD OF PROVIDING SOUND TO TWO SOUND ZONES

(71) Applicant: Bang & Olufsen A/S, Struer (DK)

(72) Inventors: Jonathan Francombe, Somerset (GB); Khan Richard Baykaner, Kent (GB)

(73) Assignee: BANG & OLUFSEN A/S, Struer (DK)

( * ) Notice: Subject to any disclaimer, the term of this patent is extended or adjusted under 35 U.S.C. 154(b) by 0 days.

(21) Appl. No.: 14/623,397

(22) Filed: Feb. 16, 2015

(65) Prior Publication Data

US 2015/0264507 A1 Sep. 17, 2015

(30) Foreign Application Priority Data

Feb. 17, 2014 (DK) ..... 2014 00082
Feb. 18, 2014 (DK) ..... 2014 00083
May 30, 2014 (DK) ..... 2014 70315

(51) Int. Cl.
*H04R 5/02* (2006.01)
*H04S 7/00* (2006.01)

(52) U.S. Cl.
CPC ..... *H04S 7/301* (2013.01); *H04R 5/02* (2013.01); *H04R 2227/005* (2013.01); *H04S 7/30* (2013.01); *H04S 2400/09* (2013.01)

(58) Field of Classification Search
CPC ..... H04R 2227/007; H04R 2227/005; H04R 5/02; H04S 7/30; H04S 7/301
USPC ..... 381/300–303, 77, 80, 82
See application file for complete search history.

(56) References Cited

U.S. PATENT DOCUMENTS 5,131,048 A 7/1992 Farenelli et al.
8,274,546 B1 9/2012 Nicolet et al.
2004/0021351 A1 2/2004 House
2007/0041590 A1* 2/2007 Tice ..... G08B 7/062 381/77
2008/0130922 A1 6/2008 Shibata et al.
2008/0130924 A1 6/2008 Vaudrey et al.
2008/0170729 A1* 7/2008 Lissaman ..... H04R 29/002 381/303
2010/0202633 A1* 8/2010 Kim ..... H04S 7/30 381/107

(Continued)

FOREIGN PATENT DOCUMENTS

EP 1538868 A2 6/2005

OTHER PUBLICATIONS

Jon Francombe et al. "Perceptually optimised loudspeaker selection for the creation of personal sound zones", AES 52nd international conference, Guildford, UK, Sep. 24, 2013.

(Continued)

*Primary Examiner* — Disler Paul
(74) *Attorney, Agent, or Firm* — Harness, Dickey & Pierce, PLC

(57) ABSTRACT

A system and a method for providing sound into two different sound zones, where an a first signal and a second signal are accessed and converted into speaker signals generating the sound in the zones. interference value is determined. If the interference value exceeds a predetermined threshold, one or more parameter changes are determined to parameters of the conversion which, when implemented, will ensure that the interference in the first zone by sound in the second zone is maintained below a threshold limit.

18 Claims, 82 Drawing Sheets

(56) References Cited

U.S. PATENT DOCUMENTS

| | | | | |
|---|---|---|---|---|
| 2010/0284544 | A1* | 11/2010 | Kim | H04S 7/30 381/56 |
| 2012/0020486 | A1 | 1/2012 | Fried et al. | |
| 2012/0121103 | A1* | 5/2012 | Cohen | H04R 1/1083 381/77 |
| 2013/0230175 | A1* | 9/2013 | Bech | H04S 7/30 381/17 |
| 2014/0064501 | A1 | 3/2014 | Olsen et al. | |

OTHER PUBLICATIONS

Danish Search Report dated Dec. 3, 2014 issued in corresponding Danish Application No. PA201470315.

* cited by examiner

| | Training | Validation 1 | Validation 2 |
|---|---|---|---|
| Subjects | 21 | 7 | 20 |
| Trials | 200 | 270 | 24 |
| SNR range / dB | 0 – 45 | −35 – +35 | uncontrolled ( 2 – 18) |
| Target | speech based radio excerpts | female clear speech | speech based radio excerpts |
| Interferer | random radio excerpts | radio, film, and music excerpts | random radio excerpts |
| Spatial | mono, frontal axis | mono, frontal axis | spatially separated target and interferer |

FIG. 2

| Step | Features | Coefficients | VIF |
|---|---|---|---|
| 1 | DivBadFrameMixT8 (NO) | 0.3431 | 1 |
| 2 | DivBadFrameMixT8 (NO) | 0.2382 | 2.6114 |
| | IStdLev (NO) | -0.1336 | 2.6114 |
| 3 | DivBadFrameMixT8 (NO) | 0.4476 | 21.57 |
| | IStdLev (NO) | -0.1911 | 4.078 |
| | DivBadFrameMixI9 (NO) | 0.2586 | 29.71 |

FIG. 7

| Step | Features | Coefficients | VIF |
|---|---|---|---|
| 1 | RMS-BadFrame18 | -0.3546 | 1 |
| 2 | RMS-BadFrame18 | -0.2787 | 3.0118 |
| | IStdLev (NO) | -0.0929 | 3.0118 |
| 3 | RMS-BadFrame18 | -0.2187 | 4.9594 |
| | IStdLev (NO) | -0.0955 | 3.0155 |
| | DivBadFrameMixT9 | 0.0721 | 2.8129 |
| 4 | RMS-BadFrame18 | -0.2136 | 4.9836 |
| | IStdLev (NO) | -0.0947 | 3.0160 |
| | DivBadFrameMixT9 | 0.0759 | 2.8258 |
| | TSpecMean | 0.0332 | 1.0118 |
| 5 | RMS-BadFrame18 | -0.2283 | 5.3223 |
| | IStdLev (NO) | -0.0684 | 4.0969 |
| | DivBadFrameMixT9 | 0.0822 | 2.8875 |
| | TSpecMean | 0.0338 | 1.0123 |
| | IStdLev | -0.0298 | 1.3911 |
| 6 | RMS-BadFrame18 | -0.2225 | 5.3862 |
| | IStdLev (NO) | -0.0513 | 4.6554 |
| | DivBadFrameMixT9 | 0.1204 | 5.6521 |
| | TSpecMean | 0.236 | 1.2088 |
| | IStdLev | -0.0402 | 1.5945 |
| | TMaxSpec | -0.0367 | 2.5492 |
| 7 | RMS-BadFrame18 | -0.2142 | 5.5468 |
| | IStdLev (NO) | -0.0420 | 4.8539 |
| | DivBadFrameMixT9 | 0.1928 | 17.8300 |
| | TSpecMean | 0.0217 | 1.2177 |
| | IStdLev | -0.0404 | 1.5946 |
| | TMaxSpec | -0.0417 | 2.6076 |
| | DivBadFrameMixT7 | -0.0612 | 8.7087 |

FIG. 11

| Step | Features | Coefficients | VIF |
|---|---|---|---|
| 1 | RMS-BadFrame18 | -0.3546 | 1 |
| 2 | RMS-BadFrame18 | -0.2066 | 4.796 |
| | PEASS-OPS | 0.1664 | 4.796 |
| 3 | RMS-BadFrame18 | -0.2016 | 4.809 |
| | PEASS-OPS | 0.1692 | 4.800 |
| | IStdLev | -0.0452 | 1.004 |
| 4 | RMS-BadFrame18 | -0.1806 | 5.477 |
| | PEASS-OPS | 0.1514 | 5.278 |
| | IStdLev | -0.0488 | 1.024 |
| | DivBadFrameMixT9 | 0.0455 | 3.153 |
| 5 | RMS-BadFrame18 | -0.1620 | 5.974 |
| | PEASS-OPS | 0.1427 | 5.389 |
| | IStdLev | -0.0532 | 1.052 |
| | DivBadFrameMixT9 | 0.0614 | 3.517 |
| | MSpecMax | -0.0310 | 1.389 |
| 6 | RMS-BadFrame18 | -0.3271 | 76.419 |
| | PEASS-OPS | 0.1510 | 5.568 |
| | IStdLev | -0.0544 | 1.056 |
| | DivBadFrameMixT9 | 0.0560 | 3.593 |
| | MSpecMax | -0.0321 | 1.3913 |
| | RMS-BadFrame20 | 0.1699 | 74.584 |

FIG. 15

| | | Benchmark | CASP Model | Extended Model | PEASS Model |
|---|---|---|---|---|---|
| Size of feature pool | | 1 | 198 | 235 | 239 |
| Number of features | | 1 | 2 | 5 | 5 |
| Training Data | RMSE | 15.97% | 11.16% | 11.75% | 11.05% |
| | RMSE* | 9.45% | 8.19 | 5.36 | 1.96% |
| | R | 0.91 | 0.93 | 0.95 | 0.96 |
| | mean 2-fold RMSE | 16.22% | 15.16 | 13.03 | 11.93% |
| Validation 1 | RMSE | 19.95% | 22.27% | 17.02% | 17.17% |
| | RMSE* | 6.55% | 8.12 | 8.93% | 8.11% |
| | R | 0.78% | 0.75 | 0.78 | 0.77 |
| Validation 1 with repeats | RMSE | 16.69% | 19.19% | 13.10% | 13.56% |
| | RMSE* | 5.20% | 7.27% | 5.91% | 5.38% |
| | R | 0.86% | 0.81 | 0.86 | 0.85 |
| Validation 2 | RMSE | 21.56% | 35.36% | 32.81% | 17.98% |
| | RMSE* | 10.90% | 18.51% | 15.11% | 5.15% |
| | R | 0.13 | 0.03 | 0.15 | 0.57 |

FIG. 18

| | Training | Validation 1 | Validation-Av 1 | Validation 2 |
|---|---|---|---|---|
| PESQ | 0.94 | 0.75 | 0.83 | −0.28 |
| POLQA | 0.91 | 0.77 | 0.84 | −0.17 |
| Extended Acc Model | 0.95 | 0.78 | 0.86 | 0.45 |
| Peass based Acc Model | 0.96 | 0.77 | 0.85 | 0.57 |
| OPS | 0.91 | 0.68 | 0.76 | 0.55 |
FIG. 19
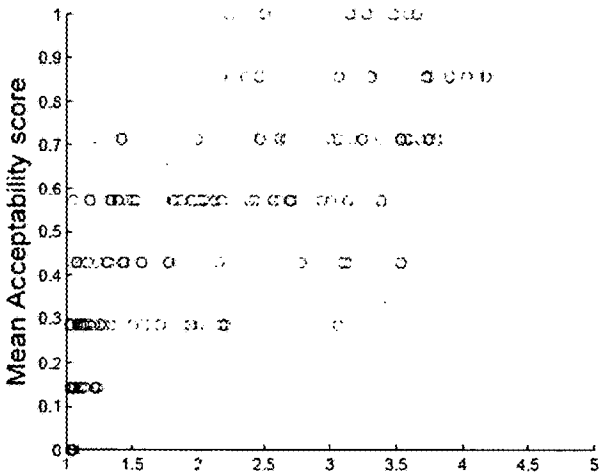
FIG. 20A
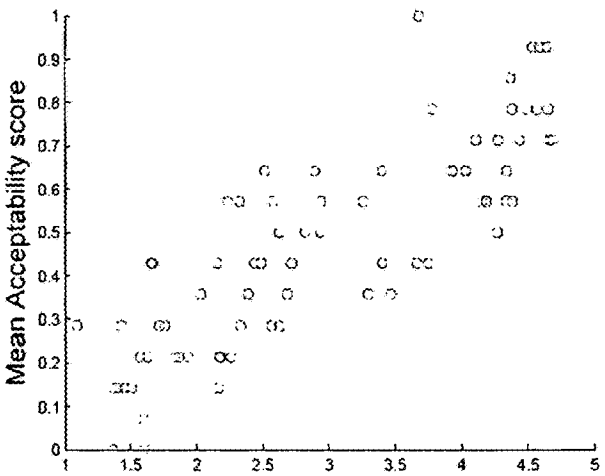
FIG. 20B

| No. | Station | Radio format |
|---|---|---|
| 1 | BBC Radio 2 | Hot adult contemporary, indie music, infotainment |
| 2 | BBC Radio 1 | Contemporary hit radio, news, entertainment, speech, showbiz |
| 3 | Classic FM | Classical music |
| 4 | BBC Radio 3 | Classical, jazz, world music, drama, culture, arts |
| 5 | Capital London | Top 40 (contemporary hit radio) |
| 6 | BBC 6 Music | Non-formatted or multi-formatted |
| 7 | Heart London | Hot adult contemporary |
| 8 | Kiss 100 FM | Dance, hip hop, RnB |
| 9 | 1Xtra from the BBC | Urban and hip hop, RnB, D&B, dancehall and garage |

FIG. 21

| Title | Frequency |
|---|---|
| Programme type | 20 |
| Level | 19 |
| Differentiation or blend between target and interferer | 11 |
| Familiarity | 11 |
| Location | 11 |
| Tempo | 10 |
| Instrumentation | 8 |
| Masking | 7 |
| Preference | 7 |
| Presence of vocals | 7 |
| Key clash | 6 |
| Frequency range and spectral content | 5 |
| Rhythmic variation | 3 |
| Clarity of main feature | 2 |
| Transients in interferer | 2 |
| Temporal gaps | 1 |
| Clarity of intricate features | 1 |
| Sound quality | 1 |
| Noise in target | 1 |

FIG. 35

| Feature | Origin | Description | Sigs. | Chans. | Freq. range | No. |
|---|---|---|---|---|---|---|
| Crest Factor | - | Crest factor (peak-to-rms ratio), a measure of the dynamic range of a signal | T, I, C | M | All | 3 |
| Zero crossing rate | MIR toolbox | Number of sign changes in the signal per second. A measure of noisiness in the signal | T, I, C | M | All | 3 |
| Model standard deviation | CASP preprocessor | Standard deviation (over time) of the CASP auditory model time-frequency map value (mean over frequency range) | T, I, C | M, L, R, Hi, Lo | All, Low, Med, High | 60 |
| Onsets (number) | MIR toolbox | Number of detected onsets in the sample | T, I, C | M | All | 3 |
| Onsets (skewness) | MIR toolbox | Skewness in temporal position of onsets (i.e. are there more at the beginning or end of the file?) | T, I, C | M | All | 3 |
| Spectral correlation | - | Cross-correlation between the target and interferer spectra (mean over 6 time periods) | C | M, L, R, Hi, Lo | All | 5 |
| Distance | MIR toolbox | Distance between audio files along a particular representation | C | M | All | 3 |
| | | Mel-frequency cepstral coefficients (MFCC) | | | | |
| | | Emotion | | | | |
| | | Onsets | | | | |
| Rolloff | MIR toolbox | The frequency below which a specified percentage of the energy in the signal falls | T, I | M | All | 6 |
| | | 75% | | | | |
| | | 85% | | | | |
| | | 95% | | | | |
| Model level | CASP preprocessor | Mean (over time) of the CASP auditory model time-frequency map value (mean over frequency range) | T, I, C | M, L, R, Hi, Lo | All, Low, Med, High | 60 |
| Brightness | MIR toolbox | The percentage of energy above a specified frequency | T, I | M | All | 6 |
| | | 1000 Hz | | | | |
| | | 1500 Hz | | | | |
| | | 3000 Hz | | | | |
| Bandwidth | CASP preprocessor | Frequency range (in octaves) of the most consecutive bands with energy above a threshold (set at mean level − standard deviation level) | T, I | M, L, R, Hi, Lo | All | 10 |
| Bad frequency bands | CASP preprocessor | The number of frequency bands in which TIP is < a specified threshold value | C | M, L, R, Hi, Lo | All | 20 |
| | | 5 dB | | | | |
| | | 10 dB | | | | |
| | | 15 dB | | | | |
| | | 20 dB | | | | |
| Key | MIR toolbox | Predicted key of programme material | T, I | M | All | 2 |
| Key clarity | MIR toolbox | The strength of the most likely key | T, I | M | All | 2 |

FIG. 36

| Feature | Origin | Description | Sigs. | Chans. | Freq. range | No. |
|---|---|---|---|---|---|---|
| Keystrength correlation | MIR toolbox | Correlation between target and interferer keystrength vectors (i.e. the likelihood of the programme material being in each of the 24 keys) | C | M | All | 1 |
| RMS level | MIR toolbox | The RMS level of the signal | T, I, C | M, L, R, Hi, Lo | All | 15 |
| Loudness | GENESIS loudness toolbox | Various statistics (over time) relating to the predicted loudness of the programme material | T, I, C | M, Bin | All | 24 |
| | | Maximum LTL level | | | | |
| | | Mean LTL level | | | | |
| | | Standard deviation of LTL level | | | | |
| | | Range of LTL level | | | | |
| Loudness ratio | GENESIS loudness toolbox | The difference between target and interferer loudness | C | M, Bin | All | 2 |
| Interferer angle | PMMP toolbox | Predicted angle of the interferer | I | Bin | All | 1 |
| Quantised interferer angle | PMMP toolbox | Predicted angle of the interferer, quantised to the nearest angle used in the training experiment | I | Bin | All | 1 |
| Masking threshold | CASP model | Predicted masking threshold of the interferer by the target | T, I | M | All | 1 |
| Masking threshold distance | CASP model | The difference between the TIR (mean CASP auditory model value) and the masking threshold | T, I | M | All | 1 |
| Is masked? | CASP model | Categorical prediction of whether or not the interferer is masked by the target | T, I | M | All | 1 |
| Pulse clarity | MIR toolbox | Estimate of rhythmic clarity | T, I, C | M | All | 3 |
| PEASS | PEASS toolbox | PEASS toolbox predictions | C | M | All | 4 |
| | | OPS | | | | |
| | | TPS | | | | |
| | | IPS | | | | |
| | | APS | | | | |
| Emotion | MIR toolbox | Emotion predictions in basic emotions and dimensional representations | T, I | M | All | 16 |
| | | Activity | | | | |
| | | Valence | | | | |
| | | Tension | | | | |
| | | Happy | | | | |
| | | Sad | | | | |
| | | Tender | | | | |
| | | Anger | | | | |
| | | Fear | | | | |
| Tempo | MIR toolbox | Predicted tempo | T, I | M | All | 2 |
| Tempo difference | MIR toolbox | Difference in tempo between target and interferer | C | M | All | 1 |

FIG. 37

| Feature | Origin | Description | Sigs. | Chans. | Freq. range | No. |
|---|---|---|---|---|---|---|
| Model range | CASP preprocessor | Difference between maximum and minimum frequency channel in time-frequency map model level (mean over time) | T, I, C | M, L, R, Hi, Lo | All, Low, Med, High | 60 |
| Bad temporal windows | CASP preprocessor | Percentage of temporal windows (0.4s, 25% overlap) with model level/TIR less than a specified threshold value | T, I, C | M, L, R, Hi, Lo | All, Low, Med, High | 80 |
| | | 5 dB | | | | |
| | | 10 dB | | | | |
| | | 15 dB | | | | |
| | | 20 dB | | | | |
| | | | | | Total: | 399 |

FIG. 38

| Range | CASP model bands | Centre frequencies (Hz) |
|---|---|---|
| All | 1–31 | 86.94–7819.20 |
| L (Low) | 1–9 | 86.94–520.01 |
| M (Mid) | 10–19 | 605.36–1974.90 |
| H (High) | 20–31 | 2226.10–7819.20 |

FIG. 39

| Statistic | Full stepwise model |
|---|---|
| RMSE | 9.03 |
| RMSE* | 4.33 |
| Leave-one-out cross-validation RMSE | 9.74 |
| 2-fold cross-validation RMSE | $10.61 \pm 0.58$ |
| $R$ | 0.94 |
| $R^2$ | 0.89 |
| Adjusted $R^2$ | 0.88 |
| Max. VIF | 21.09 |
| Mean VIF | 7.60 |
| Number of features | 8 |

FIG. 41

Residuals plot

Histogram

Q Q plot

| Statistic | Adjusted model | Full stepwise model |
|---|---|---|
| RMSE | 9.51 | 9.03 |
| RMSE* | 4.45 | 4.33 |
| Leave-one-out cross-validation RMSE | 10.07 | 9.74 |
| 2-fold cross-validation RMSE | 10.71 ± 0.52 | 10.61 ± 0.58 |
| $R$ | 0.94 | 0.94 |
| $R^2$ | 0.88 | 0.89 |
| Adjusted $R^2$ | 0.87 | 0.88 |
| Max. VIF | 5.60 | 21.09 |
| Mean VIF | 3.25 | 7.60 |
| Number of features | 6 | 8 |

FIG. 47

Residuals plot

Histogram

Q-Q plot

| No. | $y$ | $\hat{y}$ | $\hat{y}'$ | Targ. Prog. | Int. Prog. | Targ. Lev. | Int. Lev. | Int. Loc. |
|---|---|---|---|---|---|---|---|---|
| 16 | 4.65 | 29.80 | 30.22 | "Monolith" Crossfaith | "Relight my fire" - Take That ft. Lulu | −2.83 | −22.73 | 315 |
| 5 | 13.73 | 40.09 | 41.20 | "I still believe" – Cast of Miss Saigon | "Look to the stars" – Hans Zimmer | −16.34 | −28.93 | 180 |
| 31 | 16 | 36.47 | 37.62 | "Bad habit" - Foals | "All that glimmers" – Hope For Return | −10.06 | −17.69 | 0 |
| 45 | 28.13 | 56.17 | 57.49 | "Blow me one last kiss" – Pink | "You don't know what love is" - White Stripes | −17.59 | −18.9 | 180 |
| 26 | 47.06 | 28.23 | 29.52 | "Symphony no. 5 mov. 2" - Schubert | "Penny Lane" – The Beatles | −17.12 | −27.06 | 0 |

FIG. 50

| Statistic | Adjusted model, no outliers | Adjusted model |
|---|---|---|
| RMSE | 7.89 | 9.51 |
| RMSE* | 2.55 | 4.45 |
| Leave-one-out cross-validation RMSE | 8.38 | 10.07 |
| $k$-fold cross-validation RMSE | 9.78 ± 0.20 | 10.71 ± 0.52 |
| $R$ | 0.96 | 0.94 |
| $R^2$ | 0.92 | 0.88 |
| Adjusted $R^2$ | 0.91 | 0.87 |
| Max. VIF | 5.78 | 5.60 |
| Mean VIF | 3.33 | 3.25 |
| Number of features | 6 | 6 |

FIG. 51

Residuals plot

Histogram

Q-Q plot

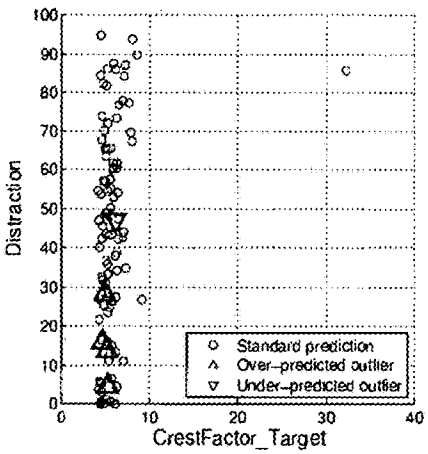
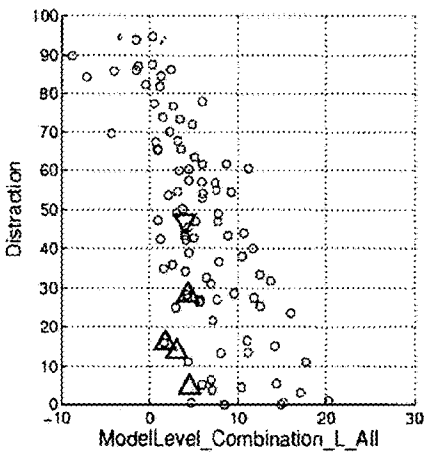
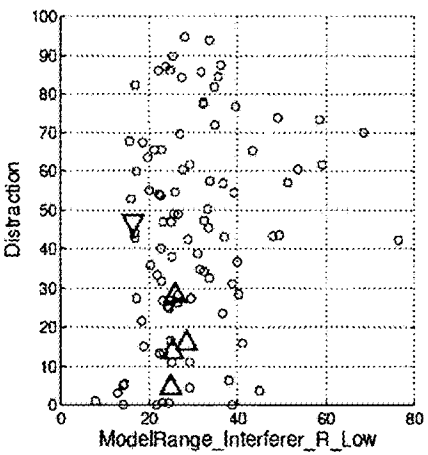
FIG. 55A
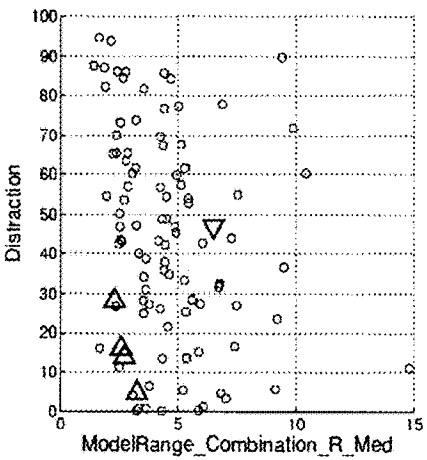
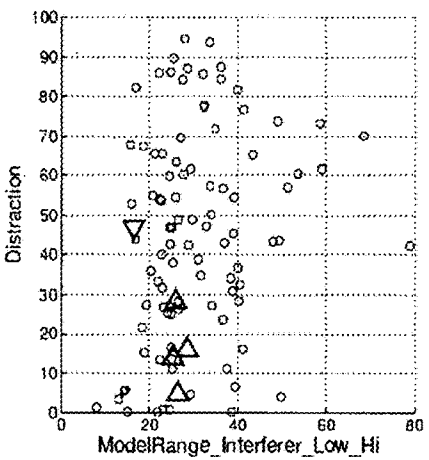
FIG. 55B
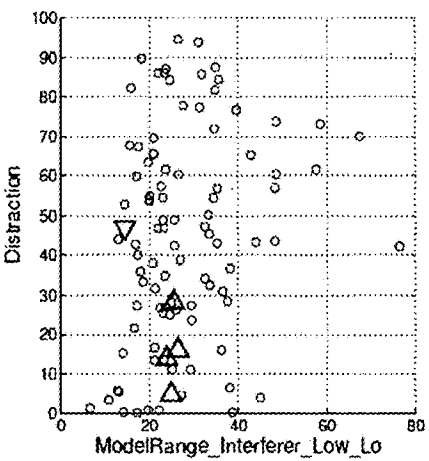
FIG. 55C

| Statistic | Adjusted model | M1 | M2 | M3 | M4 | M5 | M6 | M7 | M8 | M9 | M10 |
|---|---|---|---|---|---|---|---|---|---|---|---|
| RMSE | 9.51 | 9.47 | 12.14 | 9.50 | 9.51 | 12.05 | 9.49 | 11.33 | 11.05 | 14.68 | 13.77 |
| RMSE* | 4.45 | 4.43 | 6.22 | 4.44 | 4.45 | 6.22 | 4.44 | 6.33 | 5.64 | 8.56 | 8.18 |
| Leave-one-out cross-validation RMSE | 10.07 | 10.04 | 12.81 | 10.06 | 10.07 | 12.74 | 10.08 | 11.94 | 11.71 | 15.81 | 14.63 |
| 2-fold cross validation RMSE | 10.71 ± 0.52 | 10.68 ± 0.51 | 13.62 ± 0.59 | 10.70 ± 0.51 | 10.72 ± 0.51 | 13.55 ± 0.61 | 10.74 ± 0.54 | 12.67 ± 0.55 | 12.47 ± 0.57 | 16.95 ± 0.98 | 15.58 ± 0.72 |
| $R$ | 0.94 | 0.94 | 0.90 | 0.94 | 0.94 | 0.90 | 0.94 | 0.91 | 0.91 | 0.84 | 0.86 |
| $R^2$ | 0.88 | 0.88 | 0.80 | 0.88 | 0.88 | 0.81 | 0.88 | 0.83 | 0.84 | 0.71 | 0.75 |
| Adjusted $R^2$ | 0.87 | 0.79 | 0.84 | 0.87 | 0.87 | 0.79 | 0.87 | 0.82 | 0.83 | 0.70 | 0.73 |
| Max. VIF | 5.60 | 5.61 | 8.61 | 5.59 | 5.60 | 8.61 | 5.60 | 5.62 | 4.77 | 4.94 | 6.73 |
| Mean VIF | 3.25 | 3.24 | 4.26 | 3.15 | 3.16 | 4.28 | 3.25 | 3.08 | 2.70 | 2.74 | 3.51 |
| Number of features | 6 | 6 | 6 | 6 | 6 | 6 | 6 | 6 | 6 | 6 | 6 |

FIG. 56

Residuals plot

Histogram

Q-Q plot

| Statistic | Final model | M6 |
|---|---|---|
| RMSE | 9.46 | 9.49 |
| RMSE* | 4.41 | 4.44 |
| Leave-one-out cross-validation RMSE | 10.04 | 10.08 |
| $k$-fold cross-validation RMSE | $10.68 \pm 0.52$ | $10.74 \pm 0.54$ |
| $R$ | 0.94 | 0.94 |
| $R^2$ | 0.88 | 0.88 |
| Adjusted $R^2$ | 0.87 | 0.87 |
| Max. VIF | 5.64 | 5.60 |
| Mean VIF | 3.25 | 3.25 |
| Number of features | 6 | 6 |

FIG. 59

Residuals plot

Histogram

Q-Q plot

Feature 1

Feature 2

Feature 3

Feature 4

Feature 5

| Statistic | Interaction model | Mono | Lowest ear |
|---|---|---|---|
| RMSE | 9.94 | 10.71 | 10.03 |
| RMSE* | 4.74 | 5.49 | 4.94 |
| Leave-one-out cross-validation RMSE | 10.34 | 11.13 | 10.44 |
| $k$-fold cross-validation RMSE | $10.74 \pm 0.42$ | $11.57 \pm 0.46$ | $10.86 \pm 0.44$ |
| $R$ | 0.93 | 0.92 | 0.93 |
| $R^2$ | 0.86 | 0.84 | 0.86 |
| Adjusted $R^2$ | 0.86 | 0.84 | 0.86 |
| Max. VIF | 3.08 | 3.76 | 2.83 |
| Mean VIF | 2.42 | 2.85 | 2.28 |
| Number of features | 4 | 4 | 4 |

FIG. 65

Histogram

Q-Q plot

| Statistic | Interaction model | Adjusted model |
|---|---|---|
| RMSE | 10.03 | 9.46 |
| RMSE* | 4.94 | 4.41 |
| Leave-one-out cross-validation RMSE | 10.13 | 10.04 |
| $k$-fold cross-validation RMSE | $10.84 \pm 0.44$ | $10.68 \pm 0.52$ |
| $R$ | 0.93 | 0.94 |
| $R^2$ | 0.86 | 0.88 |
| Adjusted $R^2$ | 0.86 | 0.87 |
| Max. VIF | 2.83 | 5.60 |
| Mean VIF | 2.28 | 3.25 |
| Number of features | 4 | 6 |

FIG. 69

| | RMSE | | RMSE* | |
|---|---|---|---|---|
| | Training | Validation | Training | Validation |
| Adjusted model | 9.46 | 15.33 | 4.41 | 8.72 |
| Interactions model | 10.03 | 15.86 | 4.94 | 10.06 |

FIG. 72

Interactions model

Adjusted model

| | RMSE | | RMSE* | |
|---|---|---|---|---|
| | Training | Validation (rem. s10) | Training | Validation (rem. s10) |
| Adjusted model | 9.46 | 11.82 | 4.41 | 2.79 |
| Interactions model | 10.03 | 11.36 | 4.94 | 3.26 |

FIG. 74

| No. | $y$ | $\hat{y}$ | $\hat{y}'$ | Targ. Prog. | Int. Prog. | Targ. Lev. | Int. Lev. | Int. Loc. |
|---|---|---|---|---|---|---|---|---|
| 10 | 78.13 | 43.07 | 41.34 | "See that my grave's kept clean" – Blind Lemon Jefferson | "Titanium" – Jahmene Douglas | −2.45 | −14.33 | 90 |

FIG. 75

| | RMSE | | RMSE* | |
|---|---|---|---|---|
| | Training | Validation | Training | Validation |
| Adjusted model | 9.46 | 16.03 | 4.41 | 7.01 |
| Interactions model | 10.03 | 17.50 | 4.94 | 9.51 |

FIG. 76

Adjusted model

Interactions model

| | Adjusted model | | | Interactions Model | | |
|---|---|---|---|---|---|---|
| | Train | Set 2a | Set 2b | Train | Set 2a | Set 2b |
| RMSE | 9.46 | 13.47 | 22.42 | 10.03 | 14.17 | 24.27 |
| RMSE* | 4.41 | 6.09 | 9.54 | 4.94 | 7.93 | 12.88 |

FIG. 78

Interactions model (set 2a)

Adjusted model (set 2a)

Interactions model (set 2b)

Adjusted model (set 2b)

Adjusted model (set 2b) by target programme

Interactions model (set 2b) by target programme

Adjusted model (set 2b) by interferer programme

Interactions model (set 2b) by interferer programme

Adjusted model (set 2b) by interferer level

Interactions model (set 2b) by interferer level

Adjusted model (set 2b) by filter

Interactions model (set 2b) by filter

SYSTEM AND A METHOD OF PROVIDING SOUND TO TWO SOUND ZONES

This application claims priority under 35 U.S.C. §119 to, Danish Application No. PA201400082, filed Feb. 17, 2014, PA201400083, filed Feb. 18, 2014, PA201470315, filed May 30, 2014; the entire contents of which are hereby incorporated by reference.

The present invention relates to a system and a method of providing sound to two sound zones and in particular to where a parameter of the second sound is proposed or adapted in order to maintain an interference value below a predetermined threshold.

When generating multiple sound zones, interference experienced in one sound from sound generated in the other zone is a problem which may be encountered.

Interference between sound zones has been investigated in e.g. US2013/0230175, US2014/0064501 and "Perceptually optimised loudspeaker selection for the creation of personal sound zones", Jon Francombe et al. AES 52$^{nd}$ international conference, Guildford, UK, 2013 Sep. 2-4.

However, nowhere has the results of the interference been used to propose changes to the audio provided in one zone to affect the interference seen in one of the zones.

In a first aspect, the invention relates to a system for providing sound into two sound zones, the system comprising:

- a plurality of speakers configured to generate a first audio signal in a first of the sound zones and a second audio signal in a second of the sound zones,
- a controller configured to:
  - access a first signal and a second signal and convert the first and second signals into a speaker signal for each of the speakers,
  - derive, from at least the second audio signal and/or the second signal, an interference value,
  - if the interference value exceeds a predetermined threshold, determine a change in a parameter of the second audio signal and/or the conversion, and
  - adapt the conversion in accordance with the determined change of the parameter.

In this respect, a system may be a single element comprising the processor and loudspeakers or a distributed system where the loudspeakers are provided at/in the sound zones and the processor positioned virtually anywhere. Naturally, the first and second signals may be fed from the processor to the loudspeakers via electrical wires, optical fibres and/or via a wireless link, such as WiFi, BlueTooth or the like. The processor may forward the first and second signals via dedicated links or a network, such as the WWW, an Intranet, a telephone/GSM link or the like.

The loudspeakers may be so-called active speakers which are configured to convert the signal received into sound, such as by amplifying the signal received and optionally filtering the signal if desired. Alternatively, an amplifier may be provided for providing an electrical signal of sufficient strength to drive standard loudspeakers. The loudspeakers may form part of an element comprising other electronics for e.g. receiving and amplifying signals, such as a mobile telephone, a computer, laptop, palm top or tablet if desired.

Directivity of sound emitted from loudspeakers may be obtained by phase shifting (delaying) sound output from one loudspeaker compared to that emitted from another, usually adjacent or neighbouring, loudspeaker.

Usually, a loudspeaker is configured to generate an audio signal in an area by being provided inside the area or by being positioned and directed so that sound output thereby is emitted toward the area. The loudspeaker may have one or more sound providers, such as a woofer and a tweeter.

An audio signal is a sound signal usually having a frequency content in the interval of 20 Hz and 20,000 Hz.

The first and second audio signals may be any type of signals, including silence, such as speech (debate programs), music, songs, radio programs, sound from TV programs, or the like. One or both signals may have rhythmic contents or not.

In the present context, at least the first audio signal is a desired signal for e.g. a person in the first zone, where the second audio signal may be an interfering signal which may, however, be a desired signal for a person in the second zone. In a preferred embodiment, the audio signals in the first and second zones may be selected, such as by users positioned within the zones.

Naturally, the first and second zones may be zones defined inside a single space, such as a room, house, drivers cabin or passenger cabin of a car, vehicle, boat, airplane, bus, van, lorry, truck, or the like. More than two zones naturally is possible. There may be a dividing element provided completely or partly between the first and second zones, but often the first and second zones are provided inside the same space and with no dividing member. A zone may be defined as a volume or area inside which the pertaining audio signal is provided with a predetermined parameter, such as a minimum quality, minimum level (sound pressure, e.g.) and/or where a predetermined interference is experienced from other sources, such as the audio signal provided in the other zone. Usually, the first and second zones are non-overlapping, and often a predetermined distance, such as several cm or even several meters exist between the zones or centres of the zones.

In this context, a controller may be any type of controller, such as a processor, ASIC, FPGA, software programmable or hardwired. The controller may be a single such element or may be a combination of several such elements in a single assembly or in a distributed set-up. The processor may be provided as a combination of different types of elements, such as an FPGA and an ASIC.

That the controller is configured to perform an action will mean that the controller itself is able to perform the action or is in communication with an element which is.

The controller is configured to access a first and a second signal. Thus, the controller may comprise a storage from which the signal may be derived, or the controller may comprise a reader for reading the signal from a storage, such as a Flash memory, Hard Disc Drive or the like. The reading from the storage may be performed via wires or in a wireless manner, such as via Bluetooth, WiFi, optical signals and/or radio/microwave signals or the like.

In addition or alternatively, a signal may be received from a receiver, such as an antenna, a network connector, a transceiver, or the like, from where a streamed signal may be received. Streaming audio usually may be received from a supplier, such as a radio station, via the internet or airborne signals.

The first signal may represent silence or a signal representing speech, music or a combination thereof. The second signal may be a signal of the same type and may be assumed to be interfering or noise in the first zone.

The conversion may be any type of signal conversion transforming the first and second signals into the speaker signals. The generation of an audio signal, as is known to the skilled person, in a sound zone, may depend on the relative positions of the speakers in relation to the zone. Directionality of sound output from two speakers may be obtained by phase shifting a signal fed to one speaker compared to that output by the other. This phase shift will depend on the relative positions of the speakers and the zone.

The conversion thus may be based on information relating to relative positions of the individual speakers and the first and second zones. This information may be position information or pre-determined signal processing information, such as phase shift information.

Directionality is more prevalent to a user at higher frequencies, so this delay/phase shift may be desired only for higher frequencies, such as frequencies above a predetermined threshold frequency.

Conversion of signals to generate sound for two sound zones may be seen in e.g. US2013/0230175 and US2014/0064501.

The conversion may additionally or optionally be a filtering of one of the first or second signals or a mix of the first and second signals. This filtering may, as will be described below, be performed to limit a dynamic range and/or a frequency range of the signal.

The conversion may also comprise a mixing of the first and second signals where one of the signals is amplified or reduced in level compared to the other.

The processor may generate each speaker signal individually so as to be different from all other speaker signals. Alternatively, some speaker signals may be identical if desired.

Usually, however, the zones are provided inside a space around which the speakers are provided, so that sound from each speaker or at least some speakers reaches both zones. Situations may exist, however, where sound generated by one or more speakers is directed only toward one zone, such as if positioned between the zones and directed toward one.

The first and second signals may have different formats and may have any format, such as a single file or a sequence of streamed data packets. Naturally, analogue signals may also be received or accessed, such as from an old fashioned antenna or a tape/record player if desired. The first and second signals may be of the same or different types.

An interference value is a value describing how interfering the second audio signal is in the first zone. This value may also describe a quality of the first audio signal in the first zone where the second audio signal may also be heard to some extent.

This interference value may be determined in a number of manners. Some manners are known today and more are described further below.

The interference value preferably increases with interference from the second audio signal. If the value is implemented as a quality value increasing with quality and thus decreasing with interference, an interference value may be an inverse thereof, or the determination will then derive the change if the quality value falls below a threshold.

The threshold may be selected as a numerical value selected by an operator or user/listener in the first zone. The threshold may vary or be selected on the basis of a number of parameters, such as parameters (frequency contents, level or the like) other audio signals received from other sources not within the control of the present system, such as wind/tyre noise in a car wherein the two zones are defined. Also, a user may change parameters of the first/second signals and/or the conversion in order to e.g. change the first/second sound signals. Then, the threshold may also change.

Often, as is explained further below, the interference value is also determined on the basis of the first signal, such as one or more parameters thereof. As will be seen below, timing relationships and/or frequency contents of the first and second signals or the first and second audio signals may be used.

Naturally, the first audio signal may differ from the first signal and/or the second audio signal may differ from the second signal, even though it is usually desired that a listener within the first/second zone receives audio representing the first/second signals. Thus, a change in a parameter of e.g. the first signal may result in a corresponding (such as the same) parameter change in the first audio signal. This representation may be altered by a user by e.g. altering a volume (level or sound pressure in the pertaining zone) and a frequency filtering if desired. The difference may be caused by the interference and potentially other sound sources, such as sources external to the first/second zones.

If the interference value exceeds the threshold, a change in a parameter of the conversion is determined. The aim is to affect the interference value to fall below the threshold. Changing a parameter of the conversion may result in a changing of a parameter of the second audio signal. Below, a number of parameters are described which may be altered to improve and lower an interference value. Some of these parameters may be altered in the second signal or second audio signal. The same parameters or other parameters may be altered in the first signal or first audio signal. Other parameters may be a change in a timing relationship between the first and second signals and/or the first and second audio signals.

The conversion is then adapted in accordance with the determined change of the parameter. Usually, the conversion is based on a mathematical conversion from the first/second signals to the speaker signals. As described, this conversion may be an amplification, delay of one signal vis-à-vis the other, phase adaptation, frequency filtering (bandpass highpass, lowpass) but usually is a combination thereof. Each of these signal adaptation methods is controlled by parameters, such as an amplification value, filter frequency, delay time and the like.

In one embodiment, the controller is configured to derive the interference value also on the basis of the first audio signal and/or first signal. Often, the interference is best determined knowing also the useful or desired signal in the sound zone of interest.

In one embodiment, the controller is configured to receive an input from a user, such as to a desired change in a parameter of the first and/or second audio signals. This change may be a change in output volume (signal level) of the audio signal. In this situation, the controller may be configured to determine the interference value on the basis of the desired change but not adapt the conversion, if the determined interference value exceeds the threshold.

This may also be a desired change of the first or second signals. If the controller is configured to access the desired new first/second signal and determine the interference value on the basis thereof. If this interference value exceeds the threshold, the controller may prevent changing the desired first/second signal. Alternatively, the controller may determine a change of a parameter of the desired first/second signal or of the conversion which arrives at an interference value at or below the threshold. This changed parameter may then take effect and the desired first/second signal be used. Alternatively, the change may be proposed to a user, and if this change is acceptable (an input may be received), the thus adapted signal/conversion may be performed and the desired first/second signal provided.

In one embodiment, the controller is configured to determine a change of a number of parameters of the conversion.

A number of parameters will usually affect the interference value, such as the level of the resulting, interfering audio signal, the level of the desired audio signal, the frequency contents therein as well as the type of signal. Therefore, several parameters may be changed in order to arrive at an interference value at or below the threshold.

In one embodiment, the controller is configured to output or propose the determined parameter change and to, thereafter, receive an input acknowledging the parameter change. In that situation, a user may be questioned instead of automatically implementing the change arrived at in order to keep the interference value sufficiently low. The output or proposal may be made in a number of manners, such as on a display or monitor viewable by the user/operator, audible information entrained or mixed into an audible sound to the user/operator, or the like. The user's input may be a sound command or an activation of a button or touch screen. More advanced outputs and inputs are known, such as head-up-displays, sensory activation and the like, as are gesture determination, pupil tracking etc. possible for receiving the input.

In general, the controller may further be configured to receive a second input identifying one or more parameter settings, the controller being configured to derive the interference value on the basis of also the second input and adapt the conversion also in accordance with the one or more parameter settings of the second input.

These parameters may be desired parameters of the sound received in the first/second zones, such as the level of the sound, the changing of a channel/track thereof, filtering/mixing of the signal to alter its frequency components, or the like. Naturally, these changes may be provided in one of the first/second signals prior to a conversion thereof into the speaker signals, but in the present context, this is the same process. The first and second signals are those of the sources thereof. Any subsequent amendments thereof are performed in the conversion. The conversion may take place in a single step or multiple sequential steps, such as a preliminary adaptation (filtering, level adjustment) of the first/second signals and a subsequent mixing thereof (including relative delays) arriving at the final speaker signals.

In one embodiment, the controller is configured to, during the deriving step, determine whether the second audio signal comprises speech. It has been found that the interference determination, so human users, may depend on whether the desired signal is speech or not. It has been found that when the desired or target signal is speech, interference is seen in one way, and when the desired or target signal is e.g. music, interference is seen in another way. In other words, some parameters of the interfering signal will be more prevalent if the target signal is speech than if the target signal is music—and vice versa.

A determination of whether a signal is speech or not may be performed in a number of manners. The absence of rhythm, such as absence of harmonics, is a usual manner of detecting speech.

In one embodiment, and especially if the first signal does not represent speech, the controller is configured to derive the interference value on the basis of one or more of:

- a signal strength of the second audio signal and/or the second signal,
- a signal strength of the first audio signal and/or the first signal,
- a PEASS value based on the first and second audio signals and/or the first and second signals,
- a difference in level between the levels of different, predetermined frequency bands of the second signal and/or the second audio signal, and
- a number of predetermined frequency bands within which a predetermined maximum level difference exists between the level of the first signal and/or audio signal and the level of the second signal and/or audio signal.

In this connection, the signal strength of the first and/or second audio signal may be the sound pressure at a predetermined position, such as a centre, of the pertaining zone. The signal strength of the first/second signal may be a numerical value thereof as is seen in both analogue and digital signals. This value itself may be used, or the signal strength of the pertaining audio signal may be determined therefrom using parameters, such as amplification, used in the conversion.

One manner of obtaining this signal strength is to determine the audio signals, such as using dummy head recordings (e.g. recorded at a microphone calibrated to produce 0 dBFS at 100 dB SPL) of the first and second audio signals. Alternatively, the first and second signals may be used.

The maximum loudness may be obtained using the GENESIS loudness toolbox implementation of Gladberg and Moore's model of loudness for time varying sounds. The loudness may be determined as a maximum Low Threshold Level (LTL) level value.

The maximum loudness of a combination of the first and second signals or audio signals may be obtained by summing the first and second signals and deriving the maximum LTL value thereof.

Naturally, the loudness may be determined in any of a number of other manners.

The PEASS value preferably is the PEASS IPS (Interference-related Perception Score) parameter as described in "Subjective and objective quality assessment of audio source separation" by Emiya, Vincent, Harlander and Hohmann, IEEE Transactions on Audio, Speech and Language processing 19, 7 (2011) 2046-2057.

This paper also discusses the PEMO-Q measure, which is described in "PEMO-Q—A New Method for Objective Audio Quality Assessment Using a Model of Auditory Perception", IEEE transactions on audio, speech and language proceedings, vol 14, No. 6, November 2006, pp 1902-1911, by Huber and Kollmeier. This reference will be briefly described in the following:

FIG. 3 in the PEMO-Q paper shows how the model works in general. The major steps are:

1. an (ideal) reference signal is compared to the test signal, and the test signal is delayed and amplified (if necessary) to ensure that the two programmes are time and level aligned.
2. Next, both the reference and the aligned test signal are separately processed using an auditory model known as the Dau model. The Dau model is a predecessor to the CASP model which is used in measurements described further below. A schematic for the Dau model can be found in the PEMO-Q paper; it models the human auditory processing from the eardrum to the output of the auditory nerve, including a modulation filter stage (which accounts for some further psychophysical data). The output of the auditory model is called the 'internal representation'.
3. After a small arithmetical adjustment, Huber and Kollmeier refer to as 'assimilation', the two outputs of the auditory model (one of the reference signal and one of the test signal) are cross correlated (separately for each modulation channel) and these values are summed (normalising to the mean squared value for each modulation channel). This value is called the PSM (perceptual similarity measure).

4. Another measure is produced called the PSM(t). This measure is calculated by breaking the internal representations into 10 ms segments, and then taking a cross correlation for each 10 ms frame. After weighting the frames according to the moving average of the test signal internal representation, the 5th percentile is taken as the PSM(t).

PSM scores tend to vary between 0 and 1 (and are bound between −1 and 1), but PSM(t) scores are numerically regressed according to the equation given in FIG. 5 of the PEMO-Q paper.

Huber and Kollmeier seem to conclude that PSM(t) is more robust than PSM to a variety of signal types (i.e. PSM overestimates the quality of signals with rapid envelope fluctuations)

PEASS is focused on source separation and works on the assumption that the difference between an ideal reference signal and the test signal is the linear sum of the errors caused by target quality degradations, interferer-related degradations, and processing artefacts (see eq. 1 on page 5). PEASS works by decomposing and resynthesising the test signal with different combinations of reference target and interferer signals to estimate each of these three types of error: e(target), e(interf), e(artif).

After this, four quantities are produced by calculating the PSM (of Huber and Kollmeier's PEMO-Q) of four pairs of signals: reference and test signal (to give q(overall)), reference and test minus e(target) (to give q(target)), reference and test minus e(interf) (to give q(interf)), and reference and test minus e(artif) (to give q(artif)). In this way these quantities represent the PSM between the ideal reference and the test signal minus the portion of the error which can be attributed to target, interferer, or artefacts (see equations 14-17).

The final stage, the nonlinear mapping, converts these q values into OPS, TPS, IPS, and APS. This stage involves using a neural network of sigmoid functions to nonlinearly sum the q values into OPS, TPS, IPS, and APS values by training on subjective data. Table VI of the PEMO-Q paper gives the parameters for the sigmoid functions.

Both the above PEMO-Q reference and the PEASS reference are included herein by reference.

The difference in level between different frequency bands of the second signal and/or the second audio signal relates to a dynamic bandwidth of the second signal/second audio signal. If this difference is high, the energy or signal level in one or more frequency bands is low, whereas in one or more others it is high. A quantification of this dynamic bandwidth may be a quantification of the difference in level between the frequency band with the highest level and that with the lowest level. This quantification may be performed once, when requested or at a predetermined frequency, as the signal usually will change over time. If the difference exceeds a predetermined value, the interference value may exceed its threshold, where after it may be desired to alter the conversion so as to e.g. limit the dynamic bandwidth of the second signal or second audio signal. This may be performed using e.g. a filtering to either increase low-level frequency bands or limit high-level frequency bands.

In one embodiment, this may be determined by using the CASP model to produce internal representations of the second audio signal or the second signal (preferably binaurally). This method may use the lowest frequency modulation filter bank band and a total of e.g. 31 frequency bands, such as frequency bands 20-31. The mean value may be derived over time, and the difference, for each channel of the (binaural) signal, calculated between the highest level frequency band and the lowest level frequency band. The value may be returned for the channel with the lowest value.

The predetermined frequency bands may be selected in any manner. Too few, too wide frequency bands may render the determination less useful. More, narrower frequency bands will increase the calculation burden on the system.

When a maximum level difference is exceeded between the first signal/first audio signal and the second signal/second audio signal, interference may be experienced. Thus, a manner of quantifying interference is to determine a number of frequency bands within which a maximum level difference is exceeded between the first/second signals/audio signals. This maximum level difference may be selected based on a number of criteria.

Presently, it is preferred to use the CASP model to produce internal representation of the first and second (audio) signals (preferably binaurally). Then, for each channel of the binaural signal, a target-to-interferer (TIR) ratio (first-to-second signal ratio) is calculated by element-wise division of the two internal representations. The TIR map (0.4 second windows, 25% overlap) may be calculated, and the percentage of windows in which the TIR is less than 5 dB determined. This value may be returned for the channel with the lowest value In another embodiment, which is especially interesting when the first signal represents speech, the processor is configured to derive the interference value on the basis of one or more of:

- a proportion, over time, where a level of the first signal or first audio signal exceeds that of the second signal or the second audio signal by a predetermined threshold,
- an Overall Perception Score of a PEASS model based on the first and second audio signals and/or the first and second signals,
- a dynamic range of the second signal and/or the second audio signal over time,
- a proportion of time and frequency intervals wherein a level of the first signal or first audio signal exceeds a predetermined number multiplied by a level of a mixture of the first and second signals or first and second audio signals, and
- a highest frequency interval of a number of frequency intervals where a level of a mixture of the first and second signals or first and second audio signals is the highest at a point in time.

A ratio of the first signal/audio signal to a mixture of the first and second signals/audio signals usually will be the level of the first signal/audio signal divided by that of the combined first and second signals/audio signals.

The proportion over time describes how similar the first and signals or audio signals are over time.

This proportion may be determined by splitting the first signal or first audio signal and the second signal or the second audio signal up into non-overlapping frames of a predetermined time duration, such as 1-100 ms, such as 10-75 ms, such as 40-60 ms, such as around 50 ms. For every frame the ratio of the first level to the second level is calculated. This is like a Signal to Noise ratio but taken as the target signal or first signal to interference signal or second signal ratio.

Every frame with a ratio exceeding a predetermined threshold, such as 10 dB, such as 12 dB, such as 15 dB, such as 18 dB, is determined. In a simple embodiment, each such frame is marked with a 0, and all other frames may then be marked with a 1. The proportion of time, or in this situation frames, with a ratio exceeding the threshold is therefore calculated, such as by dividing the number of frames marked with a 1, by the total number of frames.

Preferably, the number of frames is selected so that the total time duration of the frames is sufficient to give a reliable result. A total duration of 1-20 s, such as 2-15 s, such as 6-10 s, such as 6-8 s is often sufficient.

It is interesting to note that if one of the first and second signals is delayed in relation to the other signal, this proportion may change. Thus, a delay may be determined at which the proportion is the lowest over the time samples derived, so that the interference value may be kept under the threshold, or so that a minimum parameter change may be required to obtain the desired interference value.

The PEASS model is described further above. In this model, an Overall Perception Score (OPS) is described.

The dynamic range of the second signal/audio signal may be a quantification of the difference between the highest and lowest level of the signal. This quantification may be performed in a number of manners.

The lower a dynamic range, the less interfering may the signal be felt to a person listening to the first audio signal. On the other hand, the larger the dynamic range, the more may the signal stand out and the harder will it be to ignore it.

The dynamic range may be summed, averaged or determined over a period of time if desired, as it may vary over time.

In one situation, the signal may be sampled over a predetermined period of time and divided into a number of time frames, non-overlapping or not. The dynamic range may be a level difference between the time frame with the highest level and that with the lowest level.

Another manner of determining this dynamic range is to determine the standard deviation of the second signal/audio signal using the CASP preprocessor. First, the second (audio) signal is chopped up into time windows of a predetermined duration, such as 400 ms, stepping by a predetermined time step, such as 100 ms (i.e. frame 1 is 0-400 ms, frame 2 is 100-500 ms etc.). For example, a 1 second input signal would have 7 frames: 0-400 ms, 100-500 ms, . . . 600-1000 ms. Each frame is processed with the CASP model (without using the modulation filter bank stage) so the outcome is that each frame is represented as a 2D matrix of frequency bins by samples. To be more specific, if the input audio signal had a sample rate of 44100 samples per second, then the output of each frame is a 2D matrix with 31 frequency bins (this is always the number of frequency bins) with 17640 samples. The 31 frequency bins are nonlinearly distributed according to the DRNL filterbank (which is contained within the CASP model) and considers frequencies from 80-8000 Hz.

The next step may be to sum across samples; in the 1 second example input signal, there will be 7 frames with 31 frequency bins. Next a sum is determined across frequency bins; so now for a 1 second input signal, 7 values (representing the sum of the energy across samples and frequency bins for each frame) are obtained. Finally, the standard deviation of these, 7 in the example, values would be taken as the final feature.

As before, the total time duration of the second (audio) signal and windows may be selected to obtain the best results. If the time is too short, the standard deviation might not work that well, and if the analysed part is minutes or hours long it may be that the feature will describe a different kind of characteristic of the signal, so this might change things too. A total time duration of 1-100 s, such as 2-50 s, such as 3-10 s may be sufficient. Also, naturally, a single point in time may be used. Normally, more points in time or time samples may be derived, such as at least 5 time samples, such as at least 10 time samples, such as at least 20 time samples if desired.

The proportion of time and frequency intervals describes the overlap in both time and frequency where the level of first (audio signal) exceeds that of a mixture of the first and second (audio) signals. This mixture may be a simple addition of the signals. As described above, any desired alteration performed during conversion, such as frequency filtering, may be performed before this mixing is performed.

The signals may be sampled at a number of points in time and each sample divided into frequency intervals or frequency bins. The level may be determined within each frequency interval/bin and the proportion determined as the proportion or percentage of frequency bins (across the samples) where the level of the first signal/audio signal deviates more than the number or limit from that of the mixed signal/audio signal. The limit may be set as a percentage of the level of the first or mixed signal/audio signal or as a fixed numerical value.

Presently, it is desired to use time samples of a duration of 400 ms. However, samples may be used of durations of 200 ms or less, such as 100 ms or less, if desired. Also, samples of 400 ms or more, such as 500 ms or more may be used if desired.

Usually, the level is determined within a sample and a frequency interval by averaging the level within the interval and over the time duration of the sample. Other mathematical functions may be used instead (lowest value, highest value or the like).

The dividing of time samples into frequency intervals/bins may be a dividing into any number of intervals/bins. Often 31 bins are used, but any number, such as at least 10 intervals/bins, such as at least 20 intervals/bins, such as at least 30 intervals/bins, such as at least 40 intervals/bins, or at least 50 intervals/bins may be used.

The higher the proportion, the more different will the signals be over time and frequency, and the more interfering will the second signal be.

An alternative manner of determining this parameter is to use the CASP preprocessor to process the first (audio) signal, and also to process the mixture of the first and second (audio) signals. The output is therefore a series of 2D matrices representing the, preferably 400 ms, frames of the first signal, and similar for the mixture.

After preprocessing, a sum is calculated across samples as before giving frames by (31) frequency bins, and this is done separately for both the first signal 2D matrices and for the mixture 2D matrices. Next, for every frame and every frequency bin, the first signal value is divided by the mixture value. The resulting values will tend to vary from 0-1. Next, for every frequency bin and every frame, it is determined how many of these values exceed 0.9. Finally this number is divided by the total number of frames and frequency bins. Thus, a feature is obtained describing the proportion of frequency bins across 400 ms frames which are more than 90% dominated by the target.

The highest frequency interval may be obtained by sampling a mixture of the first and second signals/audio signals. The levels are determined within each frequency interval of the sample and the frequency interval with the highest level is determined. The higher the frequency, such as the centre frequency, of the frequency interval, the higher will the respective interference value be.

In one embodiment, this interval may be determined using the CASP preprocessor output of the mixture programme using non-overlapping frames. The frames may have any time duration, such as 1-1000 ms, preferably 100-700 ms, such as 200-600 ms, such as 300-500 ms, such as around 400 ms.

The result is a 2D matrix of (thousands of) samples by (31) frequency bins. Next, a sum is determined across samples, giving 31 values (one per frequency bin), and the highest value Is selected. This feature therefore describes the characteristic of the mixed first and second (audio) signals in a way which is affected both by the overall level of the mixed signals and the overlap of energy in similar frequency bins. The coefficient for this feature is negative, meaning that when this energy value is higher the situation is less acceptable; i.e. this hints that a large degree of overlap between the first and second (audio) signals in the highest level frequency bins makes the situation less acceptable.

Naturally, the frequency intervals may be selected in any desired manner, as may the time samples, which may also be overlapping or non-overlapping.

In one embodiment, the controller is configured to determine a change in one or more of:

- a level of the second signal or the second audio signal,
- a level of the first signal or the first audio signal,
- a frequency filtering of the second signal or the second audio signal,
- a delay of the providing of the second signal vis-à-vis the providing of the first signal, and
- a dynamic range of the second signal and/or the second audio signal.

The level of the first/second signal may be a numerical value describing e.g. a maximum level or a mean level thereof. This value may describe an amplification of a normalized signal if desired. The level of an audio signal may describe a maximum or mean sound pressure at a predetermined position in the zone, such as at a centre thereof or at a person's ear.

Changing the level may be a change of a level of the first/second signal before the conversion. Alternatively, the conversion may be changed so that the first/second audio signal has a changed level.

The level of a signal may be altered in a number of manners. In one situation, the level at all frequencies or in all frequency intervals of the signal may be altered, such as to the same degree (same dB or same percentage). Alternatively, the highest or lowest level frequencies or frequency intervals may be amplified or reduced to affect the maximum/minimum and/or average level.

A frequency filtering usually will be a reduction or an amplification of the level at some frequencies or within at least one frequency interval relative to other frequencies or one or more other frequency intervals. This filtering may be a band pass filtering, a high pass or a low pass filtering, if desired. Alternatively, a more complex filtering may be performed where high level frequencies/frequency intervals are reduced in level and/or where low level frequencies/frequency intervals are amplified in level.

Other parameters of the first/second signals may be altered to cause a change in any of the above features on the basis of which the interference value may be determined.

An altering of a dynamic range may also be the reduction of high level frequencies and/or amplification of low level frequencies—or vice versa if a larger dynamic range is desired.

Providing an altered delay between the providing/conversion/mixing of the first and second signals—i.e. a delay of the first audio signal vis-à-vis the second audio signal has the advantage that time-limited high level parts, low level parts or parts with high/low dynamic range of the first signal/first audio signal may be correlated time-wise with such parts of the second signal or second audio signal. The effect thereof may be less interference, as is described above.

In a second aspect, the invention relates to a method of providing sound into two sound zones, the method comprising:

- accessing a first signal and a second signal,
- converting the first and second signals into a speaker signal for each of a plurality of speakers configured to provide, on the basis of the speaker signals, a first audio signal in a first zone of the two sound zones and a second audio signal in a second zone of the two sound zones,
- deriving, from at least the second audio signal and/or the second signal, an interference value,
- if the interference value exceeds a predetermined threshold, determining a change in a parameter of the conversion,
- adapting the conversion in accordance with the determined change of the parameter.

The sound provided usually will differ from position to position in the zones. As mentioned above, the zones may be provided in the same space, and no sound barrier of any type need be provided between the zones.

The accessing of the first and second signals may be a reception of one or more remote signals, such as via an airborne signal, via wires or the like. A source of one or more of the signals may be an internet-based provider, such as a radio station, a media provider, streaming service or the like. One or both systems may alternatively be received or accessed in or at a local media store, such as a hard disc, DVD drive, flash drive or the like, accessible to the system.

The conversion of the first and second system to the speaker signals may be as is known to the skilled person. The first and second signals may be mixed, filtered amplified and the like in different manners or with different parameters to obtain each speaker signal, so that the resulting audio signals in the zones are as desired.

The deriving of the interference signal is known to the skilled person. A number of manners may be used. A simple manner, as is described above and elaborated on below, is a determination based on a level of the second audio signal and/or the second audio signal.

The interference value increases if the interference from the second signal/audio signal increases. When the interference value exceeds a predetermined threshold, action is taken.

The threshold may be defined in any desired manner, such as depending on the manner in which the interference value is determined.

The parameter usually is a parameter which, when changed as determined, will bring the interference value to or below the threshold value. Different parameters and different types of changes are described above and elaborated on below.

The adaptation of the conversion may be merely the changing of the parameter. Additional changes may be made if desired.

Naturally, the method will usually comprise the step of, before determining the parameter, speakers receiving the speaker signals and generating the first/second audio signals while the interference value is determined when the audio signals are generated and the subsequent step of, after the adapting step, the speakers receiving the speaker signals and outputting the first/second audio signals, where the subsequently determined interference value is now reduced.

In one embodiment, the deriving step comprises deriving the interference value also on the basis of the first audio signal and/or first signal. As mentioned above, the interference value often relates to the relative difference between the first and second signals/audio signals.

In one embodiment, the determining step comprises determining a change of a number of parameters of the conversion. Different manners of adapting the conversion may affect the interference value, whereby different parameters may be selected to achieve the desired reduction of the interference value.

In one embodiment, the determining step comprises outputting or proposing the determined parameter change and wherein the adapting step comprises initially receiving an input acknowledging the parameter change.

Thus, instead of, which may be one embodiment, automatically adapting the parameter(s) of the conversion, the determined parameter change may be proposed to a user/listener, who may enter an input, as an acceptance, where after the conversion is adapted accordingly. Naturally, a number of alternatives of parameter changes may be provided, where the input may be a selection of one of the alternatives, where the conversion is there after adapted according to the selected alternative.

In one embodiment, the method further comprises the step of receiving a second input identifying one or more parameter settings, the deriving step comprising deriving the interference value on the basis of also the one or more parameter settings, and the adapting step comprising adapting the conversion also in accordance with the one or more parameter settings of the second input.

Usually, a user may adapt the audio signal listened to, such as changing the signal source, the signal contents (another song, for example), changing a level of the signal and potentially also filtering it so enhance low or a high frequency contents, for example. Naturally, the first/second signals may be adapted accordingly prior to the conversion, but this would be the same as altering the pertaining signal in the conversion.

If a user makes such changes, the interference value may change. Thus, the determined parameter change may be determined also on the basis of such user changes.

As mentioned above, it is desirable that the deriving step comprises determining whether the first signal and/or audio signal comprises speech. Determining whether the signal comprises or represents speech may be based on the signal not comprising or comprising only slightly periodic or rhythmic contents and/or harmonic frequencies.

In one embodiment, and preferably in the situation where the first signal/audio signal does not represent or comprise speech, the deriving step comprises deriving the interference value on the basis of one or more of:

- a signal strength of the second audio signal and/or the second signal,
- a signal strength of the first audio signal and/or the first signal,
- a PEASS value based on the first and second audio signals and/or the first and second signals,
- a difference in level between the levels of different, predetermined frequency bands of the second signal and/or the second audio signal, and
- a number of predetermined frequency bands within which a predetermined maximum level difference exists between the level of the first signal and/or audio signal and the level of the second signal and/or audio signal.

These parameters and their determination are described above.

In another embodiment, and preferably when the first signal/audio signal represents or comprises speech, the deriving step comprises deriving the interference value on the basis of one or more of:

- a proportion, over time, where a level of the first signal or first audio signal exceeds that of the second signal or the second audio signal by a predetermined threshold,
- an Overall Perception Score of a PEASS model based on the first and second audio signals and/or the first and second signals,
- a dynamic range of the second signal and/or the second audio signal over time,
- a proportion of time and frequency intervals wherein a level of the first signal or first audio signal exceeds a predetermined number multiplied by a level of a mixture of the first and second signals or first and second audio signals, and
- a highest frequency interval of a number of frequency intervals where a level of a mixture of the first and second signals or first and second audio signals is the highest at a point in time.

These parameters are described above.

In one embodiment, the controller is configured to determine a change in one or more of:

- a level of the second signal or the second audio signal,
- a level of the first signal or the first audio signal,
- a frequency filtering of the second signal or the second audio signal,
- a delay of the providing of the second signal vis-à-vis the providing of the first signal, and
- a dynamic range of the second signal and/or the second audio signal.

In the following, a preferred embodiment is described with reference to the drawing.

FIGURES

FIG. 2 is a side-by-side comparison of the data sets to be used for training and validation.

Figure 4A:
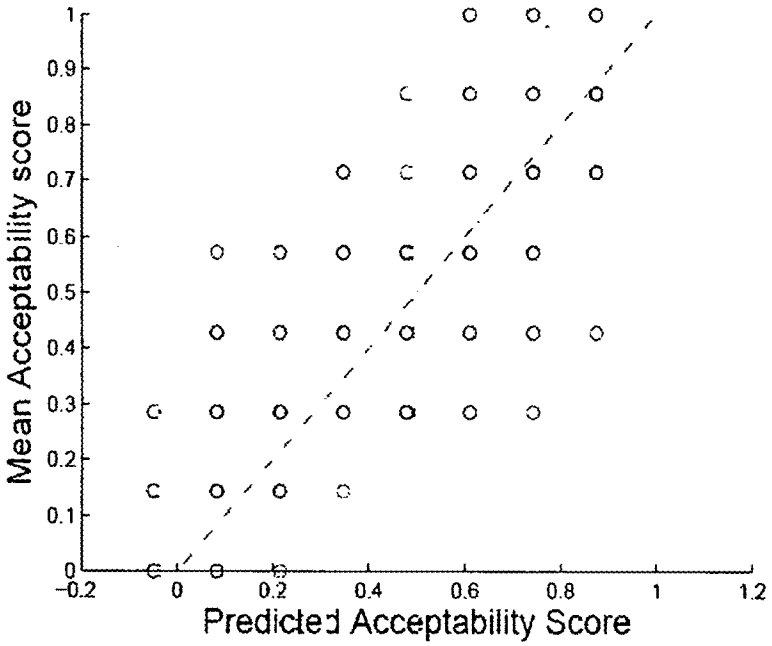
Figure 4B:
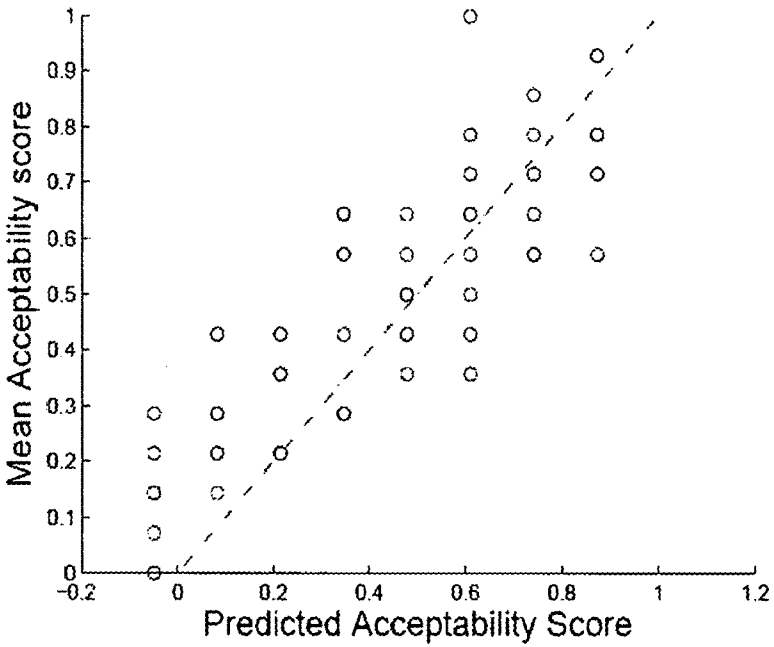

FIG. 4A illustrates mean acceptability scores averaged across subjects only. FIG. 4B illustrates mean acceptability scores averaged across subjects and repeats. Predicted acceptability scores plotted against mean acceptability scores for validation. 1. The black dash-dotted line represents a perfect positive linear correlation. In plot a the mean acceptability scores are averaged across seven subjects for 144 trials, whereas in plot b the mean acceptability scores are averaged across seven subjects and repeats for 72 trials.

Figure 5:
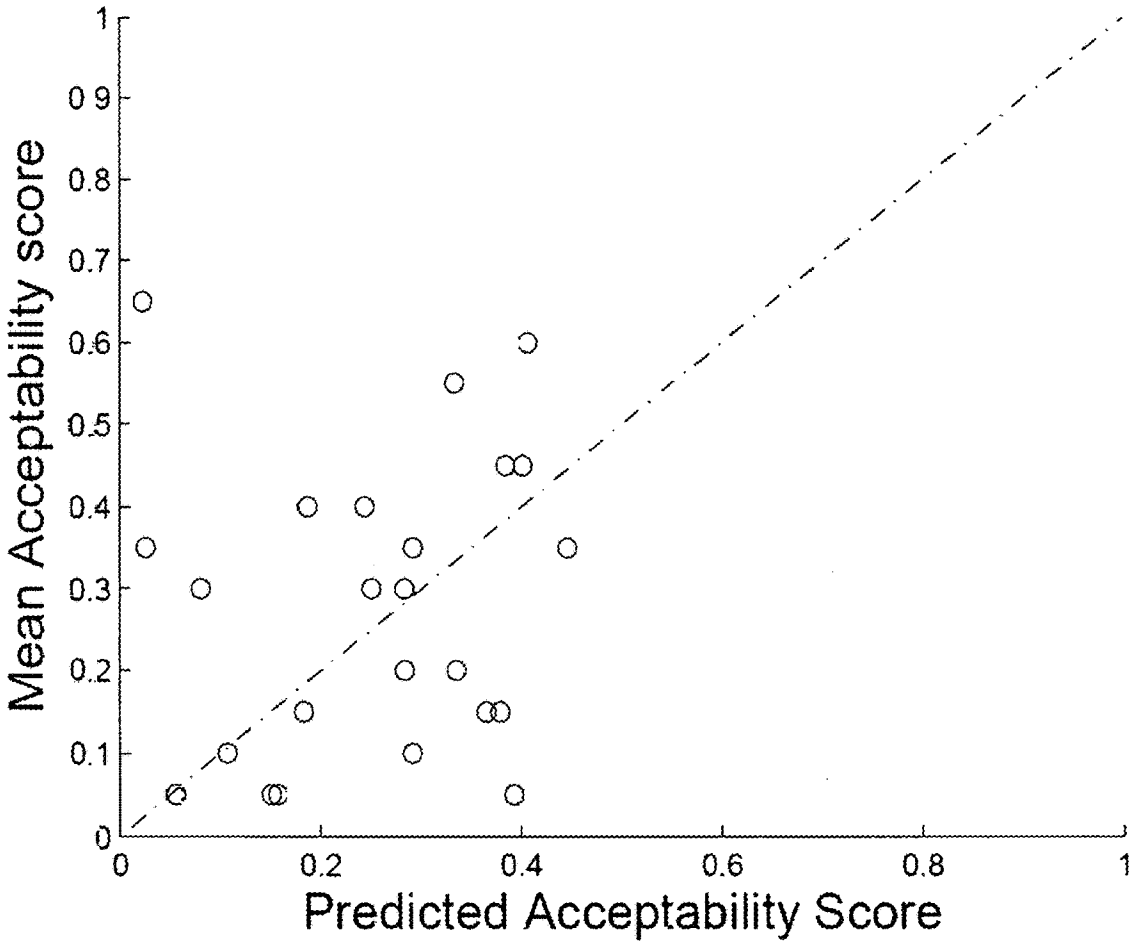

FIG. 5 illustrates a predicted acceptability scores plotted against mean acceptability scores reported by the 20 subjects. The black dash-dotted line represents a perfect positive linear correlation.

Figure 6:
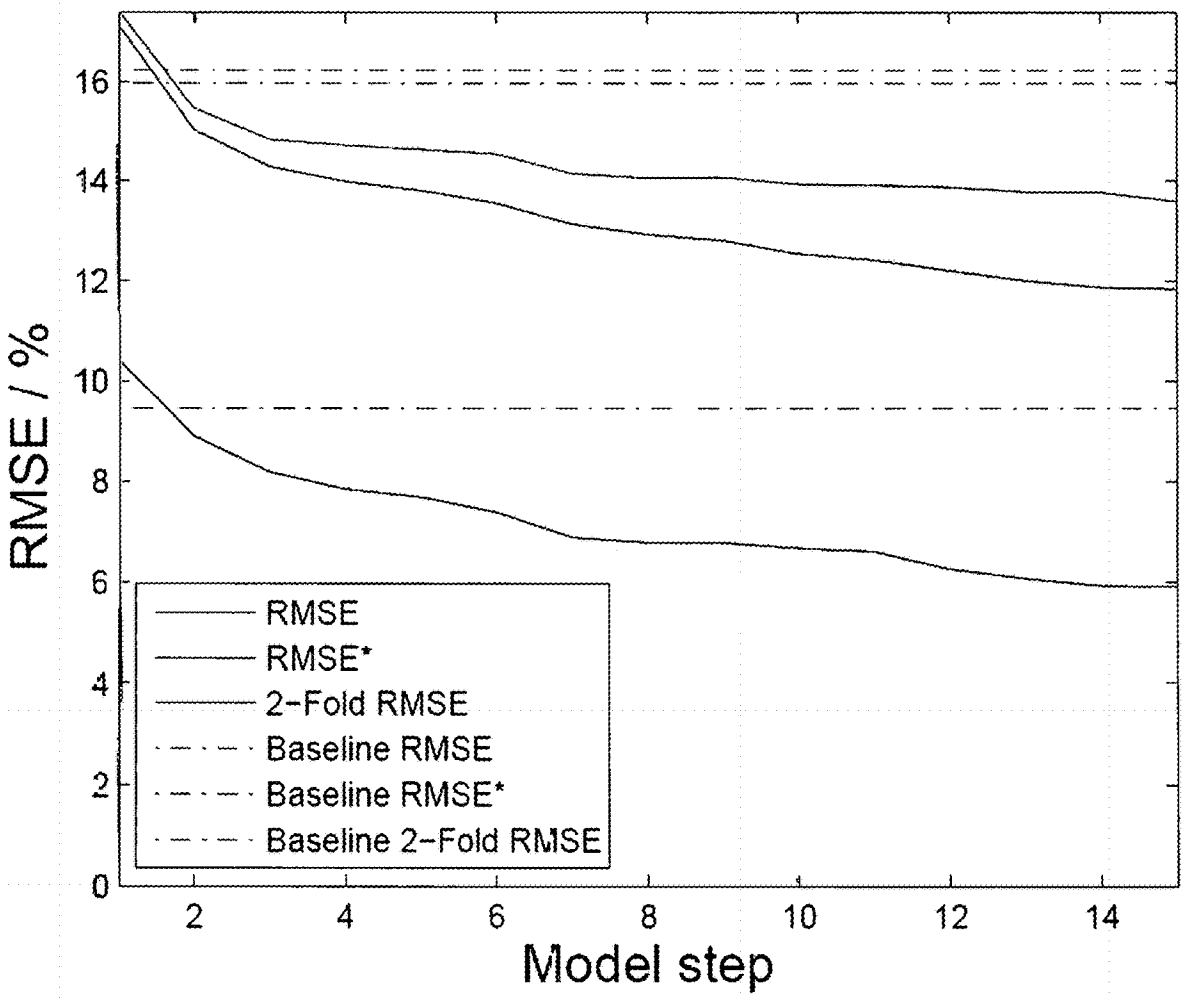

FIG. 6 illustrates a plot showing the accuracy and generalisability of the acceptability model constructed in each step of the stepwise regression procedure compared with the benchmark model. the solid lines represent measurements for the constructed acceptability model and the dot-dashed lines represent measurements for the benchmark model. In each case the blue line represents the RMSE, the black line represents the RMSE*, and the red line represents the 2-fold RMSE.

FIG. 7 illustrates features, coefficients, and VIF for the first 3 steps of model construction. For clarity, the intercepts have been excluded.

Figure 8B:
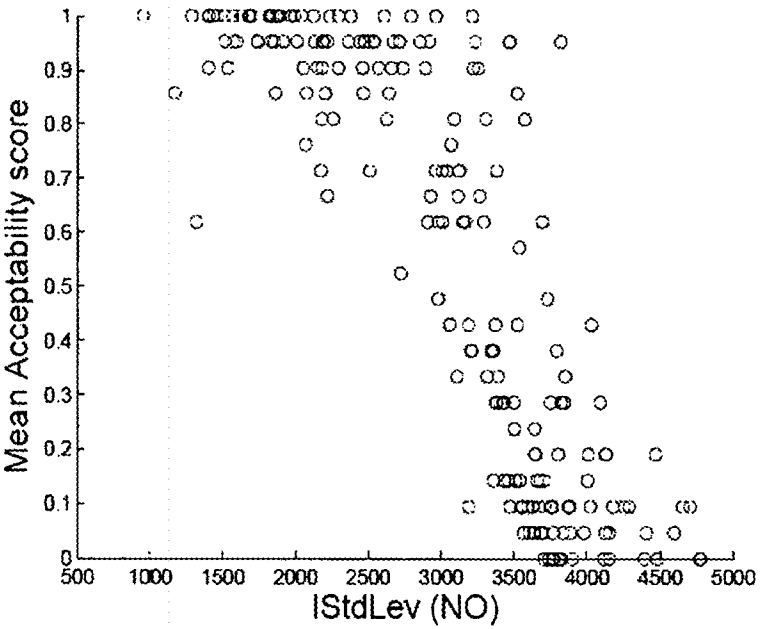
Figure 8A:
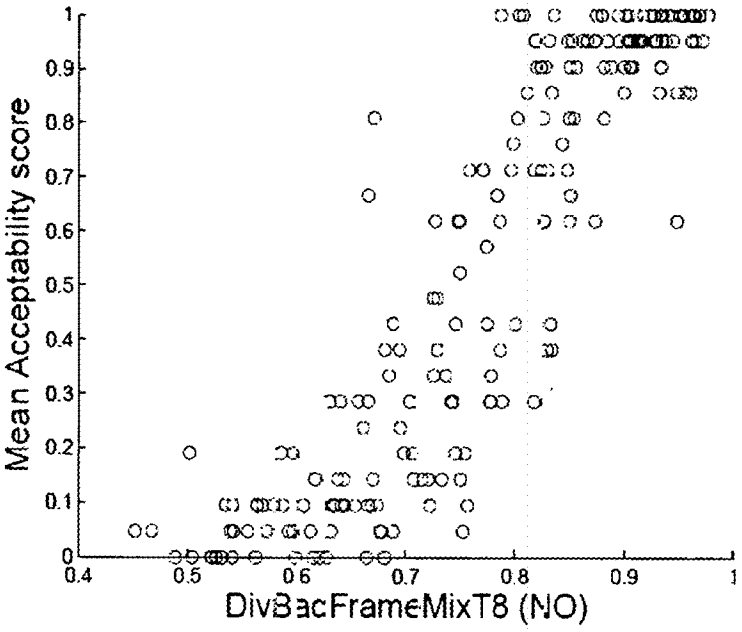

FIG. 8A illustrates mean acceptability scores plotted against feature 1 of the CASP based acceptability model. FIG. 8B illustrates mean acceptability scores plotted against feature 2 of the CASP based acceptability model. Predicted acceptability scores plotted against the features of the CASP based acceptability model.

Figure 9A:
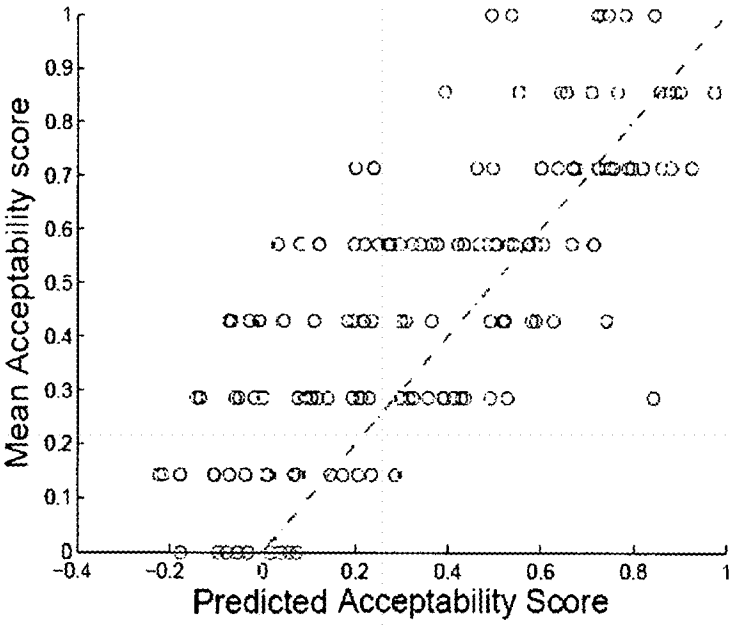
Figure 9B:
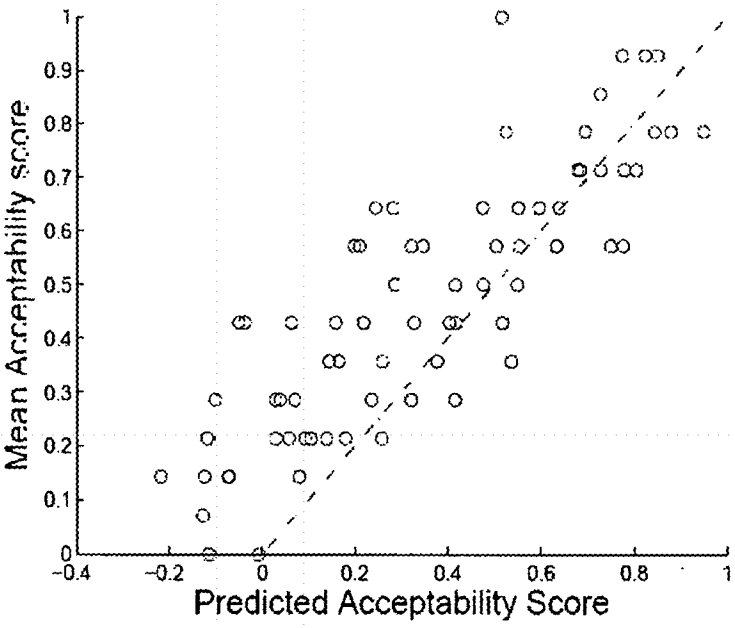

FIG. 9A illustrates mean acceptability scores averaged across subjects only. FIG. 9B illustrates mean acceptability scores averaged across subjects and repeats. Predicted acceptability scores plotted against the mean acceptability scores of validation 1. The black dash-dotted line represents a perfect positive linear correlation. In plot a the mean acceptability scores are averaged across seven subjects for 144 trials, whereas in plot b the mean acceptability scores are averaged across seven subjects and repeats for 72 trials.

Figure 10:
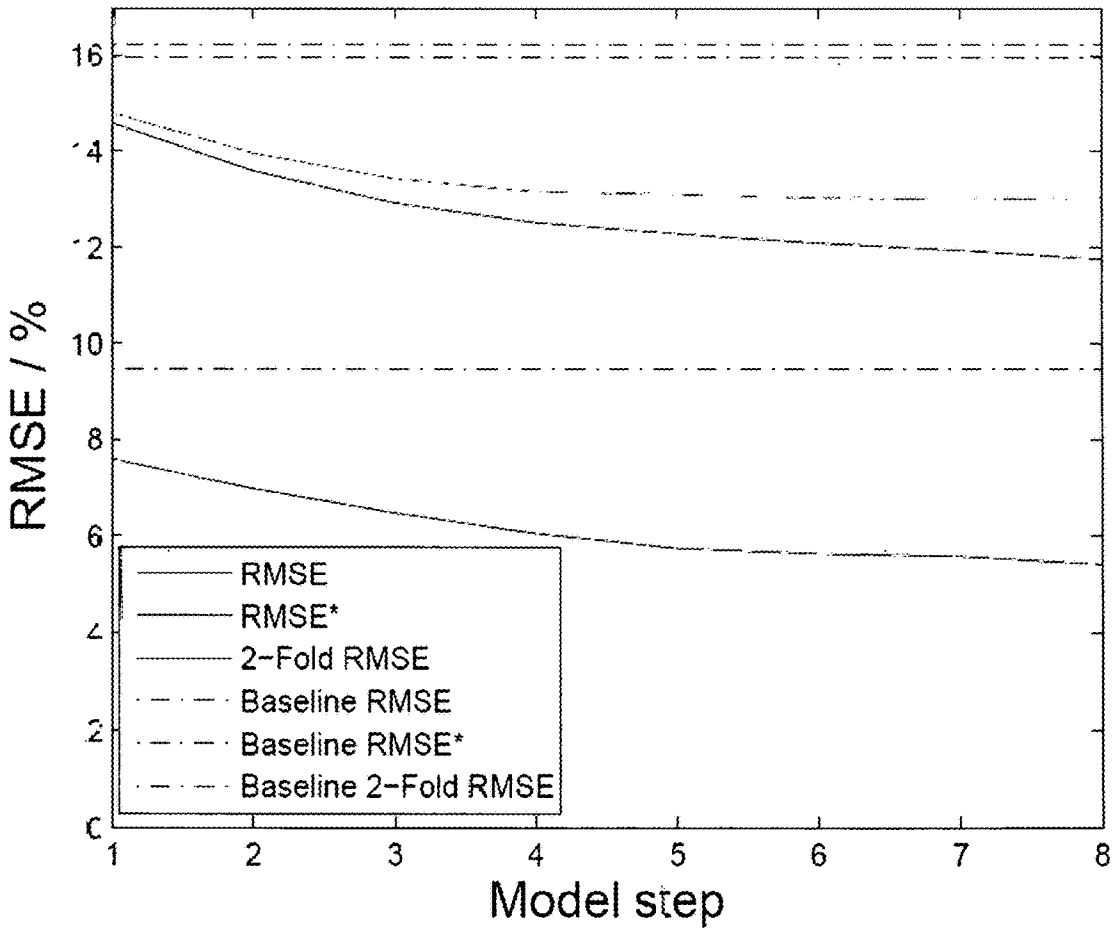

FIG. 10 illustrates the accuracy and generalisability of the acceptability model constructed in each step of the stepwise regression procedure compared with the benchmark model. the solid lines represent measurements for the constructed acceptability model and the dot-dashed lines represent measurements for the benchmark model. In each case the blue line represents the RMSE, the black line represents the RMSE*, and the red line represents the 2-fold RMSE.

FIG. 11 shows the selected features, their ascribed coefficients, and the calculated VIF for each of the first 7 steps.

Figure 12B:
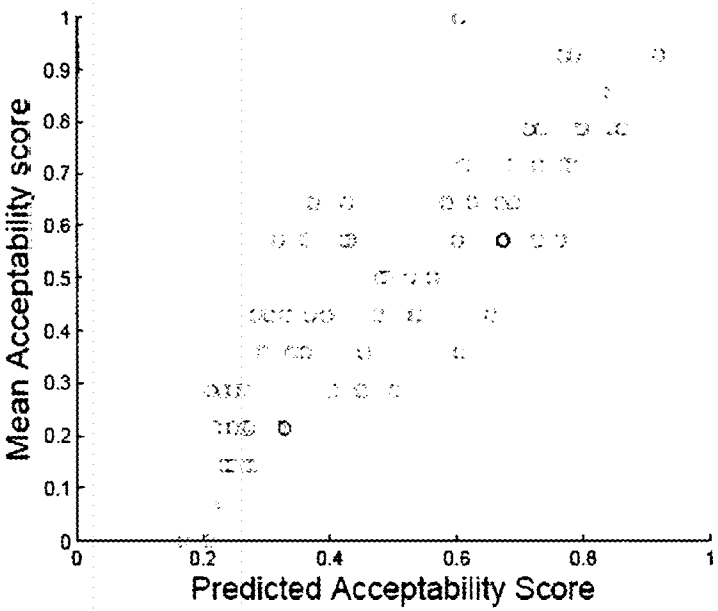
Figure 12A:
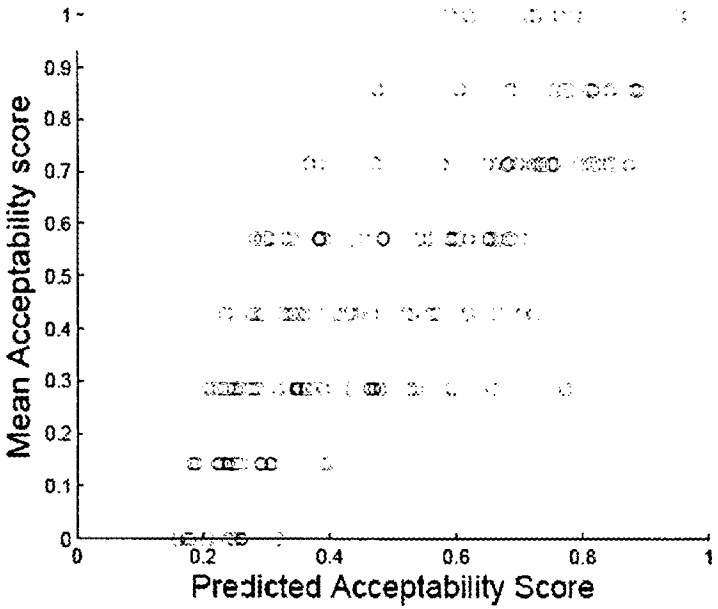

FIG. 12A illustrates mean acceptability scores averaged across subjects only. FIG. 12B illustrates mean acceptability scores averaged across subjects and repeats. Predicted acceptability scores plotted against the mean acceptability scores of validation 1. The black dash-dotted line represents a perfect positive linear correlation. In plot a the mean acceptability scores are averaged across seven subjects for 144 trials, whereas in plot b the mean acceptability scores are averaged across seven subjects and repeats for 72 trials.

Figure 13:
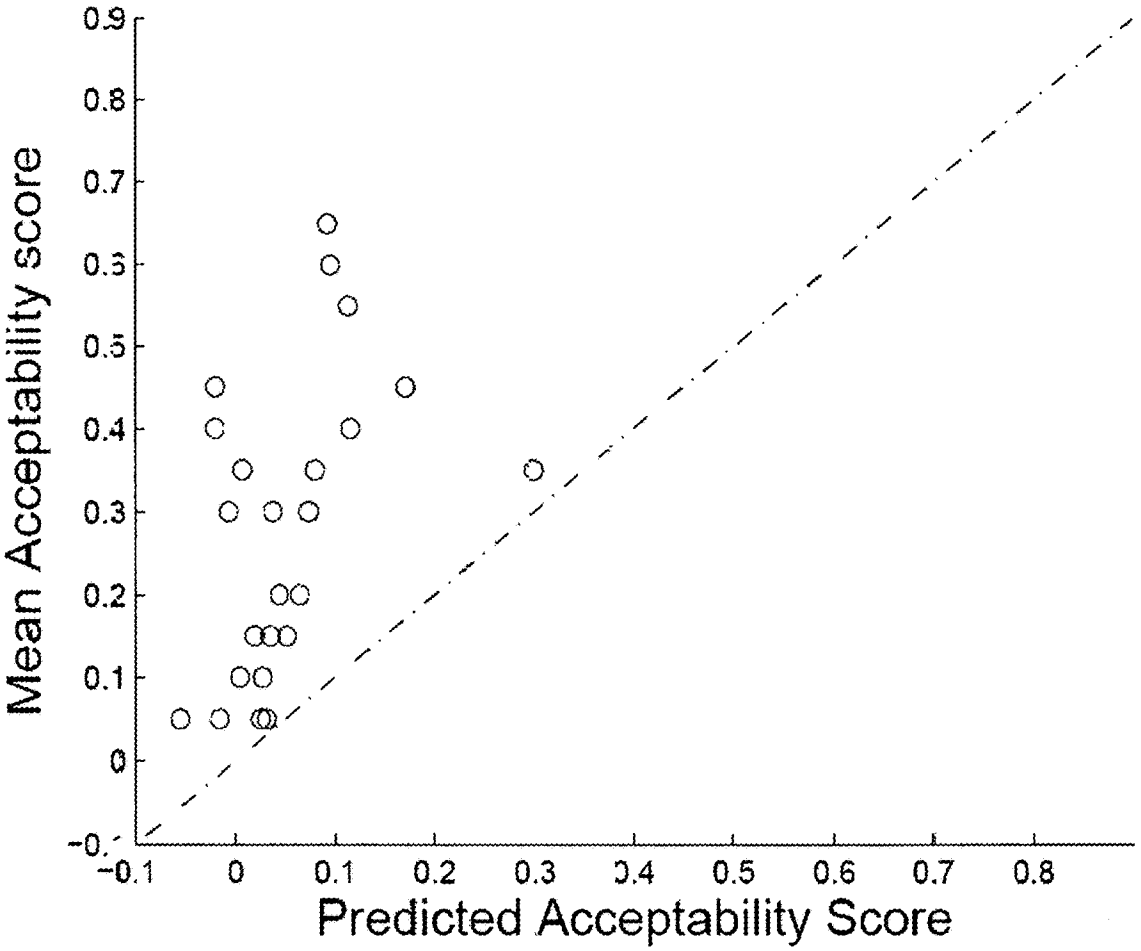

FIG. 13 illustrates predicted acceptability scores plotted against mean acceptability scores reported by the 20 subjects. The black dash-dotted line represents a perfect positive linear correlation.

Figure 14:
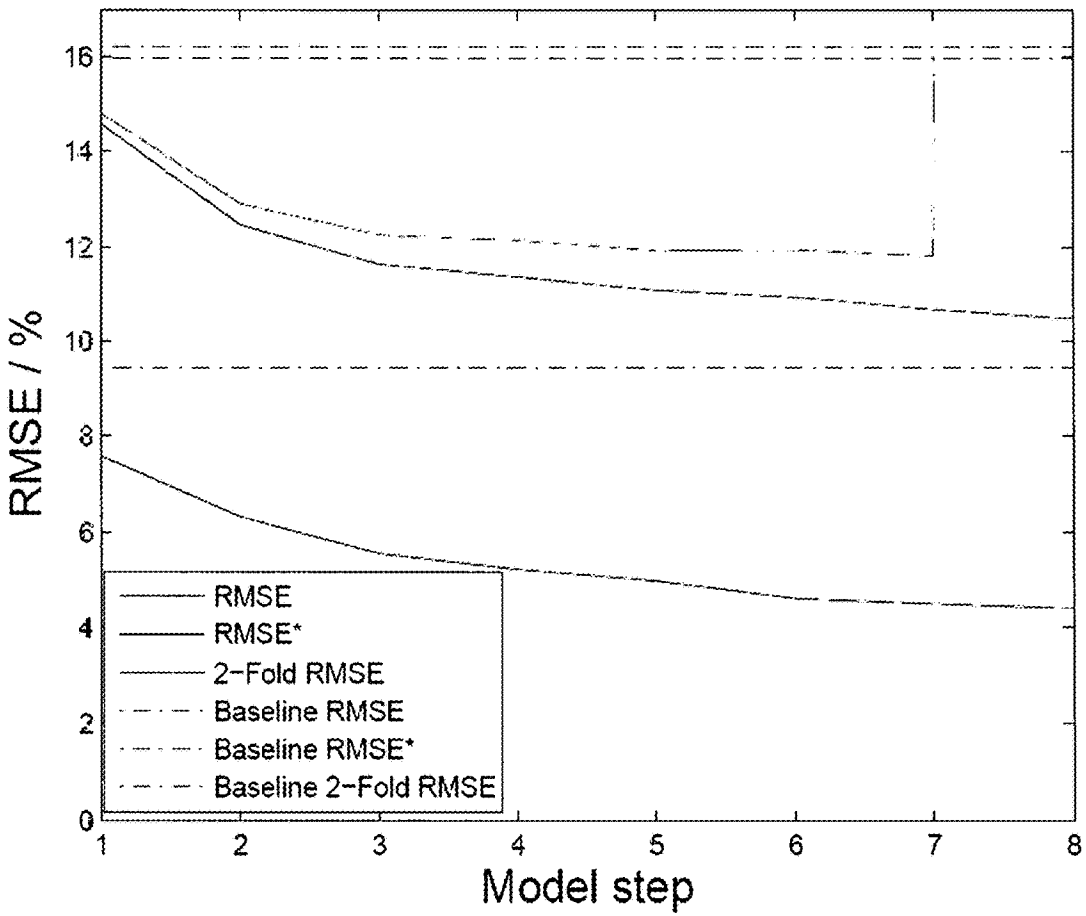

FIG. 14 illustrates a plot showing the accuracy and generalisability of the acceptability model constructed in each step of the stepwise regression procedure compared with the benchmark model. the solid lines represent measurements for the constructed acceptability model and the dot-dashed lines represent measurements for the benchmark model. In each case the blue line represents the RMSE, the black line represents the RMSE*, and the red line represents the 2-fold RMSE.

FIG. 15 illustrates features, coefficients, and multicollinearity for the first 6 steps of model construction. For clarity, the intercepts have been excluded.

Figure 16A:
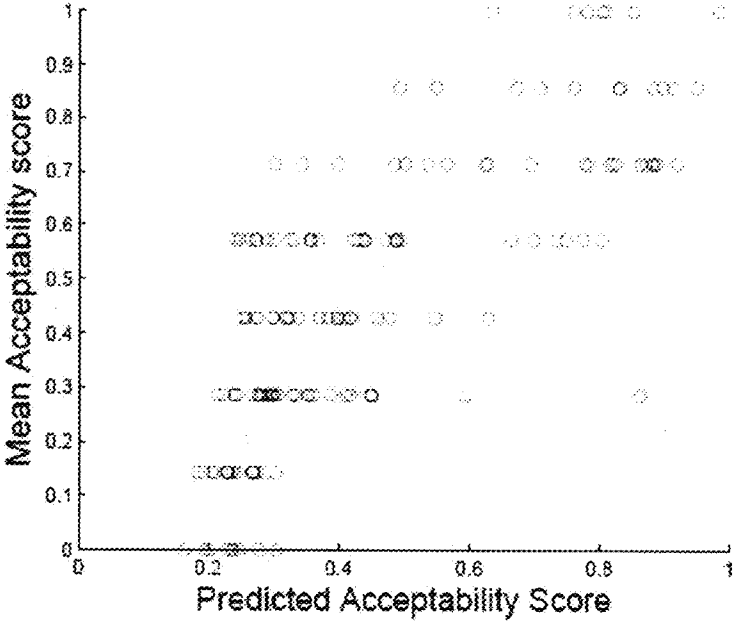
Figure 16B:
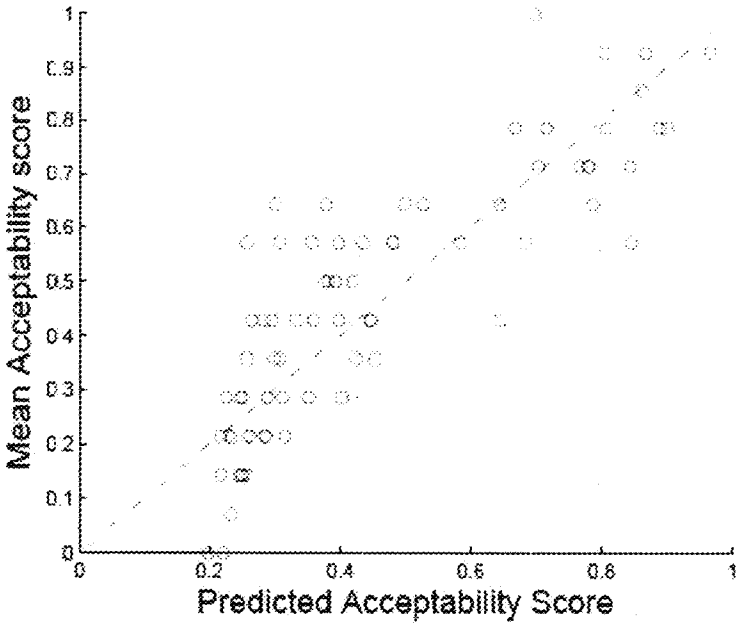

FIG. 16A illustrates mean acceptability scores averaged across subjects only. FIG. 16B illustrates mean acceptability scores averaged across subjects and repeats. Predicted acceptability scores plotted against the mean acceptability scores of validation 1. The black dash-dotted line represents a perfect positive linear correlation. In plot a the mean acceptability scores are averaged across seven subjects for 144 trials, whereas in plot b the mean acceptability scores are averaged across seven subjects and repeats for 72 trials.

Figure 17:
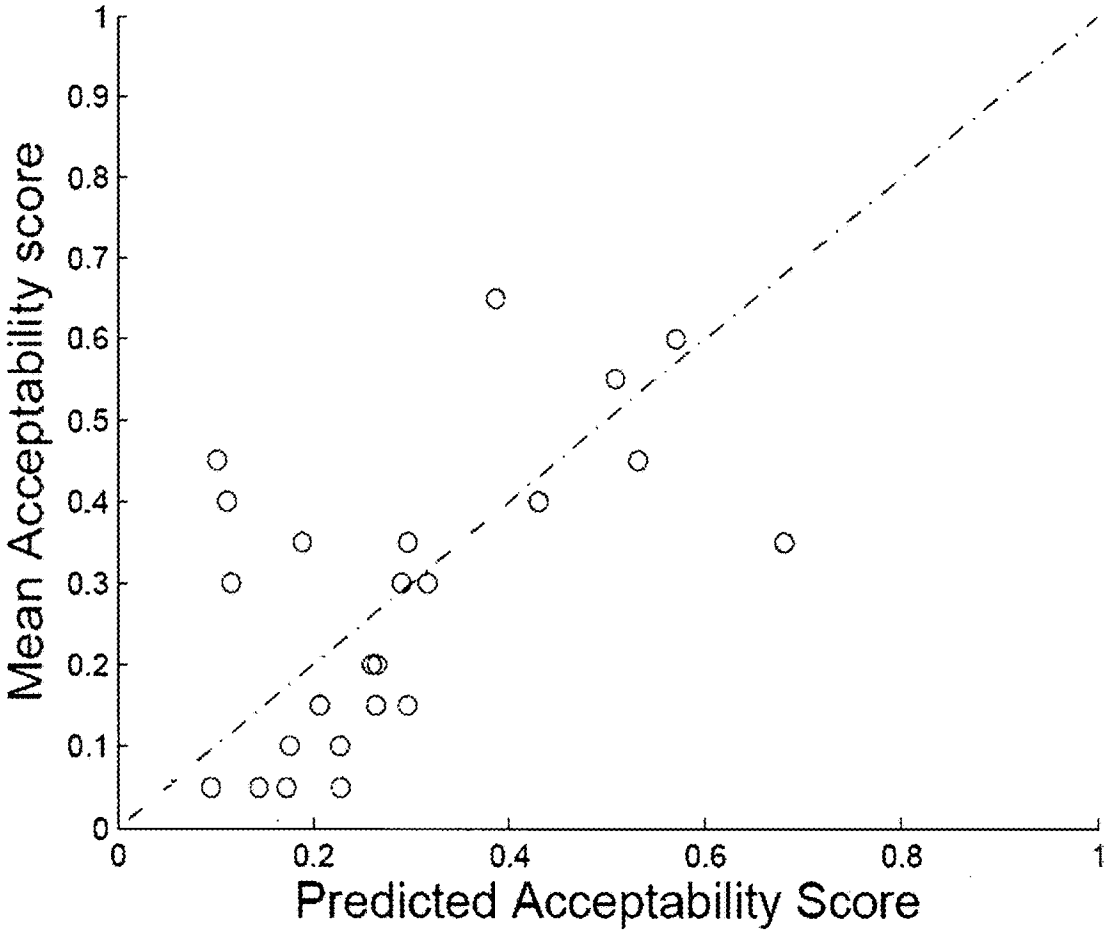

FIG. 17 illustrates predicted acceptability scores plotted against mean acceptability scores reported by the 20 subjects. The black dash-dotted line represents a perfect positive linear correlation.

FIG. 18 illustrates a side-by-side comparison of the performance of two acceptability models. Scores are highlighted in green and red by indicating performance metrics which exceeded or fell short of those of the benchmark model.

FIG. 19 illustrates correlation scores for PESQ and POLQA predictions.

FIG. 20A illustrates mean acceptability scores averaged across subjects only. FIG. 20B illustrates mean acceptability scores averaged across subjects and repeats. PESQ and POLQA predictions plotted against mean acceptability scores averaged across repeats for validation 1.

FIG. 21 illustrates radio stations used in random sampling procedure. Format details from Wikipedia.

Figure 22:
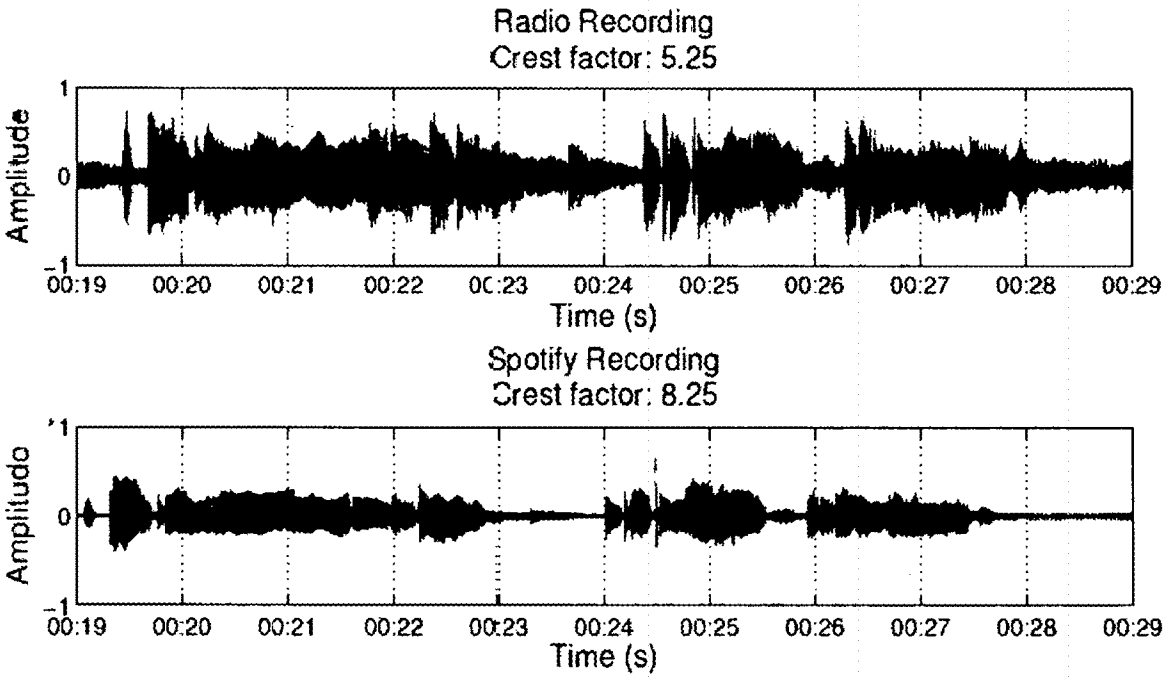

FIG. 22 illustrates comparison of recording from radio against recording from Spotify for recording number 218. The crest factor (peak-to-rms ratio) indicates the higher degree of compression in the radio recording seen in the waveform.

Figure 23:
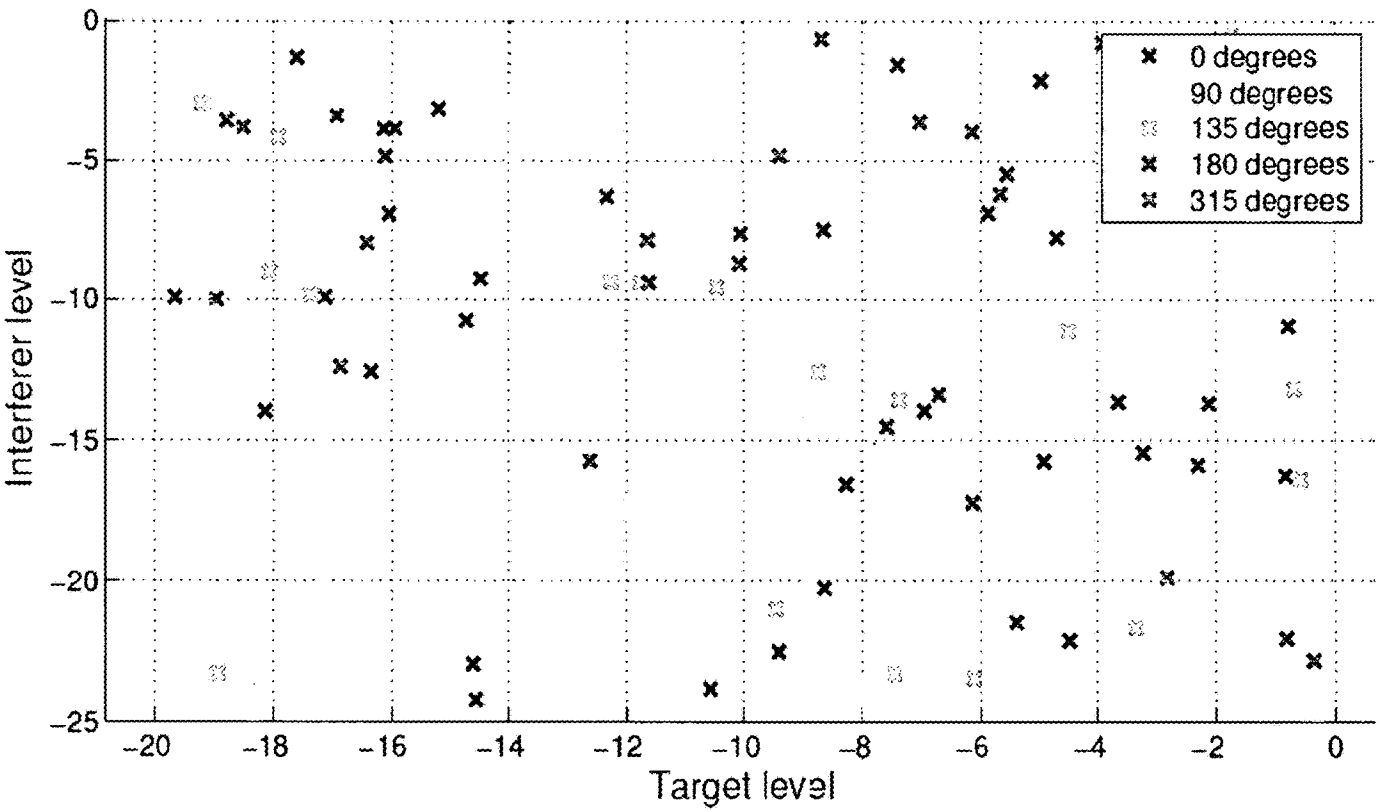

FIG. 23 illustrates distribution of factor levels. Interferer location indicated by colour.

Figure 24:
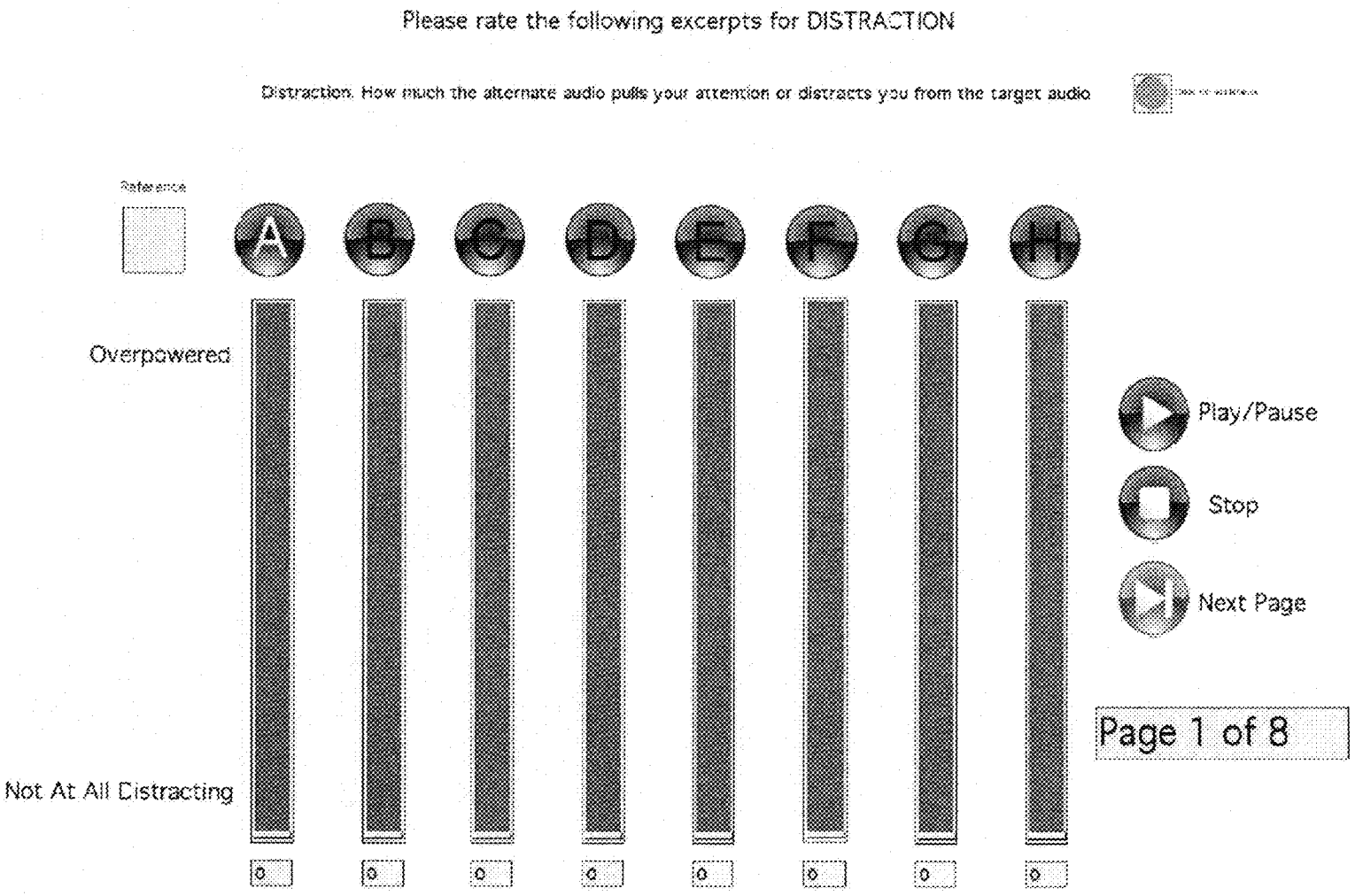

FIG. 24 illustrates an interface for distraction rating experiment.

Figure 25:
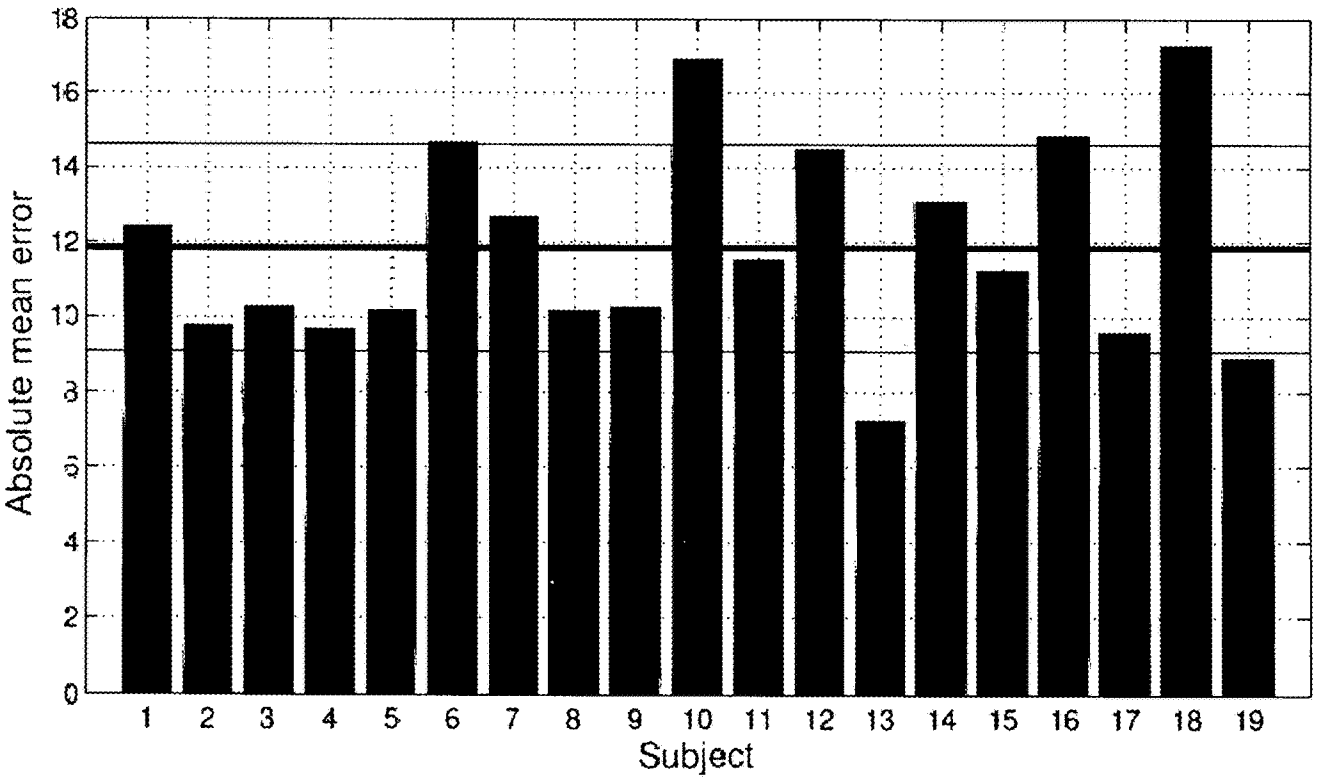

FIG. 25 illustrates absolute mean error for repeated stimuli by subject. Thick horizontal line shows mean across subjects, thin horizontal lines show ±1 standard deviation.

Figure 26:
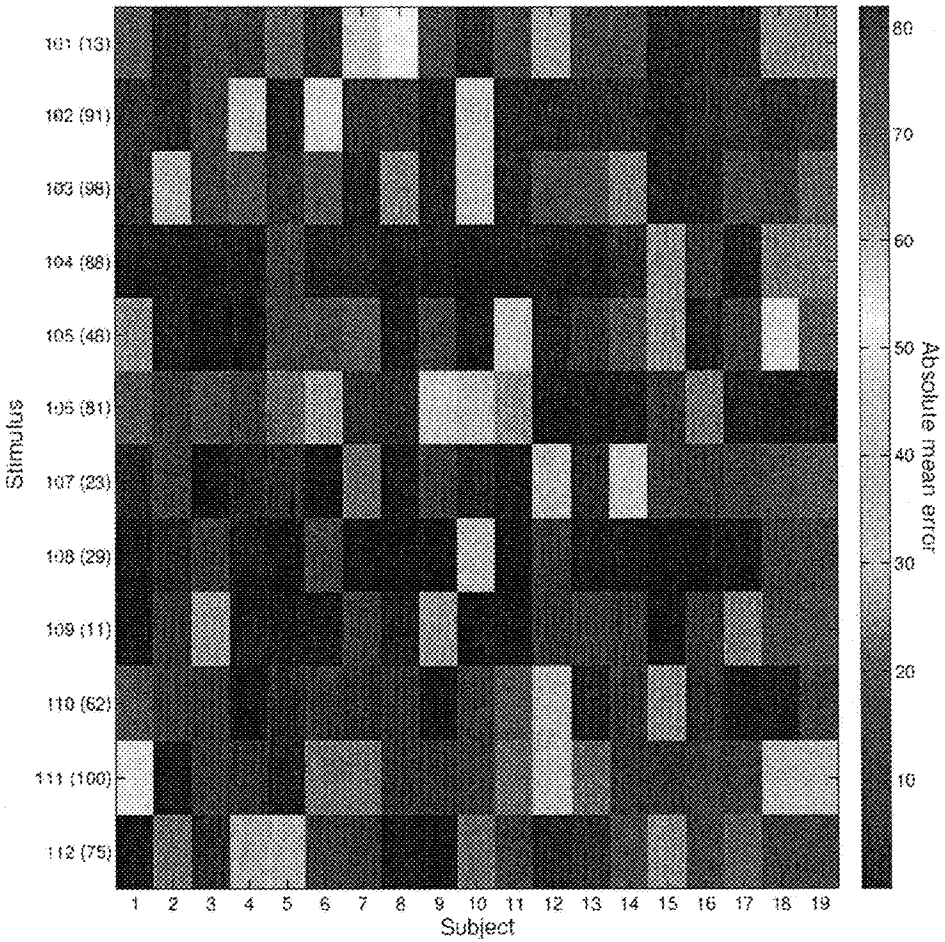

FIG. 26 illustrates a heat map showing absolute error for each subject and stimulus. The colour of each cell represents the size of the absolute error.

Figure 27:
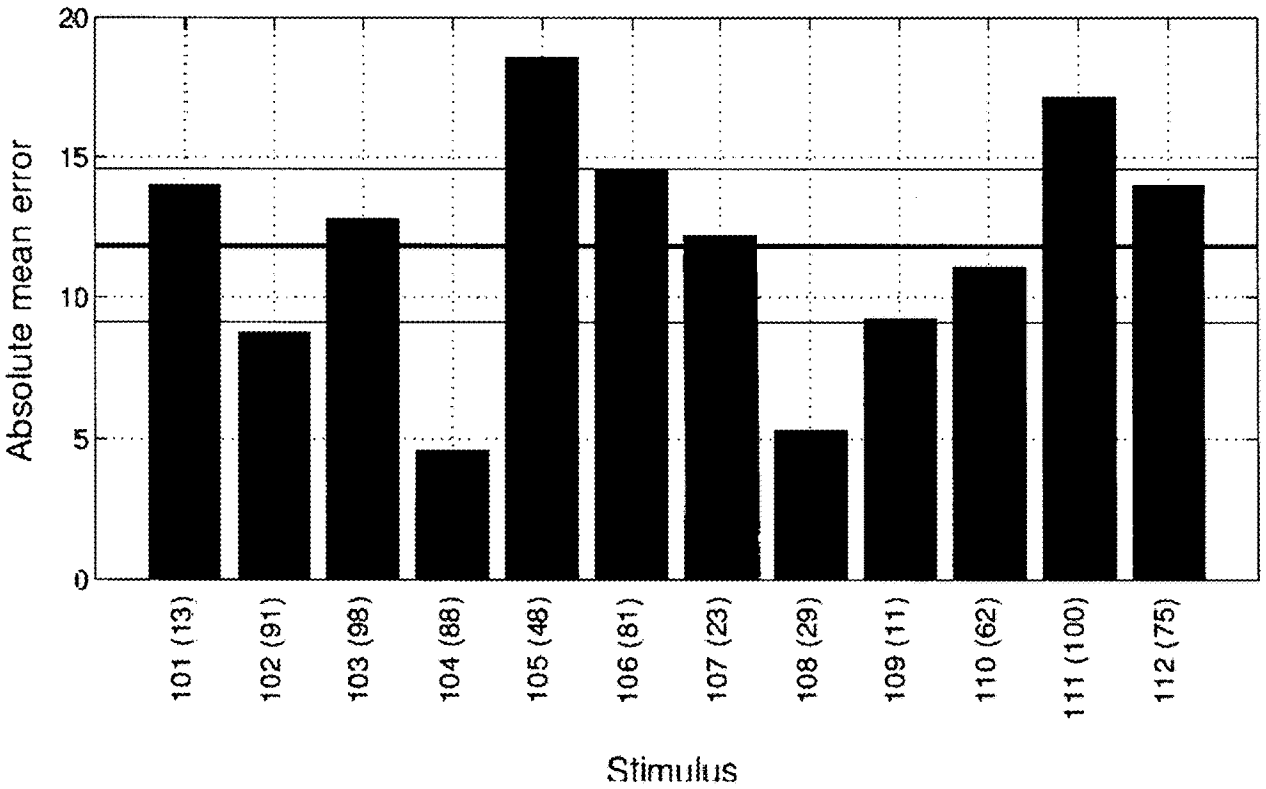

FIG. 27 illustrates absolute mean error by stimulus. Thick horizontal line shows mean across stimuli, thin horizontal lines show ±1 standard deviation.

Figure 28:
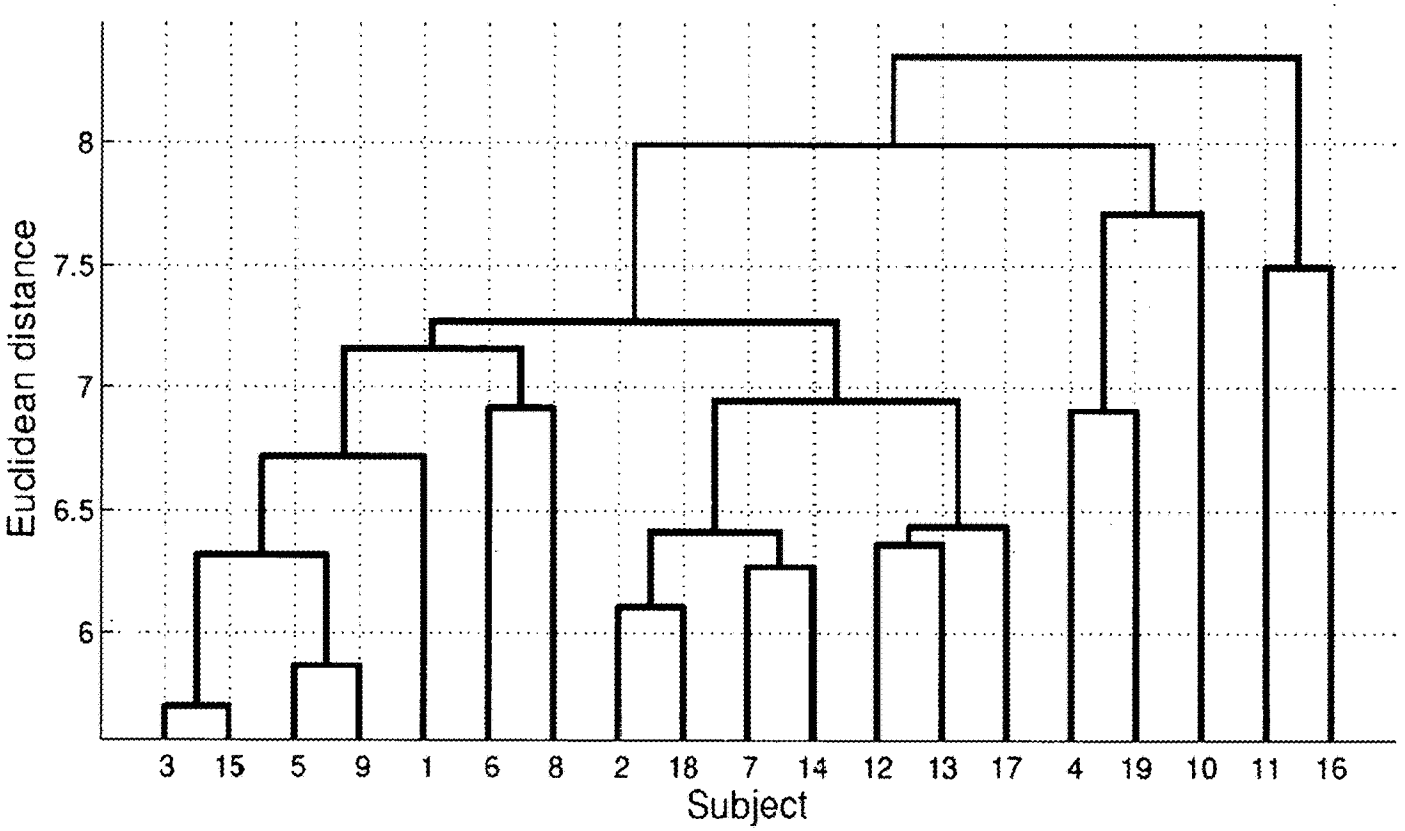

FIG. 28 illustrates a dendrogram showing subject groups. Agglomerative hierarchical clustering performed using the average Euclidean distance between all subjects in each cluster.

Figure 29:
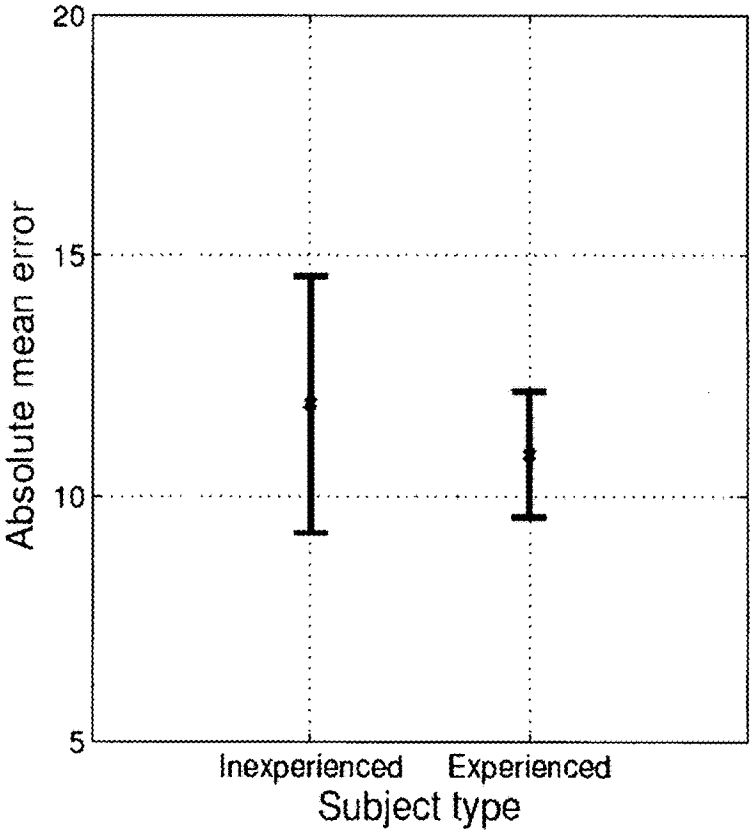

FIG. 29 illustrates absolute mean error (across stimulus) by subject type. Error bars show 95% confidence intervals calculated using the t-distribution.

Figure 30:
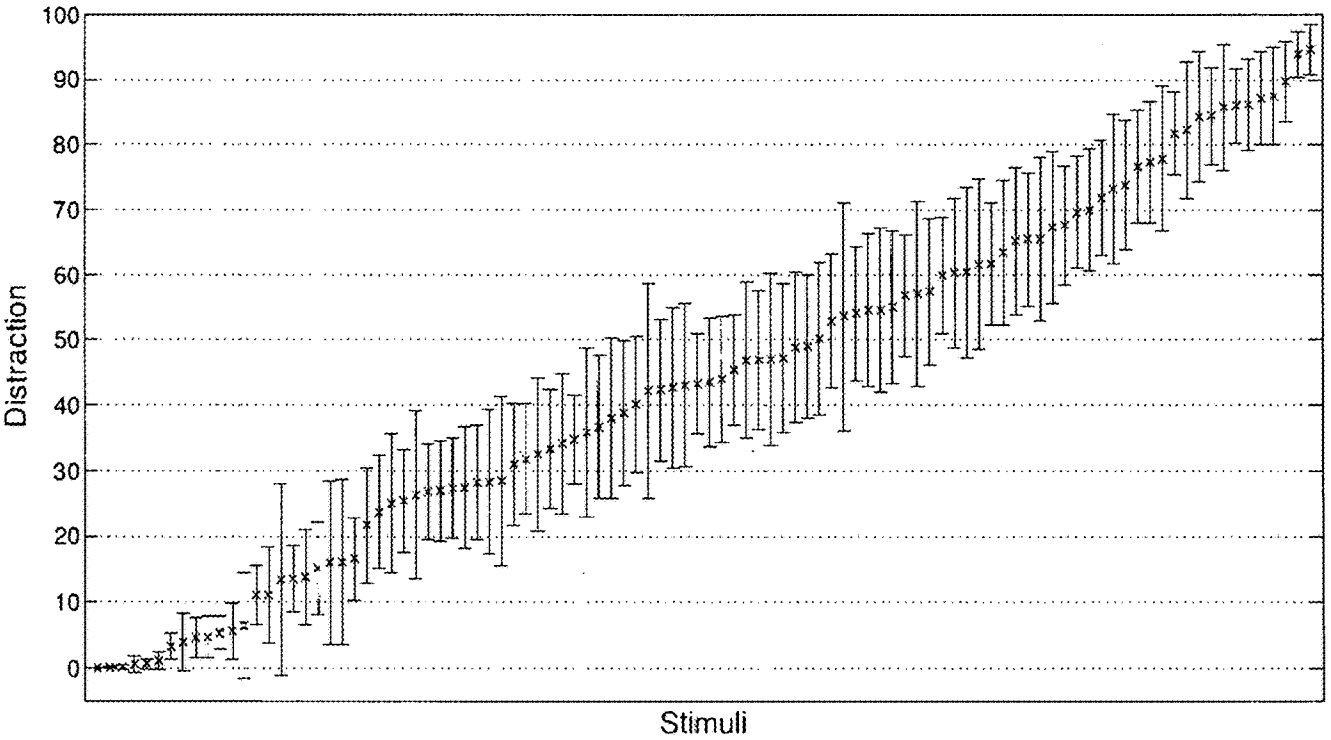

FIG. 30 illustrates mean distraction (across subject) for each stimulus. Error bars show 95% confidence intervals calculated using the t-distribution.

Figure 31:
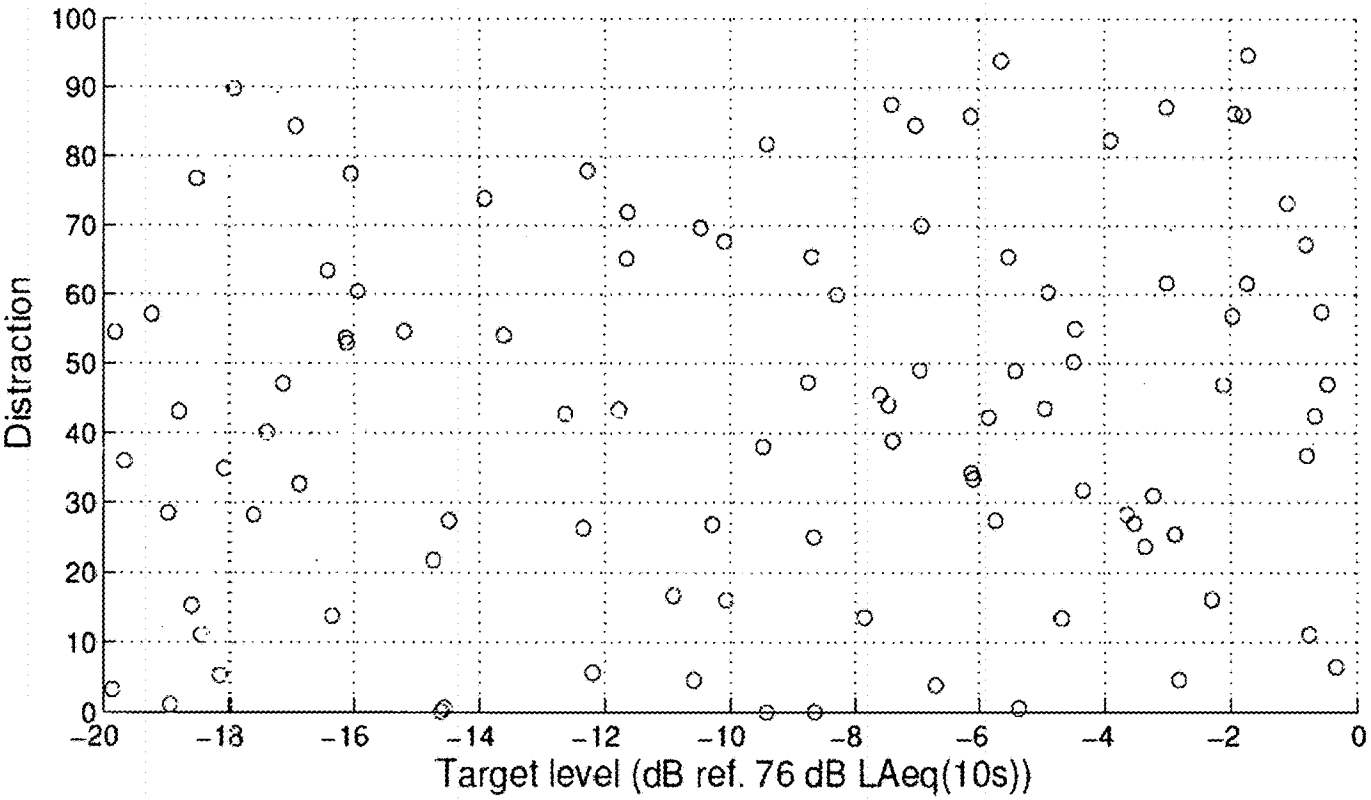

FIG. 31 illustrates correlation between distraction and target level.

Figure 32:
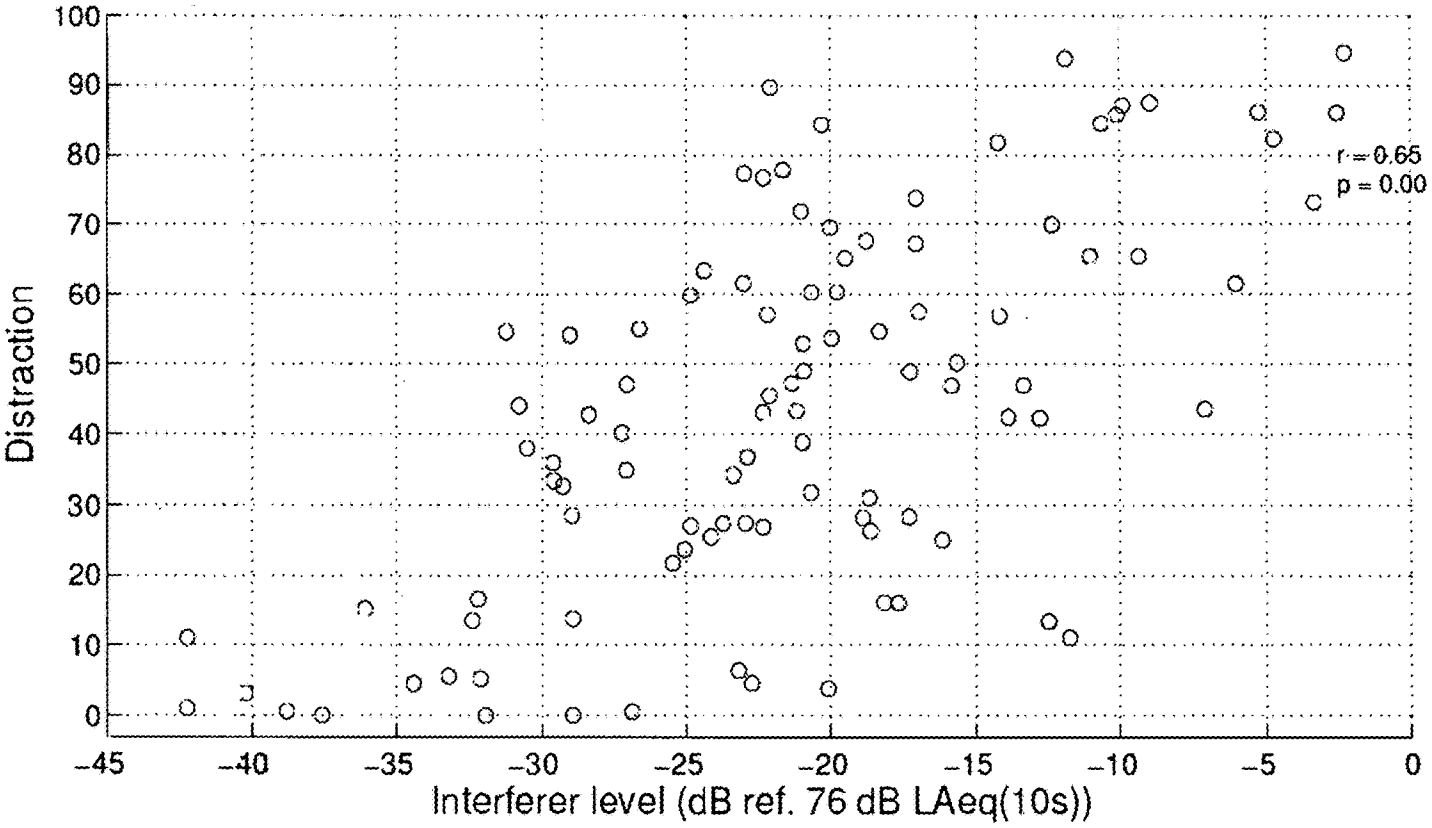

FIG. 32 illustrates correlation between distraction6 and interferer level.

Figure 33:
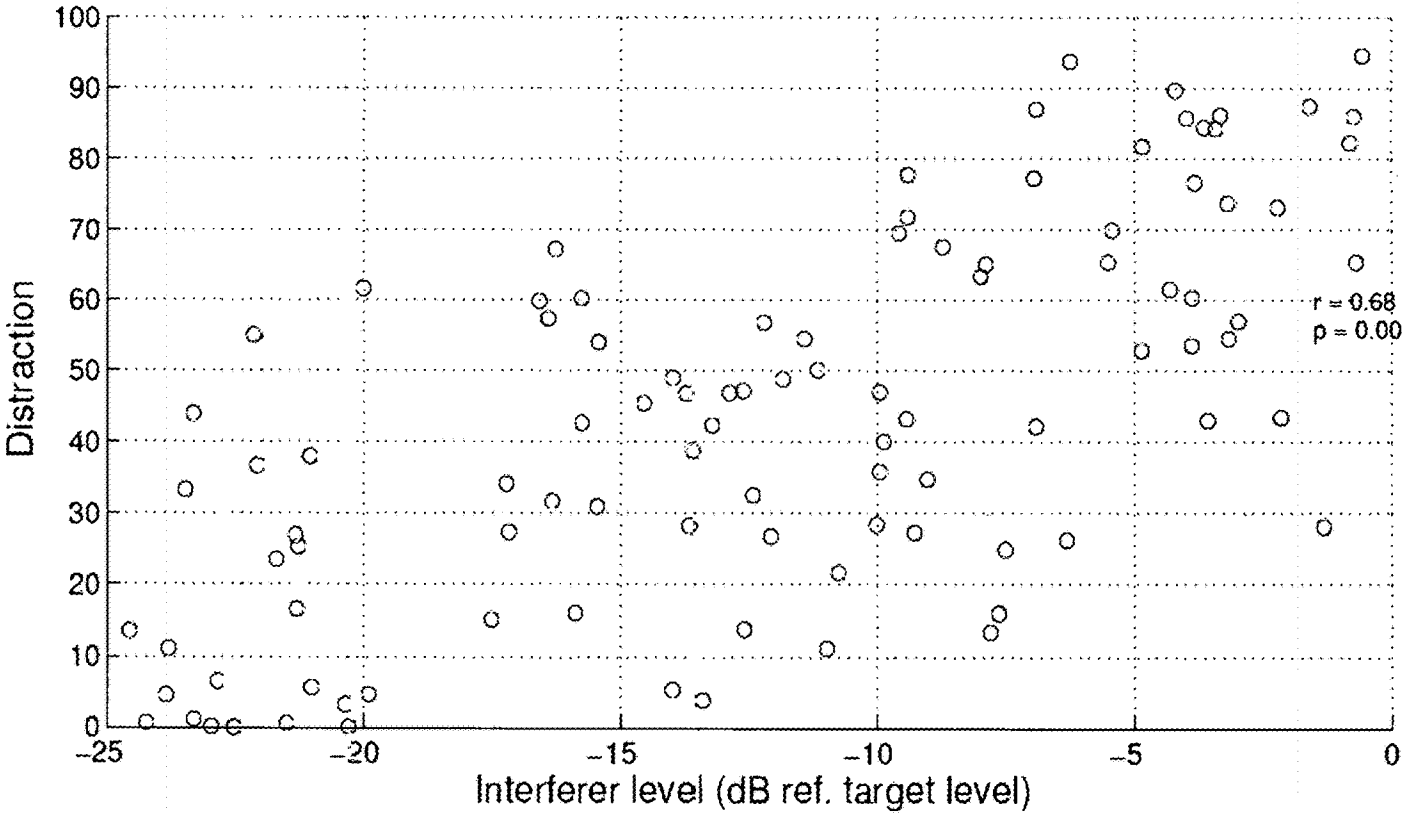

FIG. 33 illustrates correlation between distraction and target-to-interferer ratio.

Figure 34:
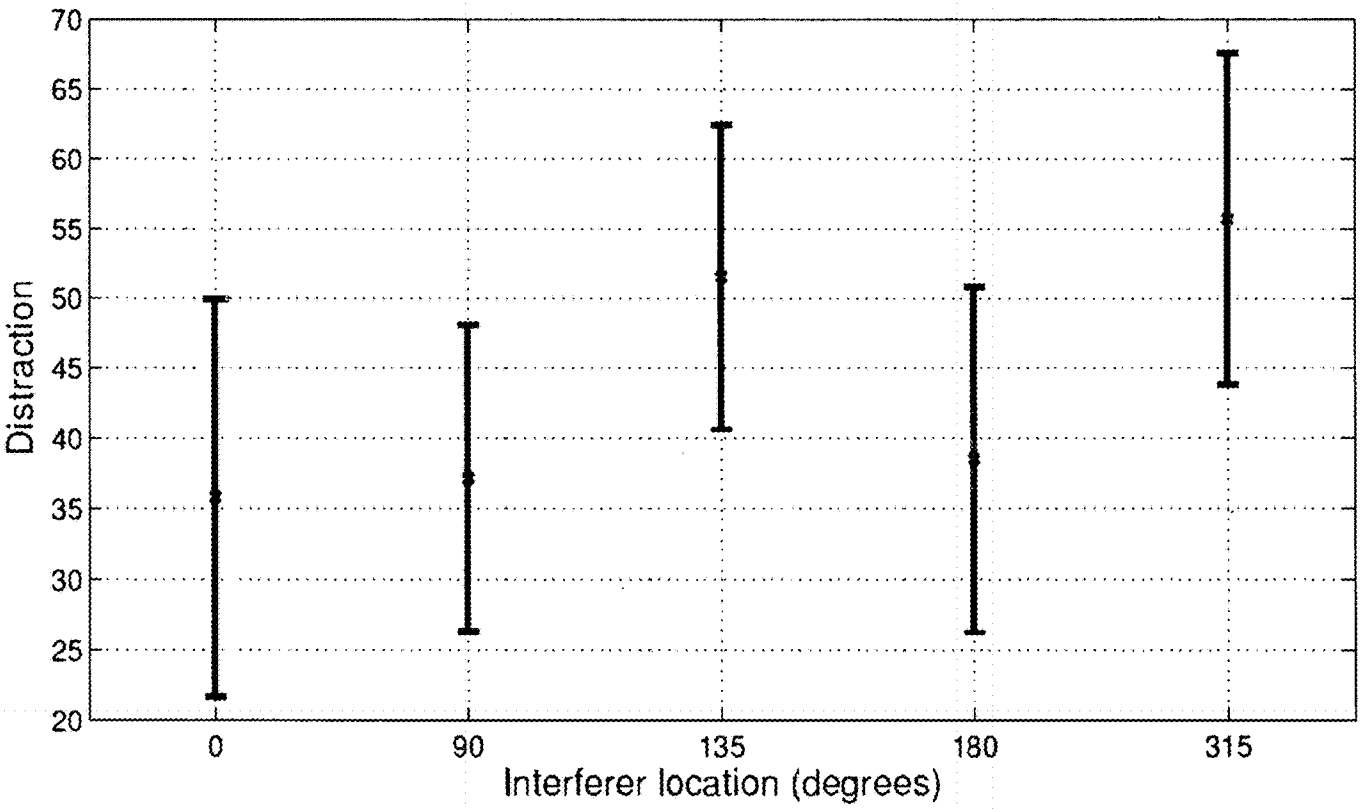

FIG. 34 illustrates mean distraction against interferer location. Error bars show 95% confidence intervals calculated using the t-distribution.

FIG. 35 illustrates VPA coding groups and frequency.

FIG. 36, FIG. 37, and FIG. 38 describes features extracted for distraction modelling. T: Target; I: Interferer; C: Combination. M: Mono; L: Binaural, left ear; R: Binaural, right ear; Hi: Binaural, ear with highest value; Lo: Binaural, ear with lowest value.

FIG. 39 describes feature frequency ranges.

Figure 40:
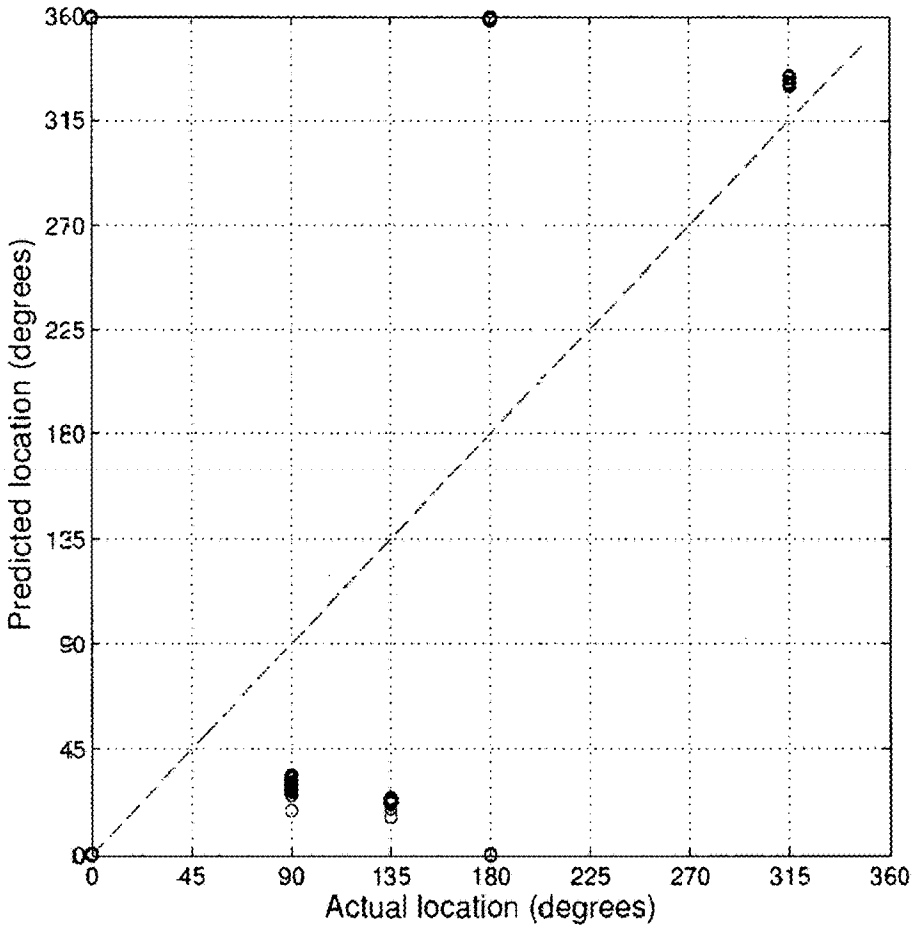

FIG. 40 illustrates actual interferer location against predicted interferer location.

FIG. 41 describes statistics for full stepwise mode.

Figure 42:
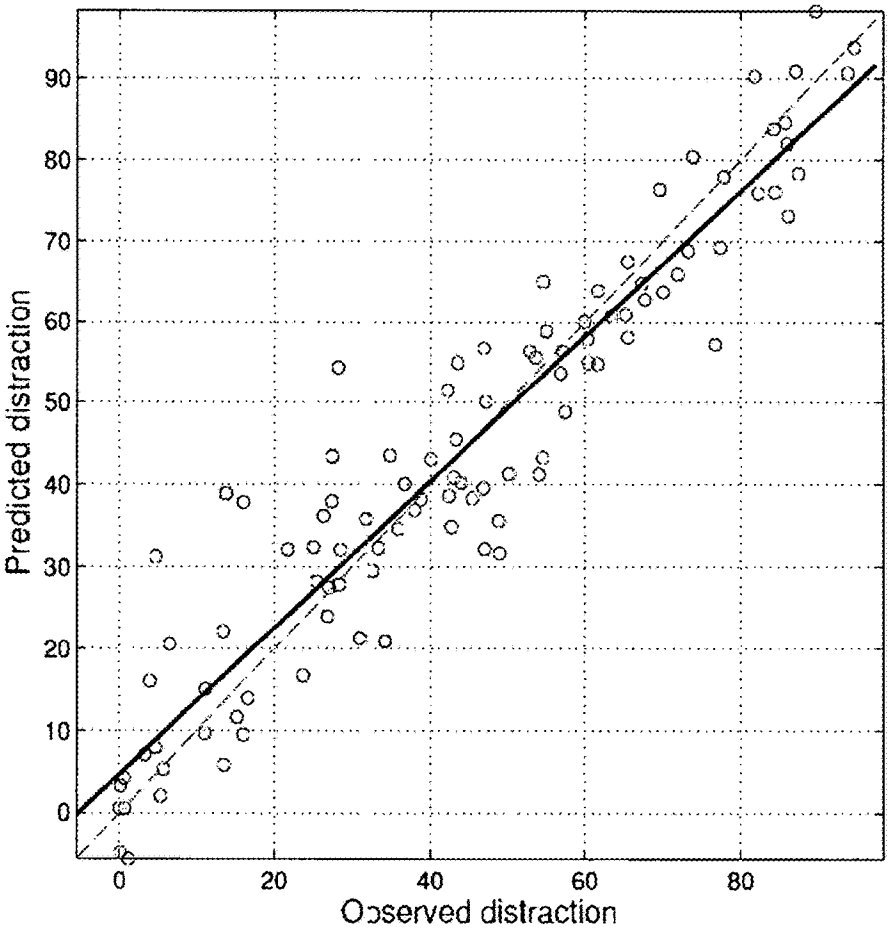

FIG. 42 illustrates model fit for the full stepwise model.

Figure 43:
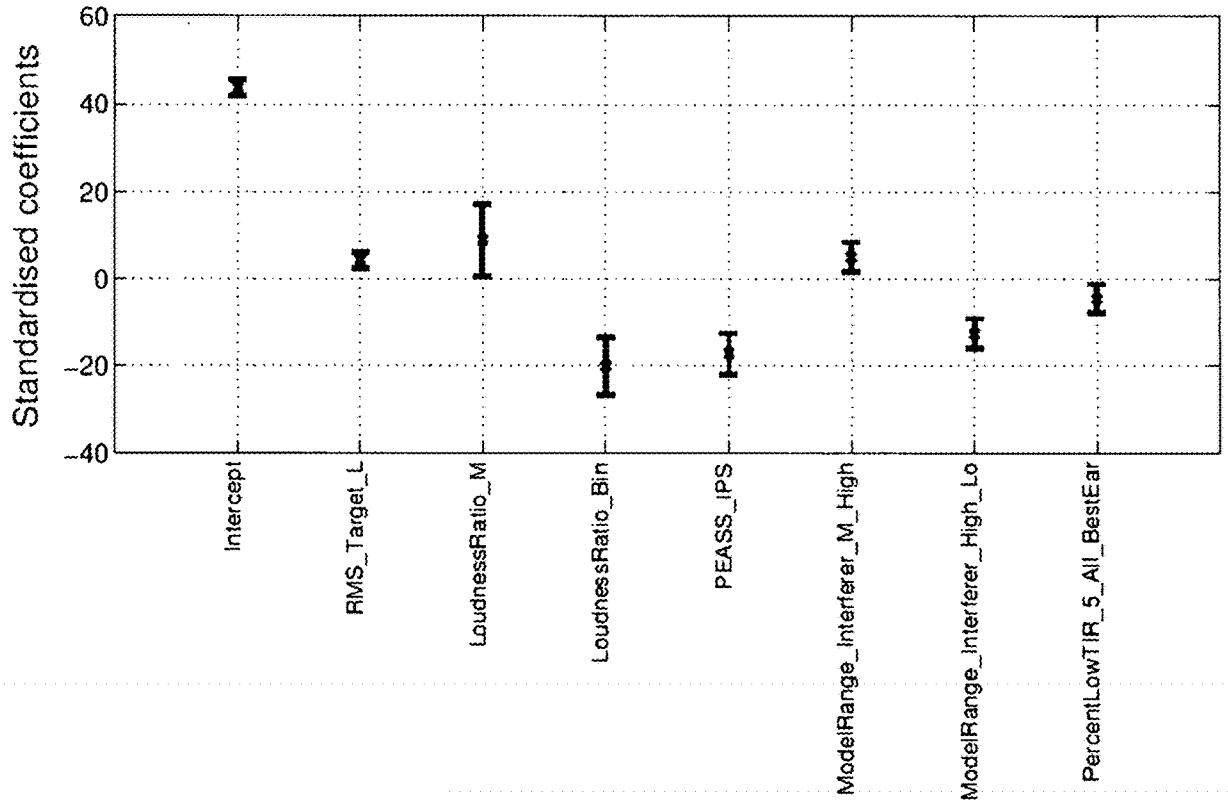

FIG. 43 illustrates standardised coefficient values for the full stepwise model. Error bars show 95% confidence intervals for coefficient estimates.

Figure 44A:
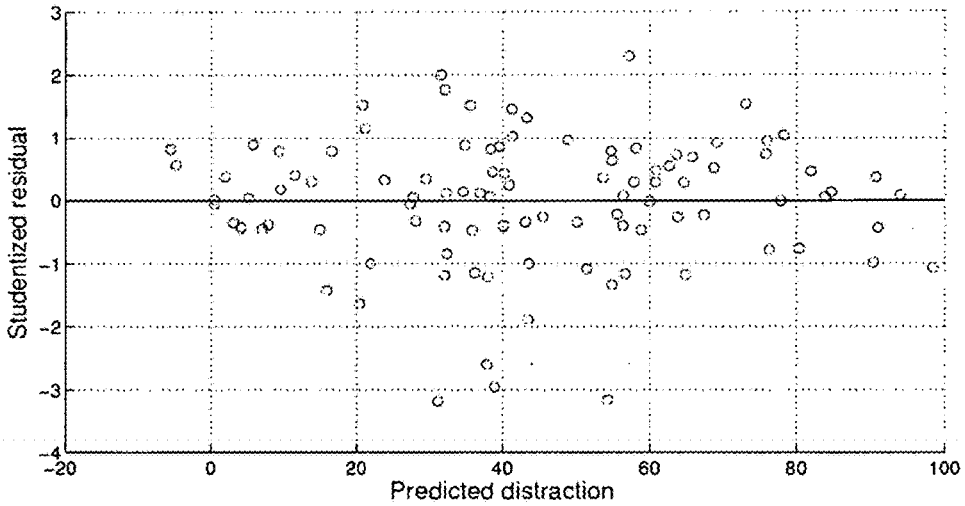
Figure 44B:
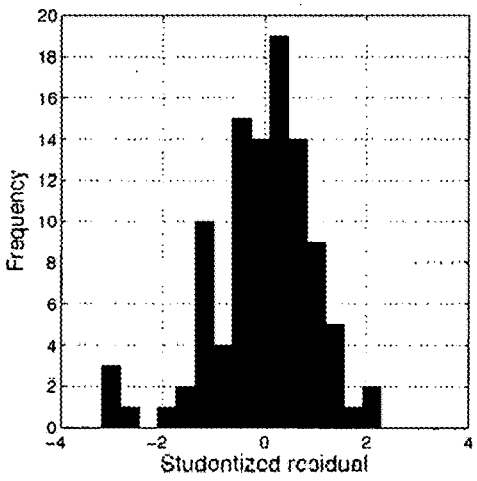
Figure 44C:
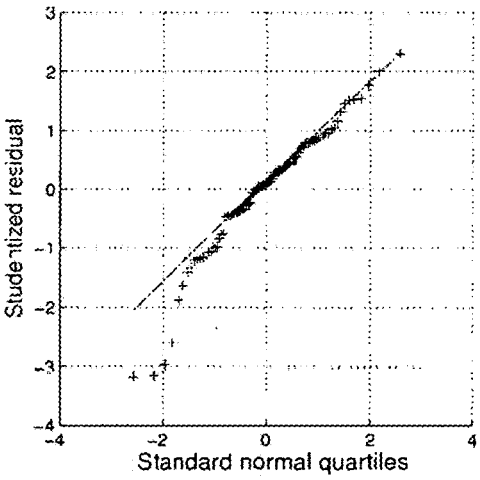

FIG. 44A, FIG. 44B, and FIG. 44C illustrate visualisation of studentized residuals for full stepwise model.

Figure 45:
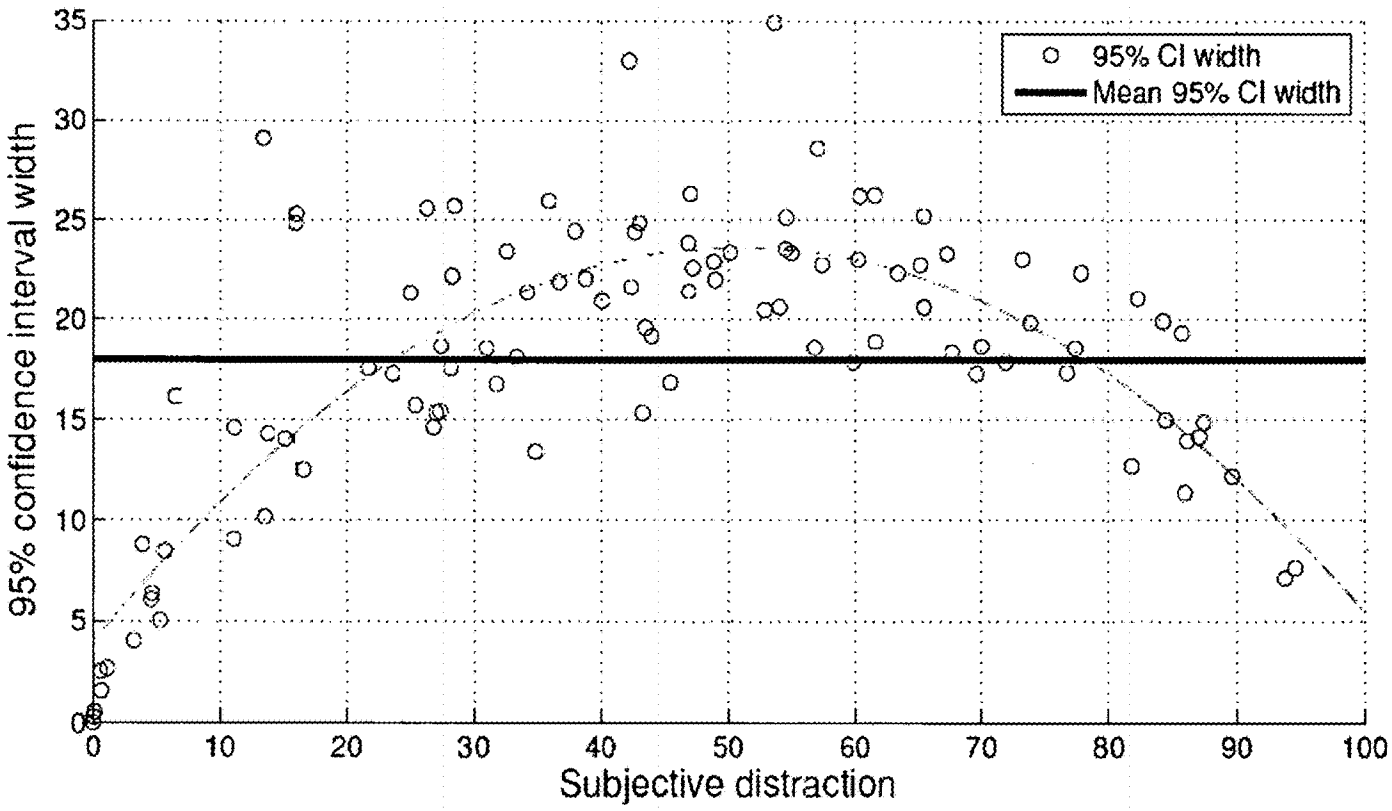

FIG. 45 illustrates 95% confidence interval width against distraction scores for subjective ratings. Horizontal line shows mean 95% CI size.

Figure 46:
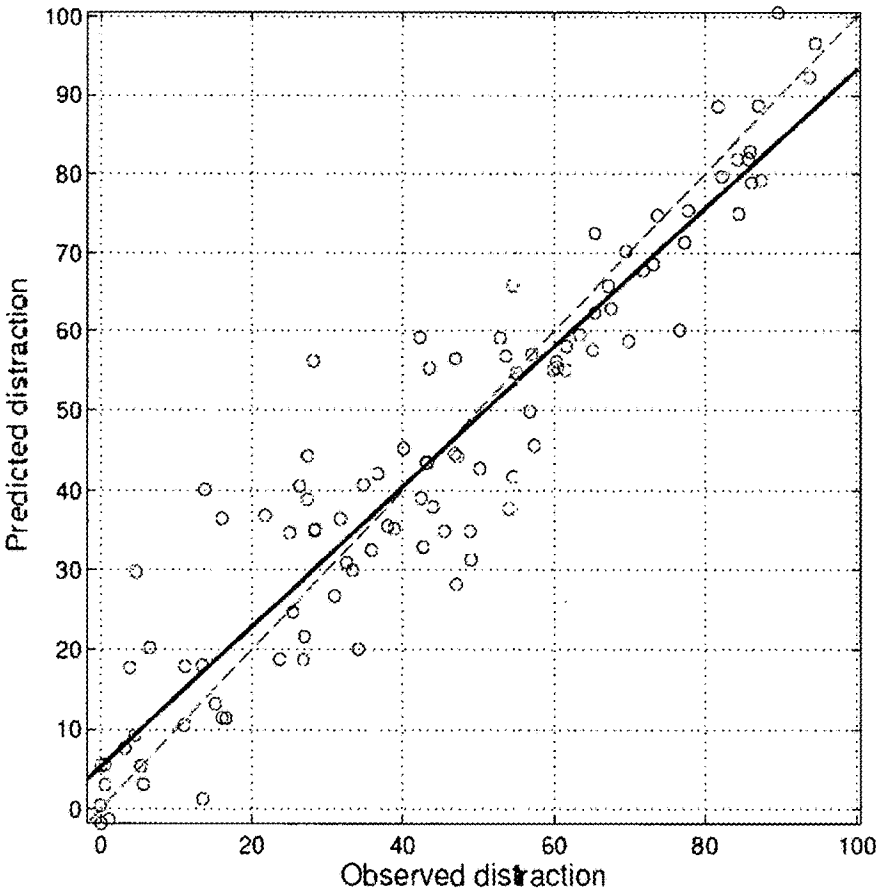

FIG. 46 illustrates model fit for the adjusted model.

FIG. 47 illustrates statistics for adjusted model.

Figure 48:
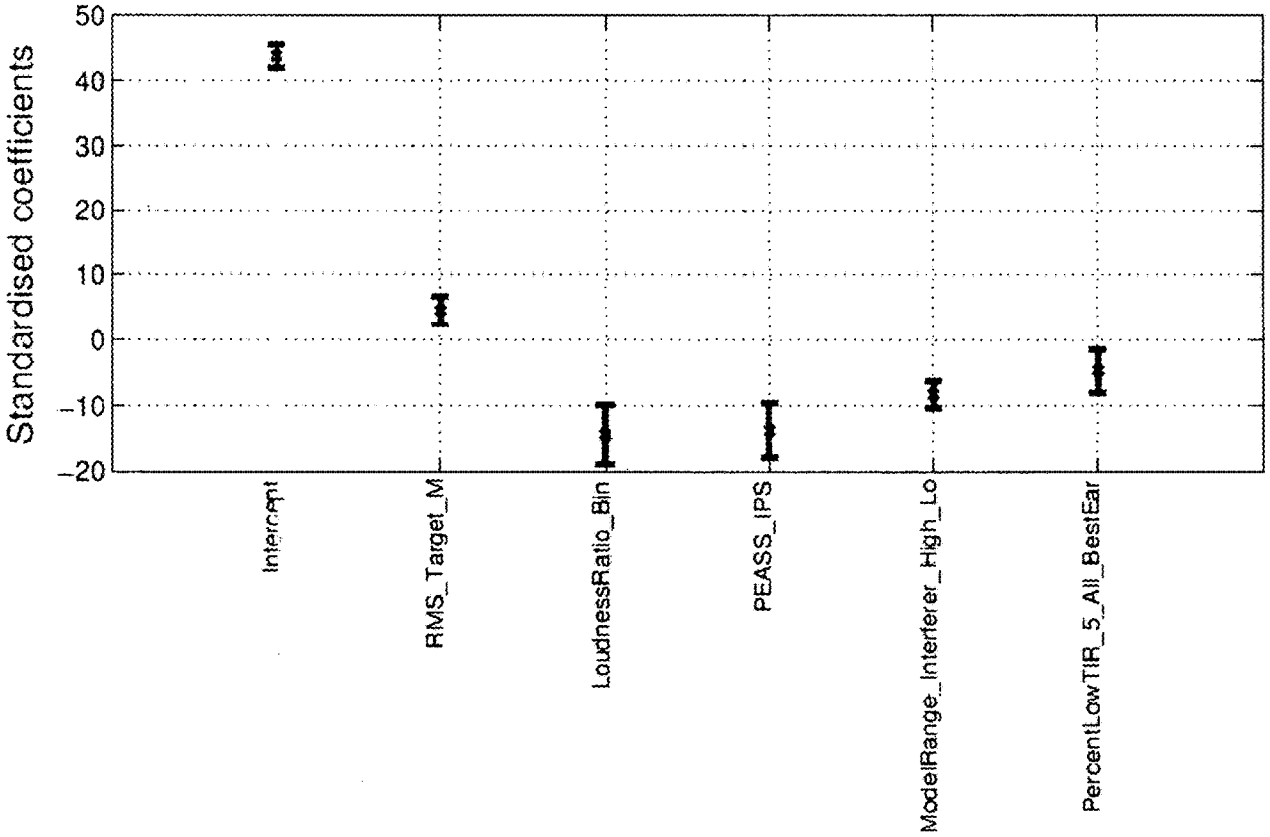

FIG. 48 illustrates standardised coefficient values for the adjusted model. Error bars show 95% confidence intervals for coefficient estimates.

Figure 49A:
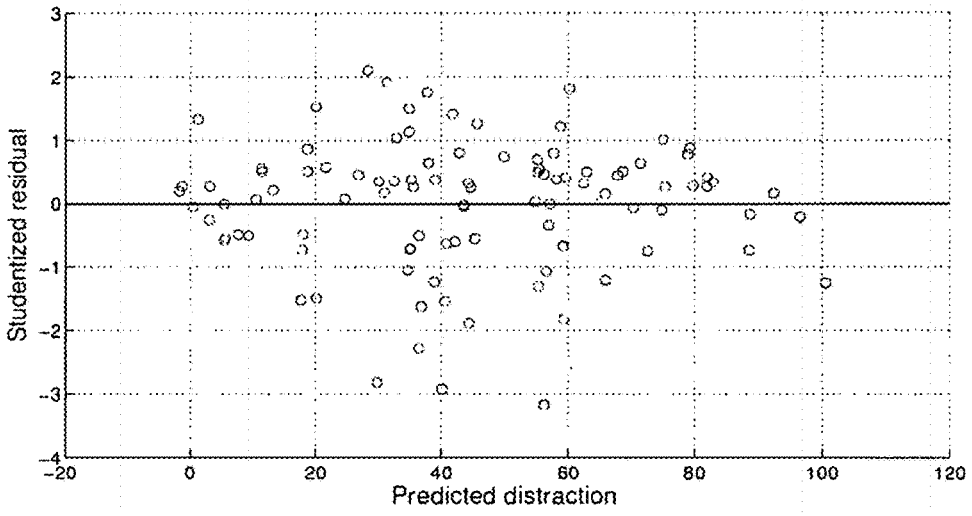
Figure 49B:
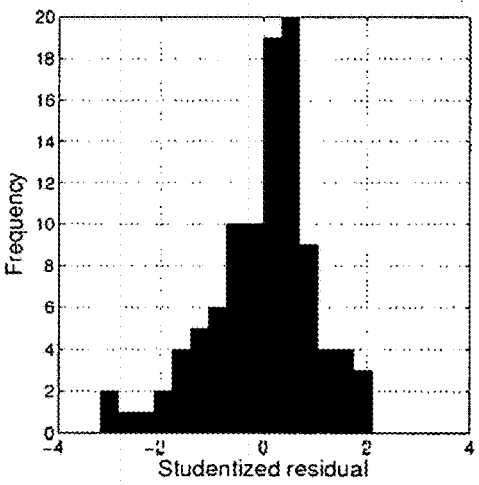
Figure 49C:
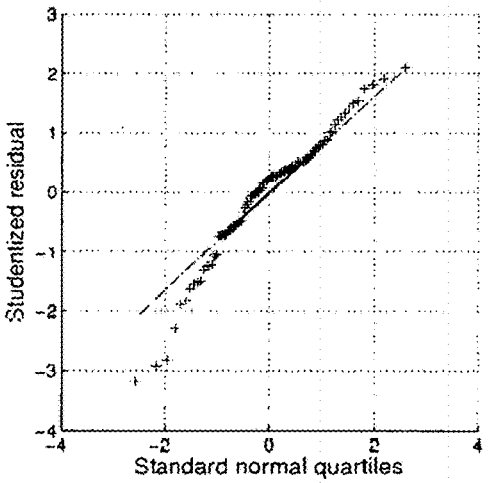

FIG. 49A, FIG. 49B, and FIG. 49C is a visualisation of studentized residuals for adjusted model.

FIG. 50 describes outlying stimuli from adjusted model. y is the subjective distraction rating, y^ is the prediction by the adjusted model (full training set), and y^ is the prediction by the adjusted model trained without the outlying stimuli.

FIG. 51 describes statistics for adjusted model trained without the outlying stimuli. For the k-fold cross-validation, k=5 for the model trained without outliers, as the 95 training cases could not be divided evenly into 2 folds.

Figure 52:
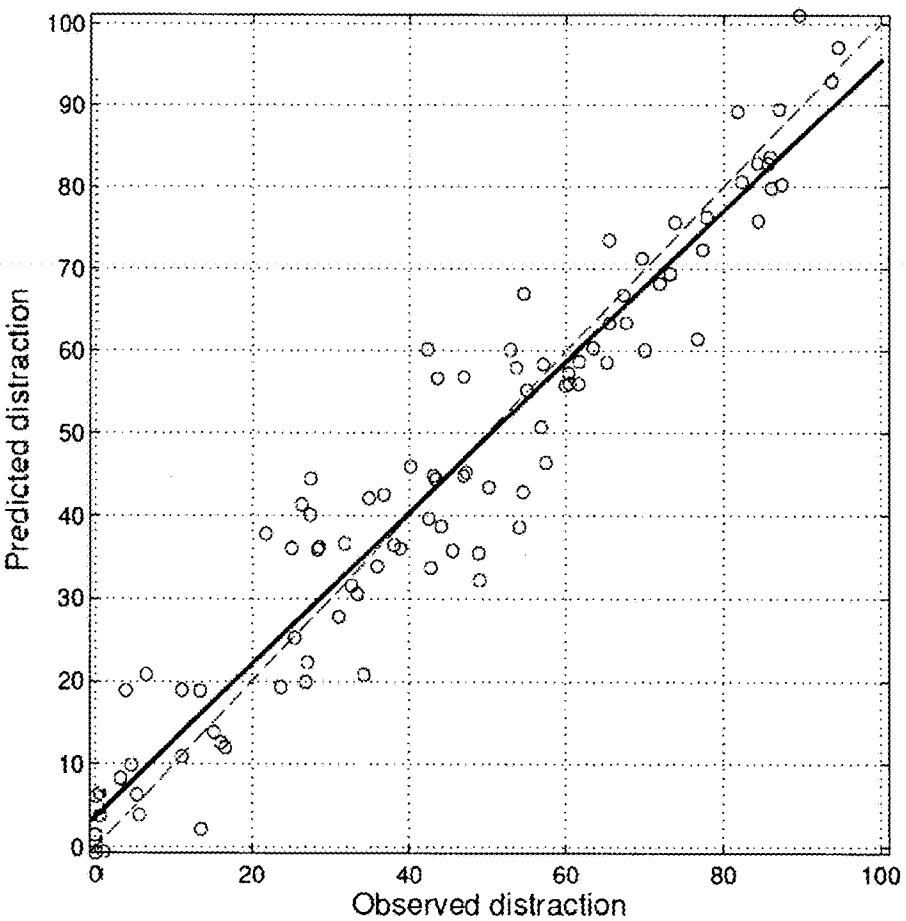

FIG. 52 illustrates model fit for the adjusted model trained without the outlying stimuli.

Figure 53A:
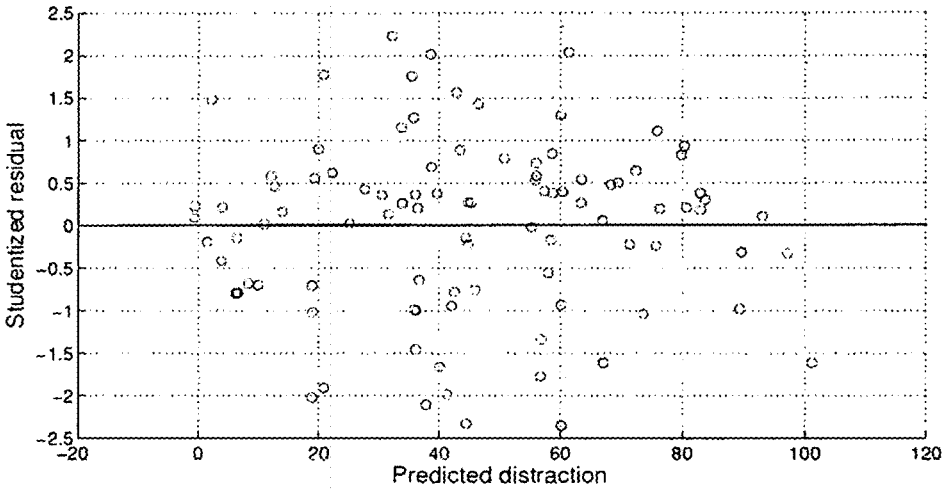
Figure 53B:
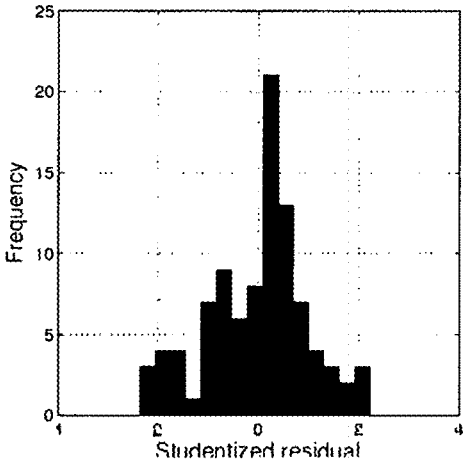
Figure 53C:
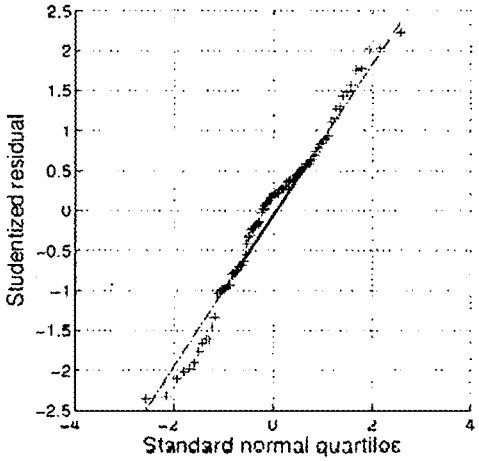

FIG. 53A, FIG. 53B, and FIG. 53C is a visualisation of studentized residuals for adjusted model trained without the outlying stimuli.

Figure 54:
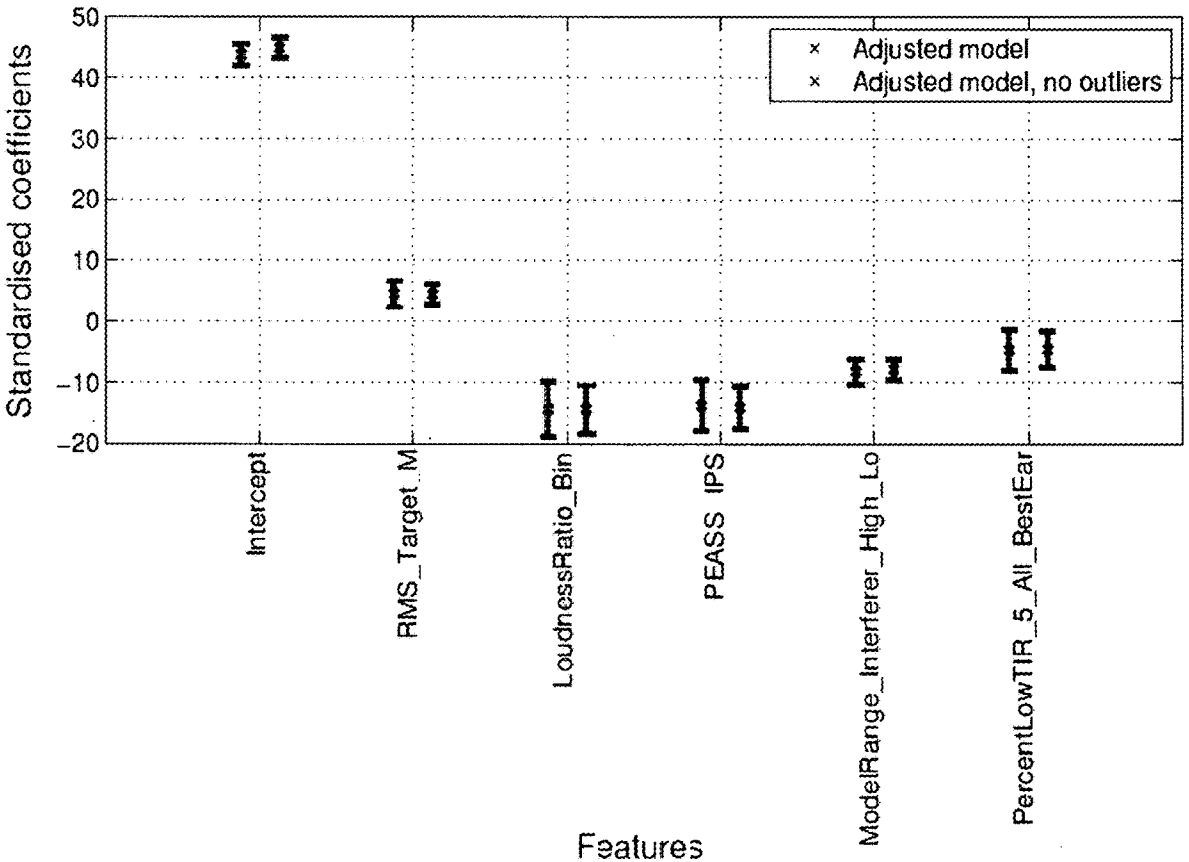

FIG. 54 illustrates standardised coefficient values for the adjusted model trained with and without outlying stimuli. Error bars show 95% confidence intervals for coefficient estimates.

FIG. 55A, FIG. 55B, and FIG. 55C illustrate features in which the outlying stimuli are tightly grouped.

FIG. 56 describes statistics for altered versions of adjusted model.

Figure 57:
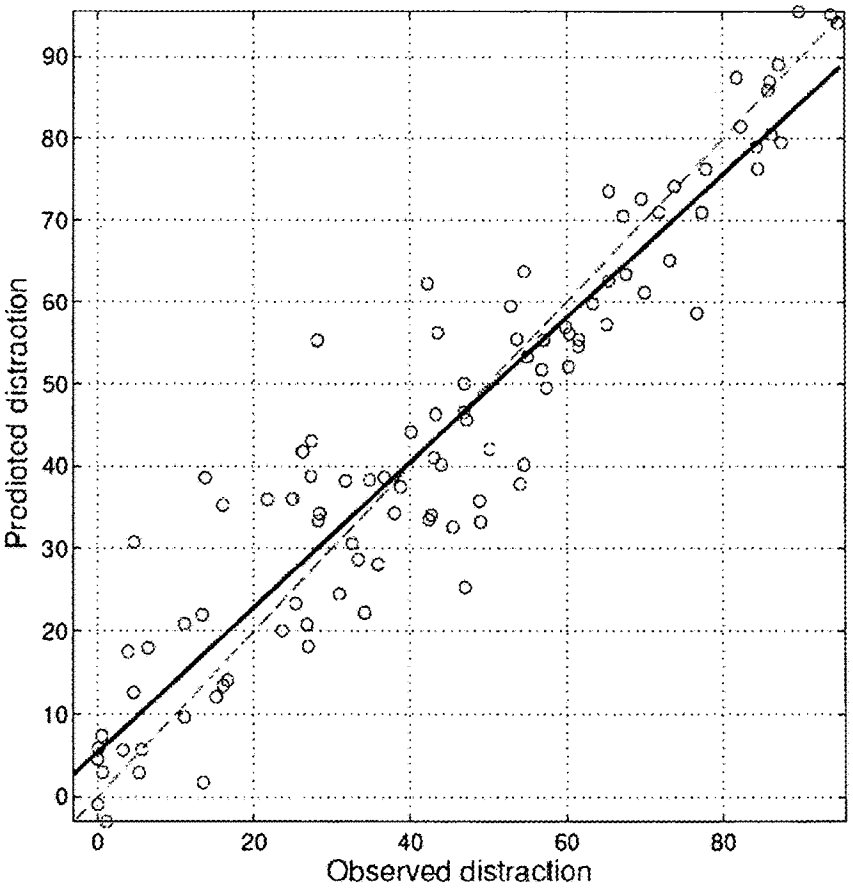

FIG. 57 illustrates model fit for the adjusted model with binaural loudness-based features.

Figure 58A:
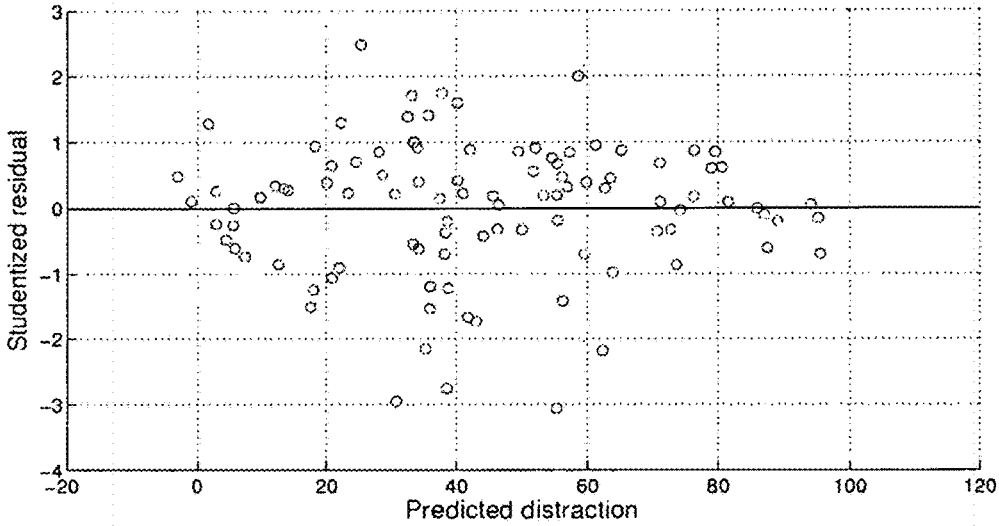
Figure 58B:
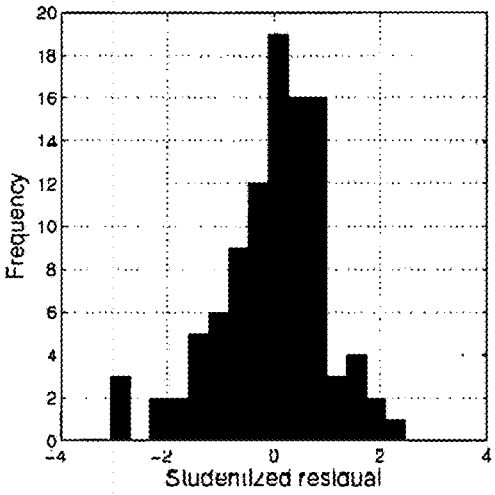
Figure 58C:
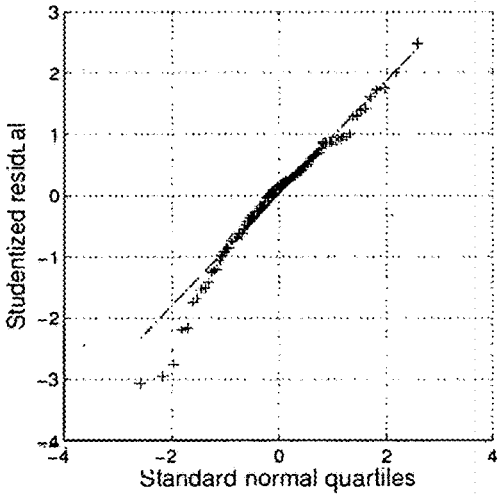

FIG. 58A, FIG. 58B, and 58C is a visualisation of studentized residuals for adjusted model with bin-aural loudness-based features.

FIG. 59 describes statistics for adjusted model with altered features, final version.

Figure 60:
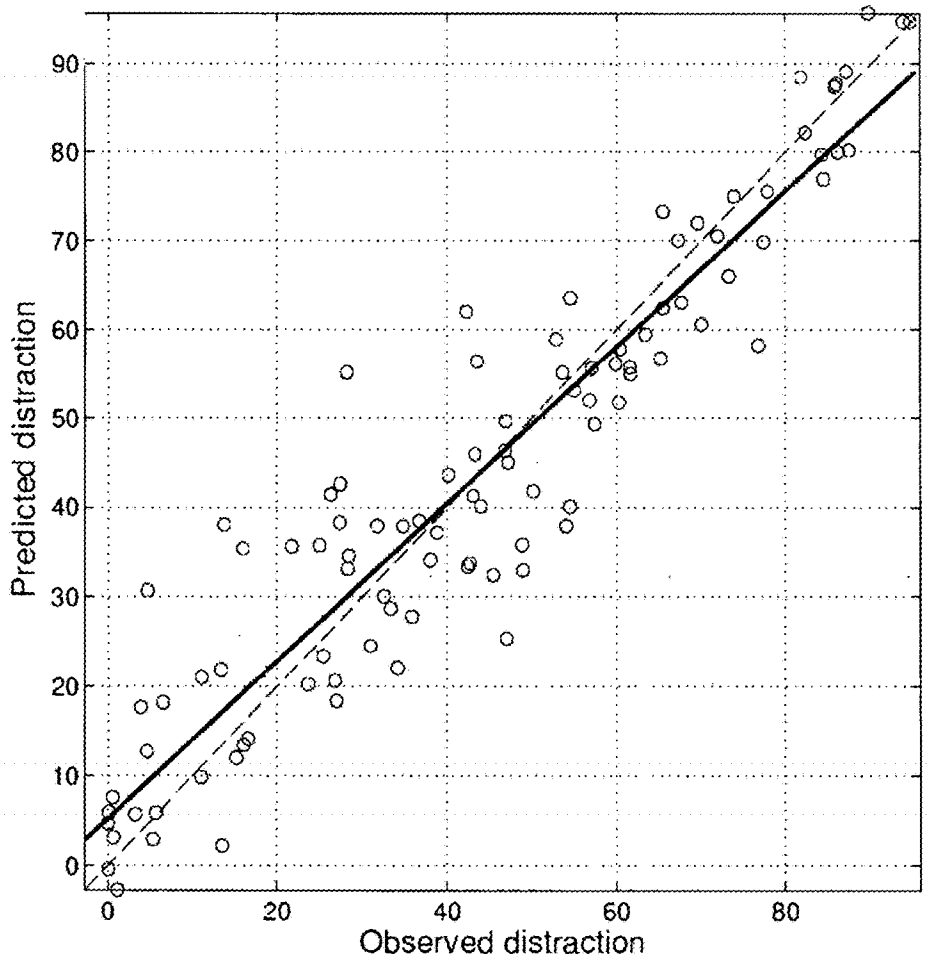

FIG. 60 illustrates model fit for the adjusted model with altered features, final version.

Figure 61A:
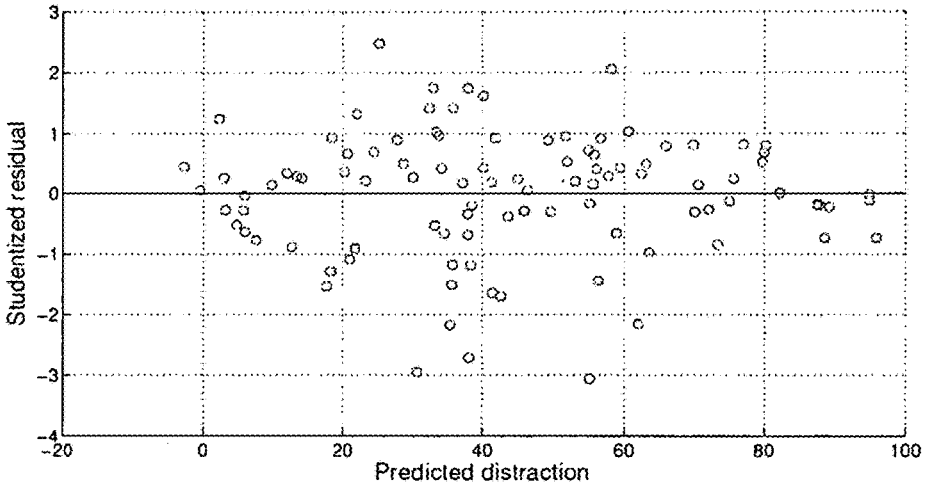
Figure 61B:
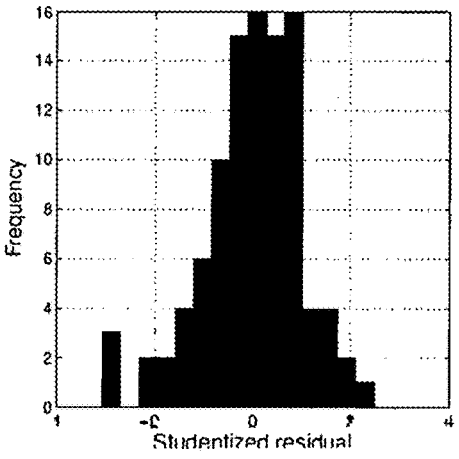
Figure 61C:
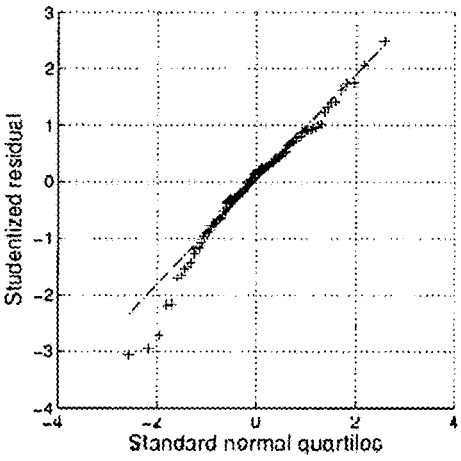

FIG. 61A, FIG. 61B, and FIG. 61C is a visualisation of studentized residuals for adjusted model with altered features, final version.

Figure 62:
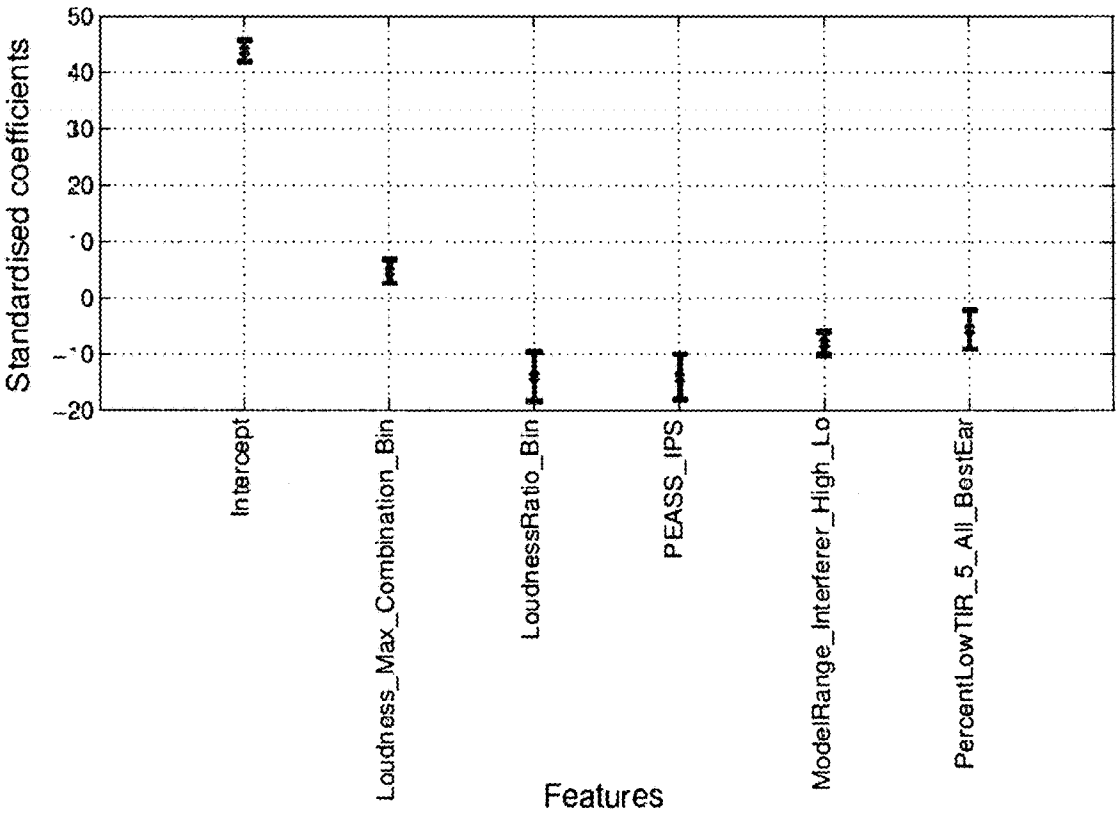
Figure 63A:
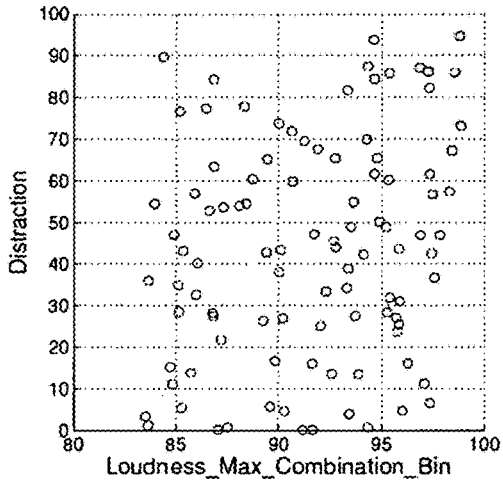
Figure 63B:
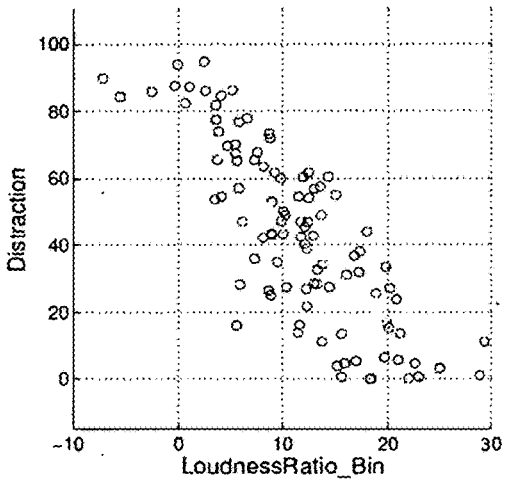
Figure 63C:
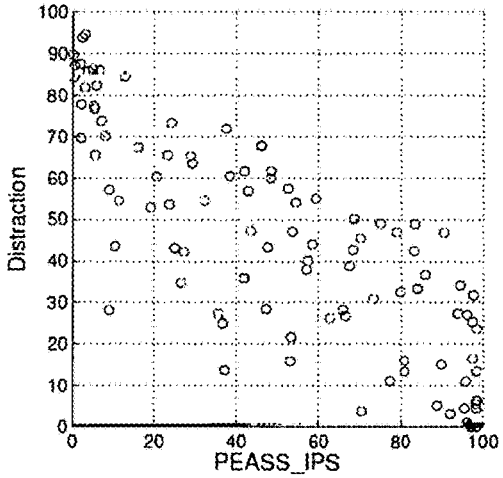
Figure 63D:
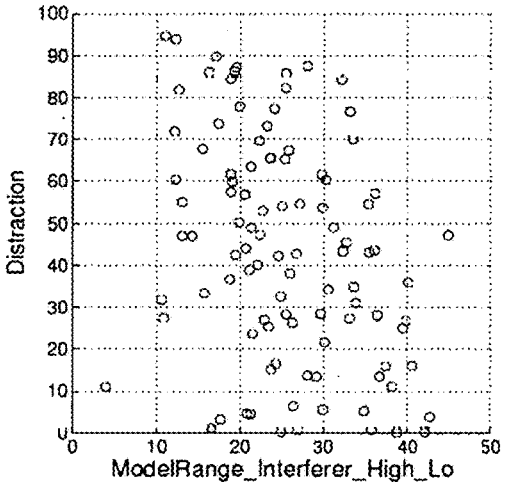
Figure 63E:
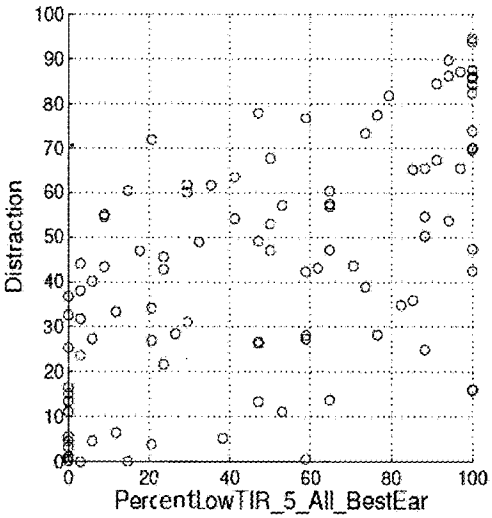

FIG. 62 illustrates standardised coefficient values for the adjusted model with altered features, final version. Error bars show 95% confidence intervals for coefficient estimates.

FIG. 63A, FIG. 63B, FIG. 63C, FIG. 63D, and FIG. 63E are visualisations of studentized residuals for adjusted model with altered features, final version.

Figure 64:
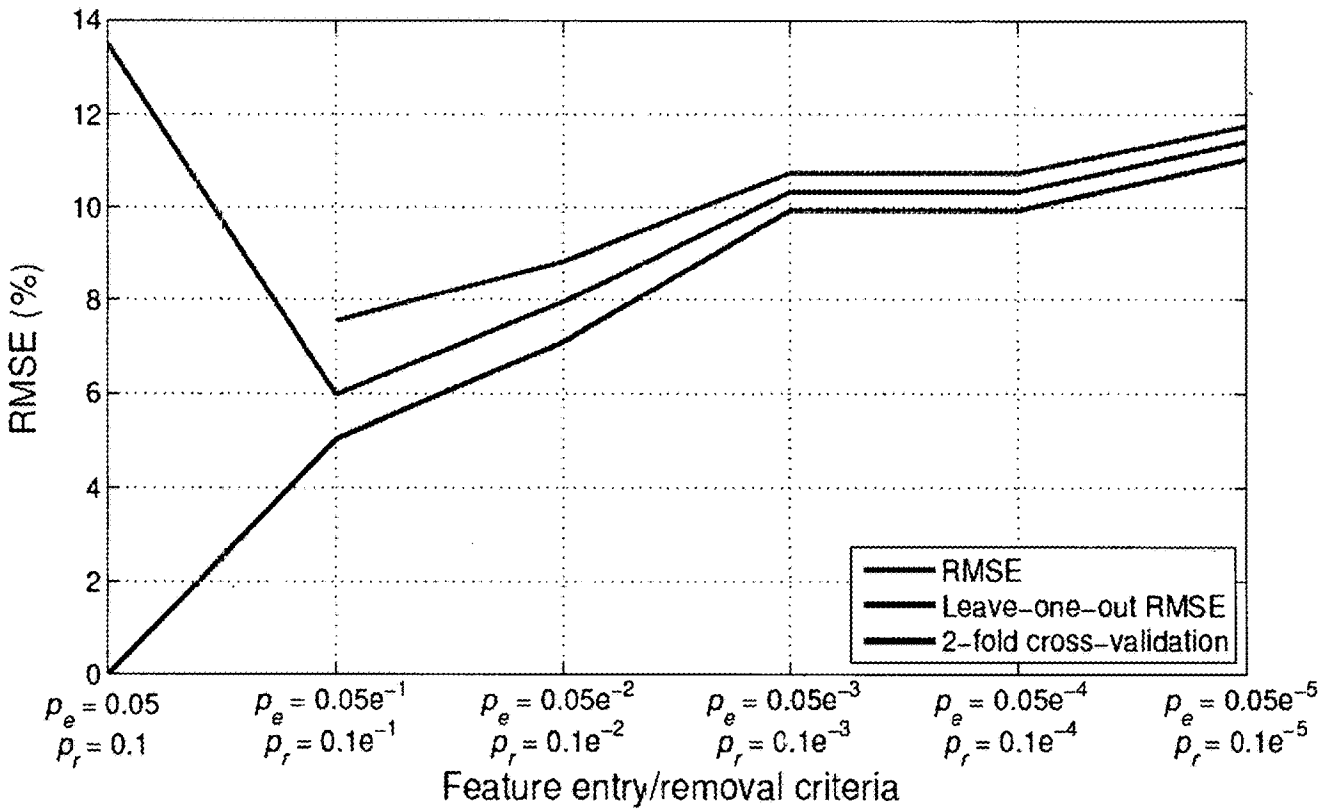

FIG. 64 illustrates RMSE and cross-validation performance for stepwise fit of features with squared terms for varying Pe and Pr.

FIG. 65 describes statistics for model with interactions, with 'model range' feature altered to the mono and lowest ear versions.

Figure 66:
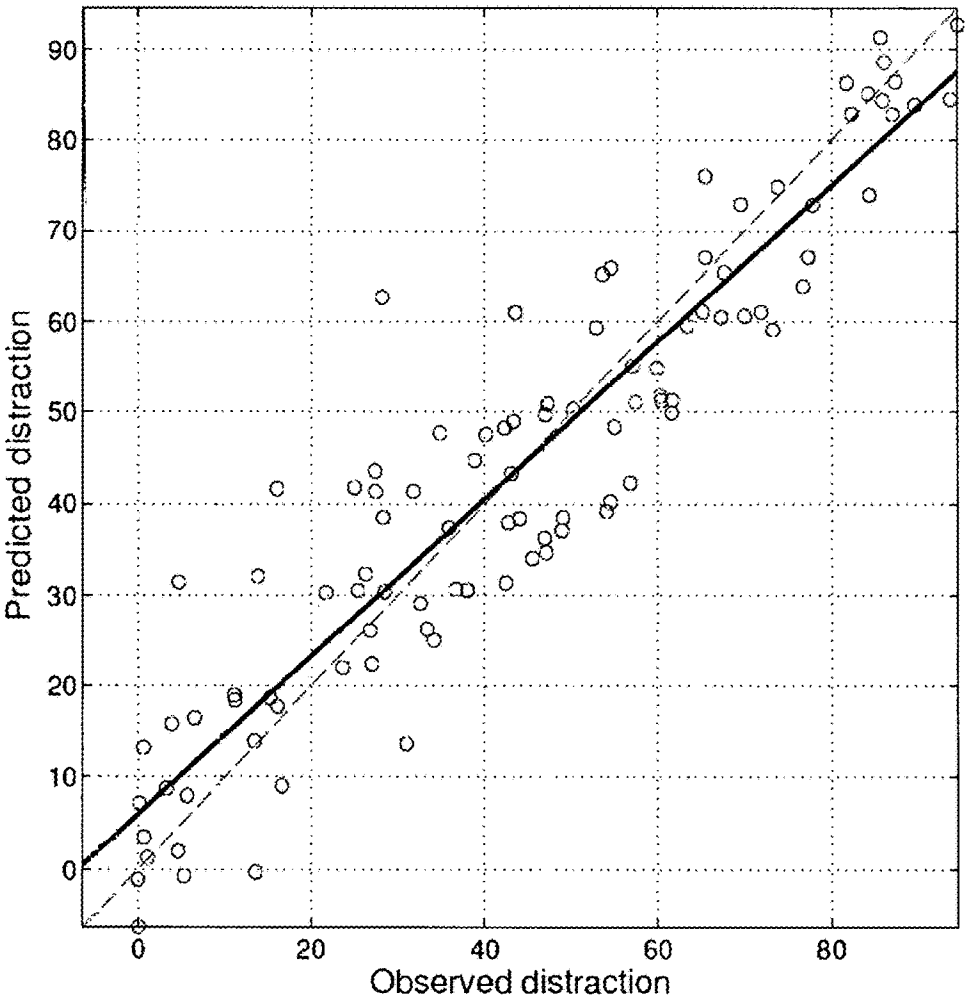

FIG. 66 is a model fit for the interactions model with altered features.

Figure 67A:
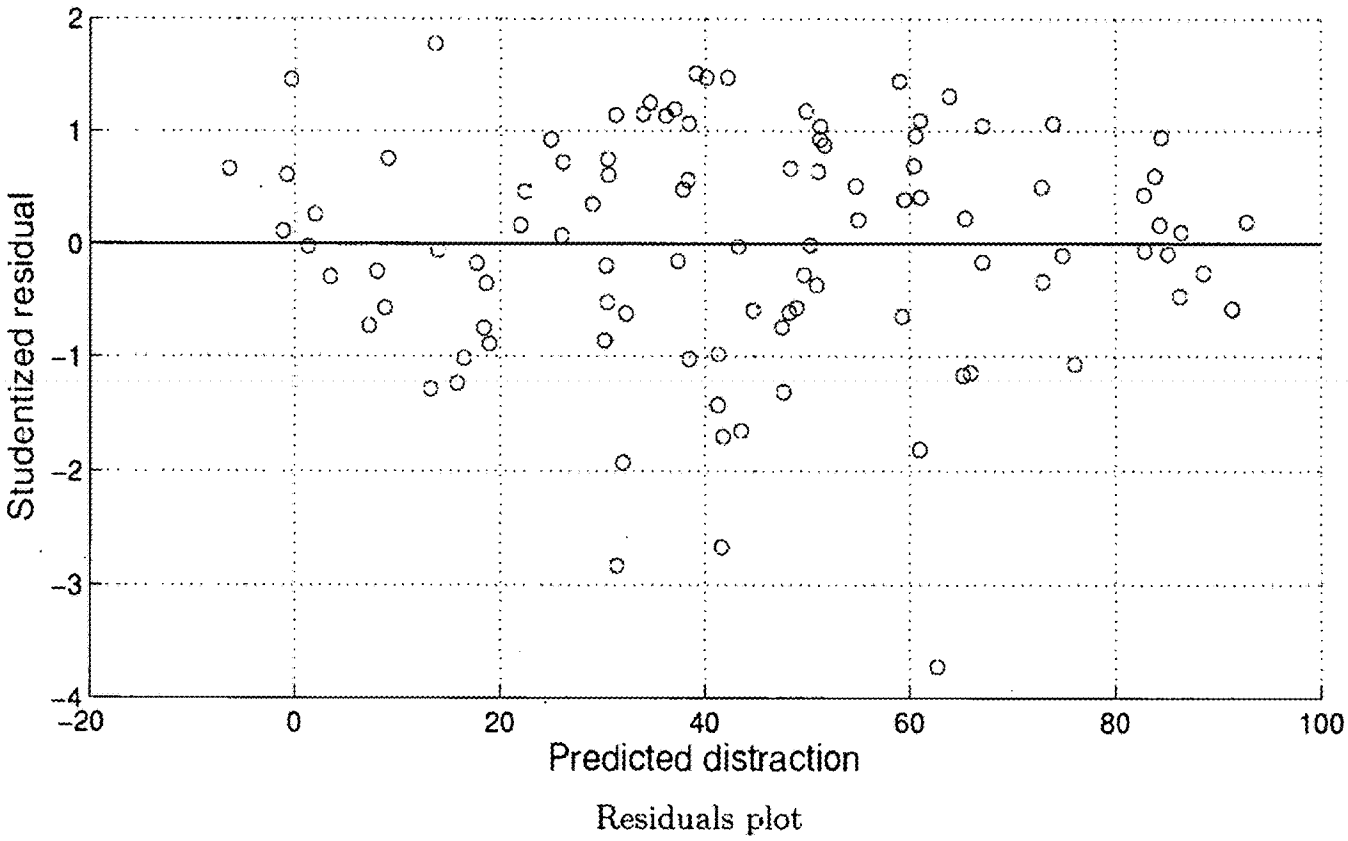
Figure 67B:
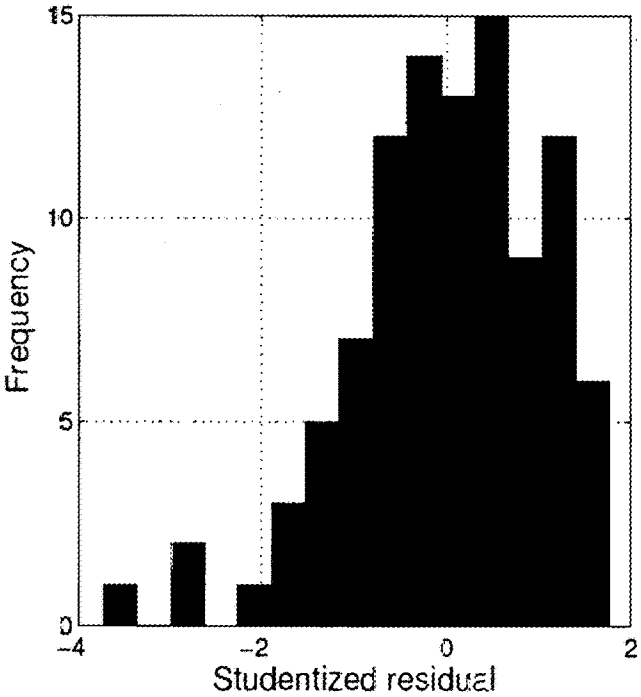
Figure 67C:
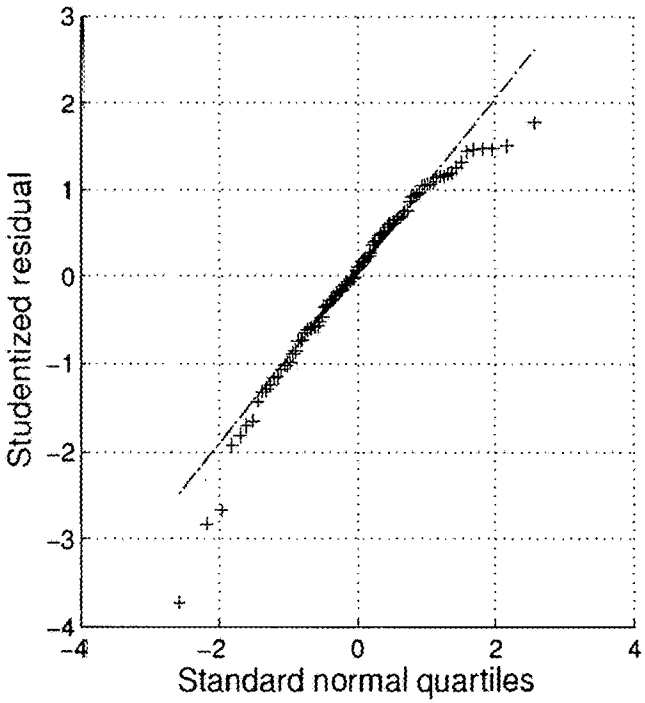

FIGS. 67A, 67B, and 67C are a visualisation of studentized residuals for interactions model with altered features.

Figure 68:
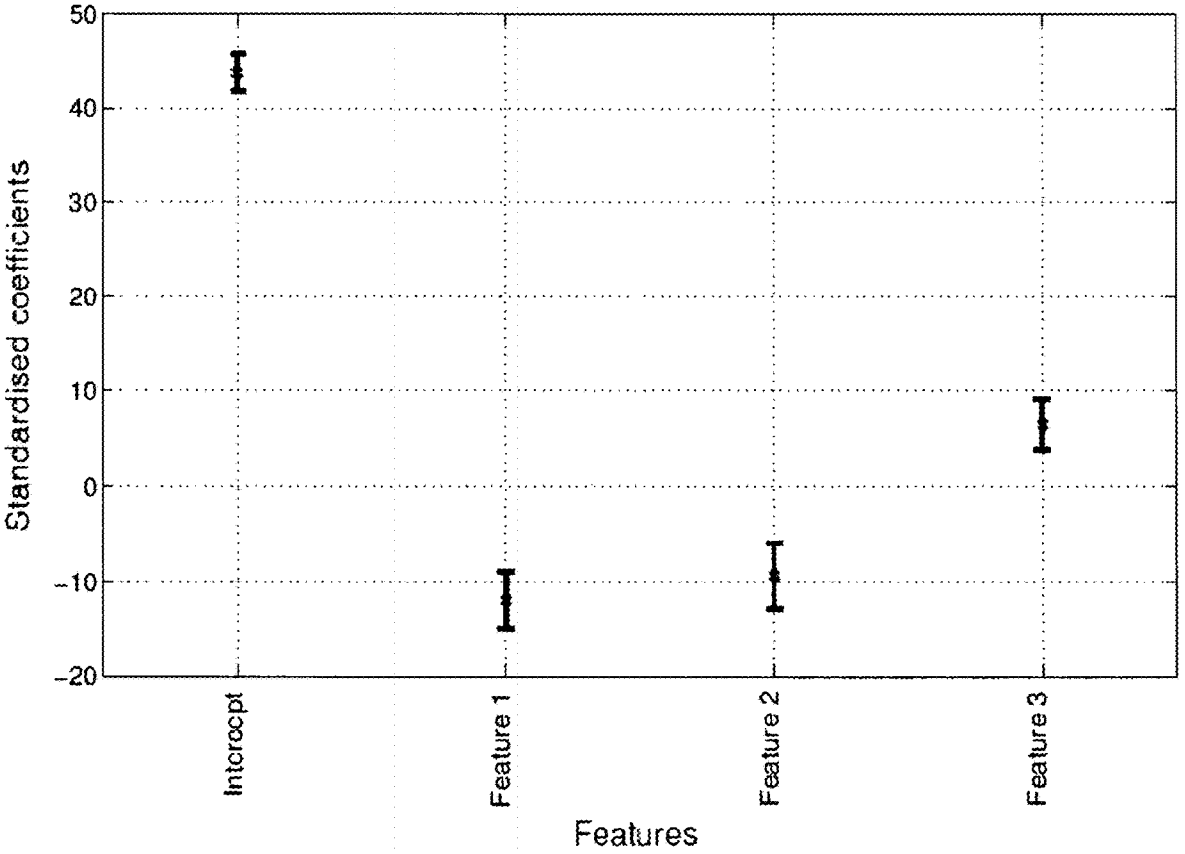

FIG. 68 illustrates standardised coefficient values for the model with interactions. Error bars show 95% confidence intervals for coefficient estimates.

FIG. 69 shows a full comparison of statistics.

Figure 70:
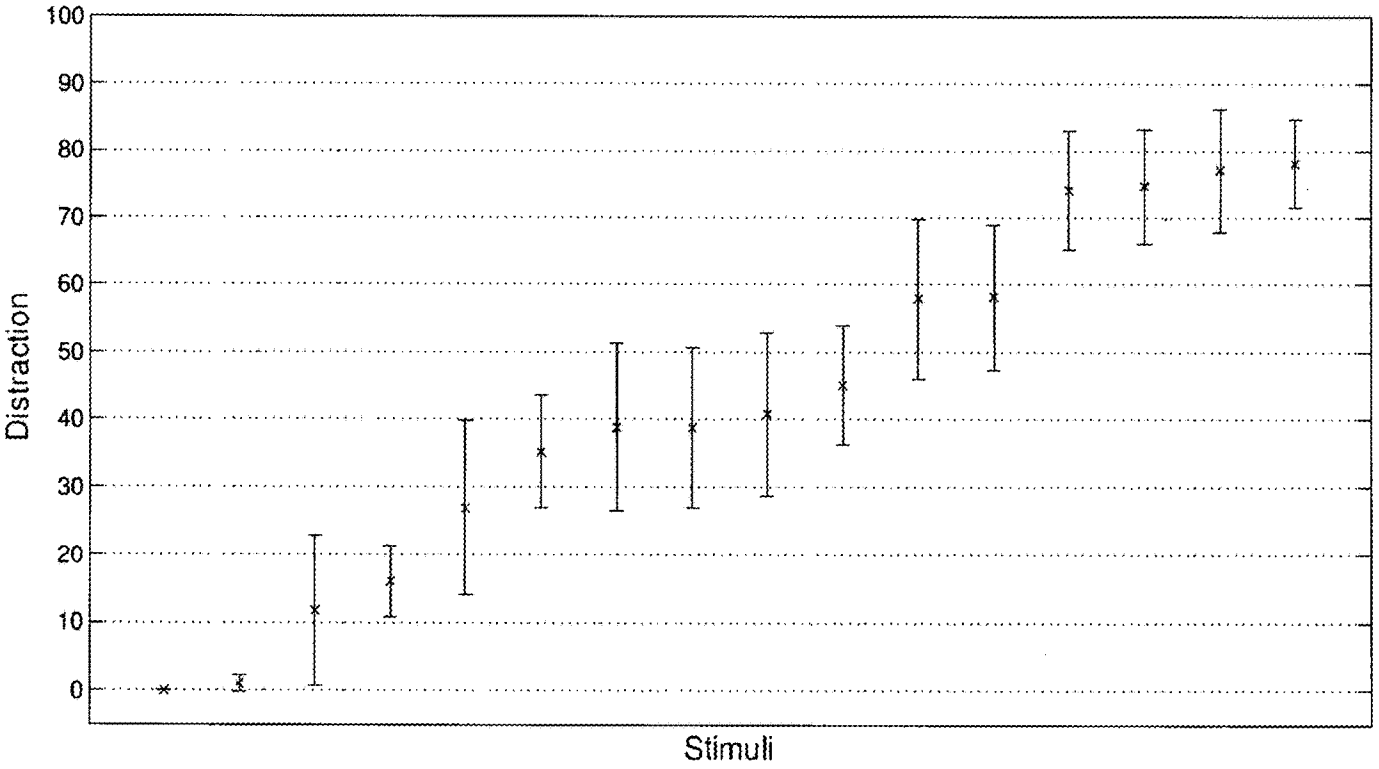

FIG. 70 illustrates mean distraction (across subject) for each practice stimulus. Error bars show 95% confidence intervals calculated using the t-distribution.

Figure 71B:
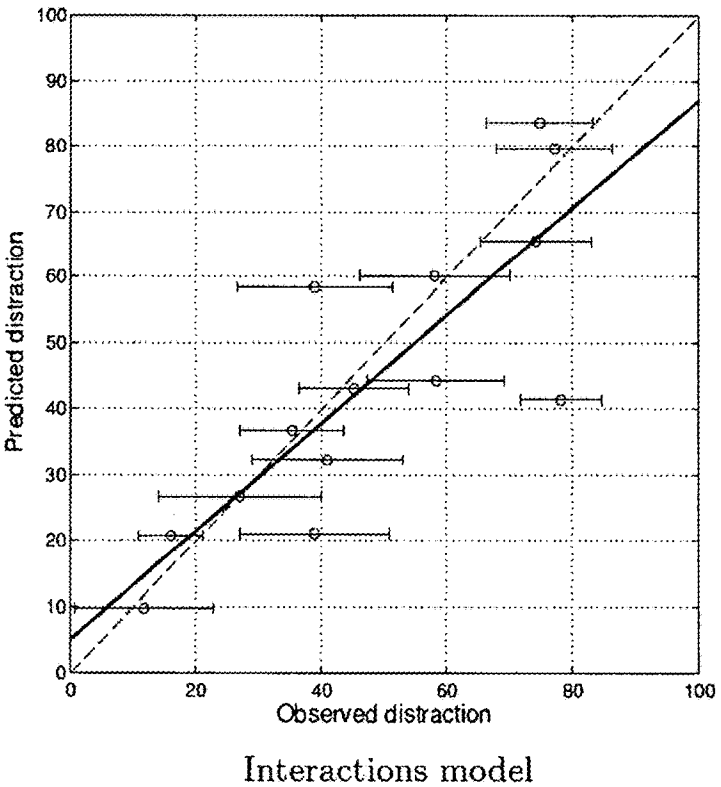
Figure 71A:
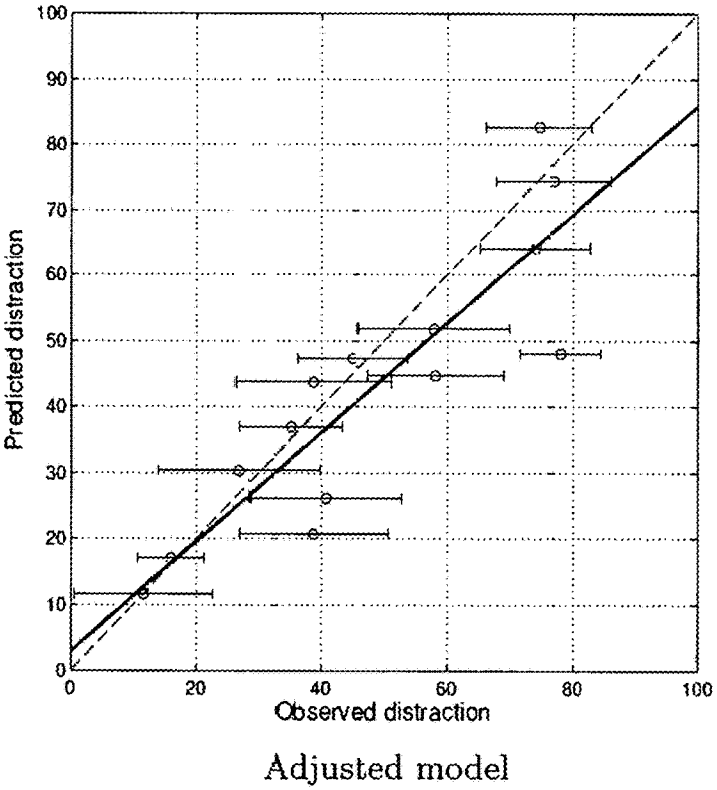

FIGS. 71A-FIG. 71B illustrate model fit to validation data set 1. Error bars show 95% confidence intervals calculated using the t-distribution.

FIG. 72 describes RMSE and RMSE* for validation set 1 and training set.

Figure 73B:
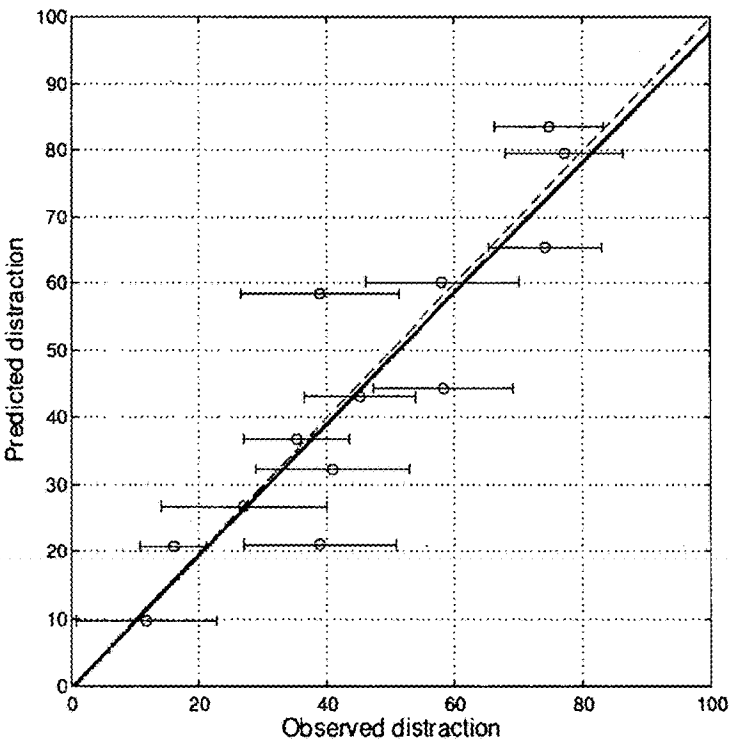
Figure 73A:
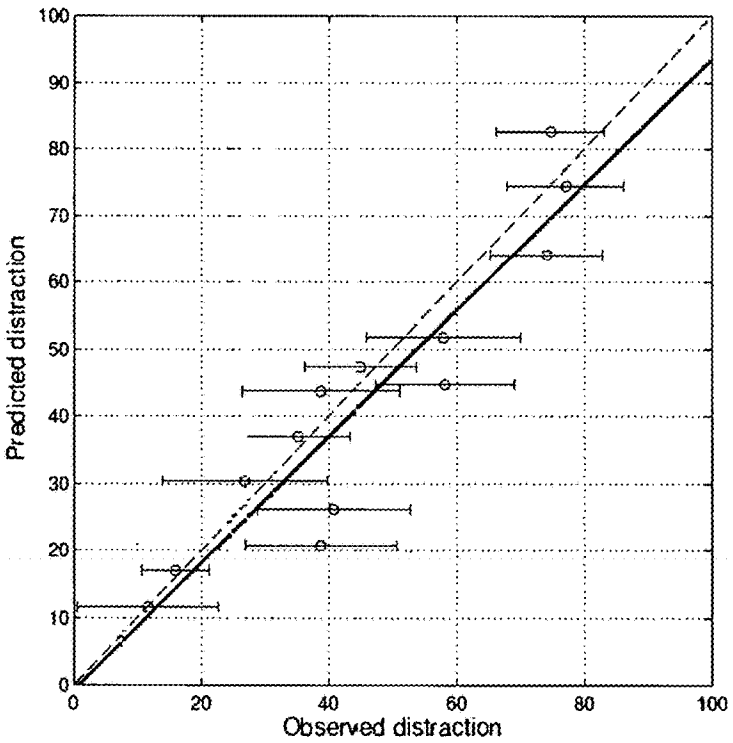

FIGS. 73A-FIG. 73B illustrate model fit to validation data set 1 with outlier (stimulus 10) removed. Error bars show 95% confidence intervals calculated using the t-distribution.

FIG. 74 describes RMSE and RMSE* for validation set 1 (with stimulus 10 removed) and training set.

FIG. 75 describes outlying stimulus from validation data set 1. y is the subjective distraction rating, y^ is the prediction by the adjusted model, and y^ is the prediction by the interactions model.

FIG. 76 describes RMSE and RMSE* for validation set 2 and training set.

Figure 77A:
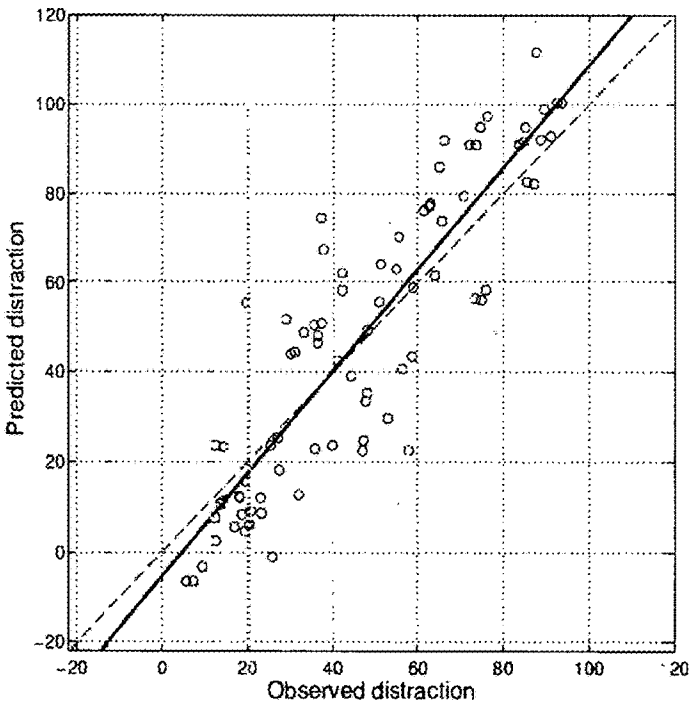
Figure 77B:
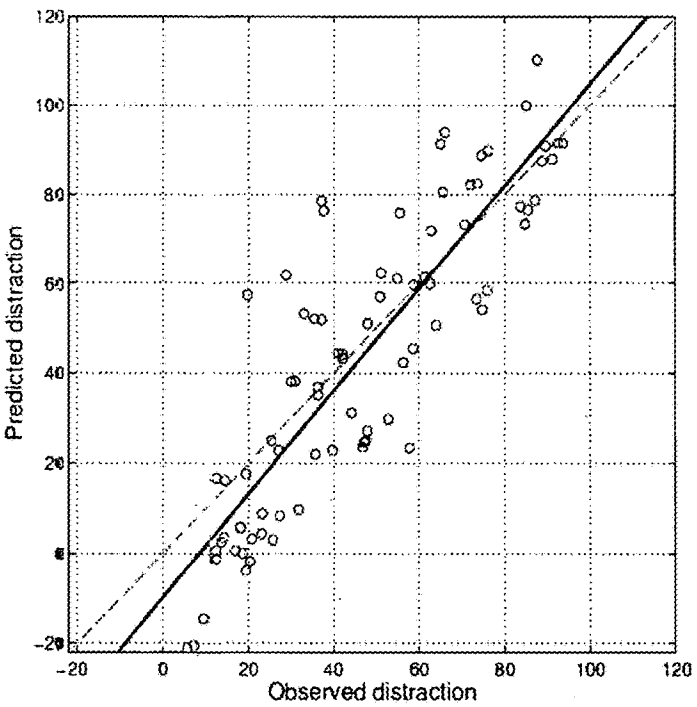
Figure 79B:
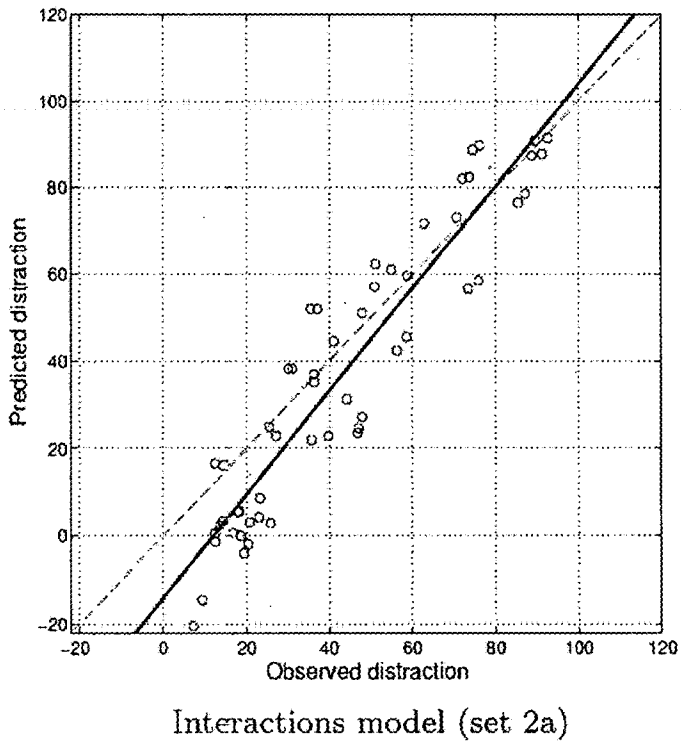
Figure 79A:
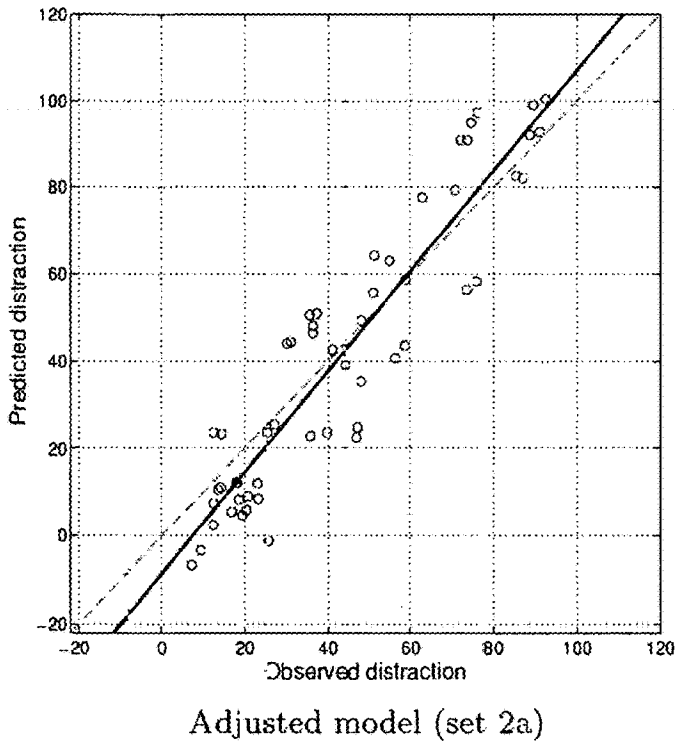
Figure 79D:
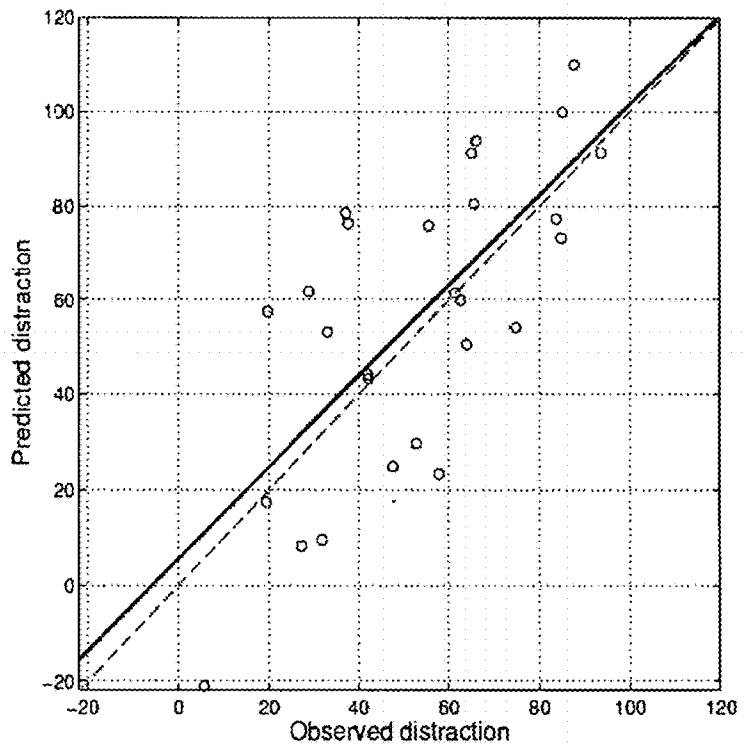
Figure 79C:
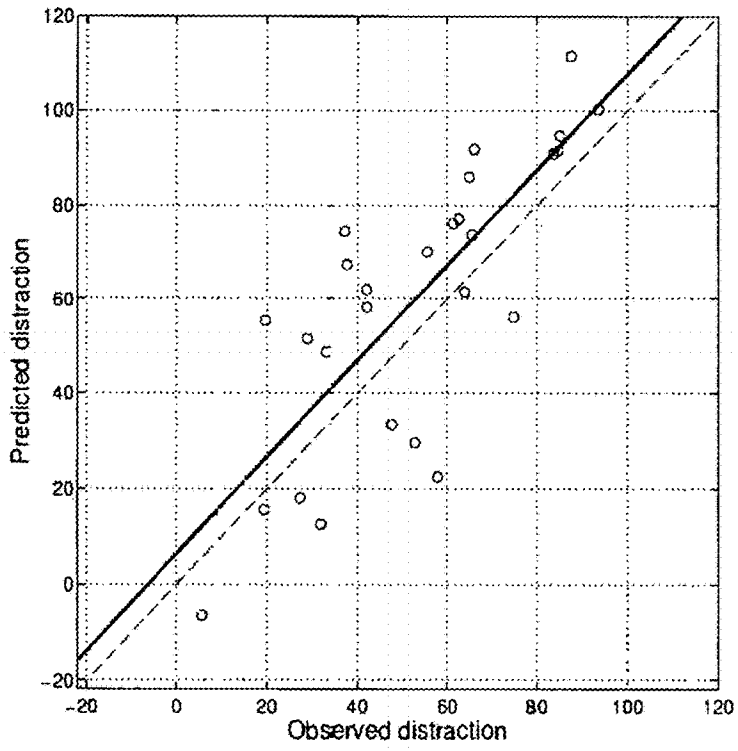
Figure 80A:
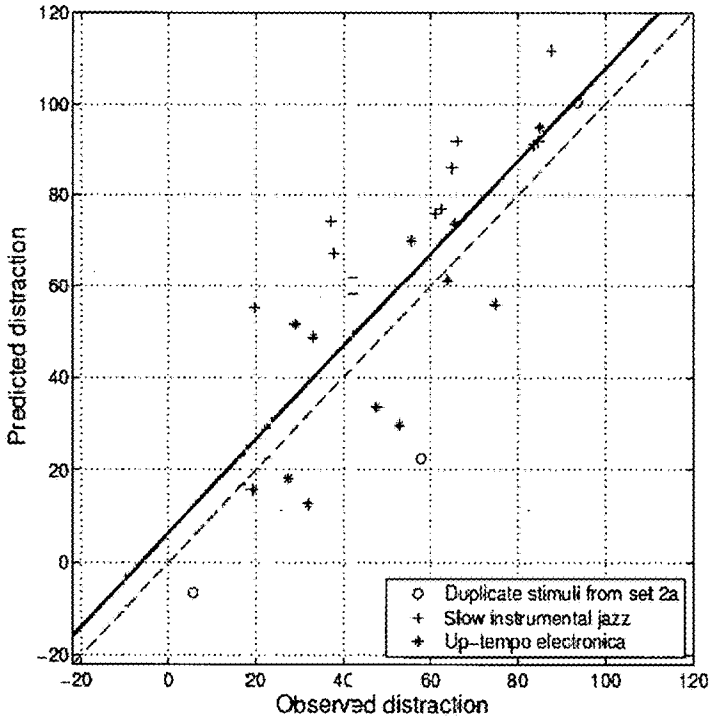
Figure 80B:
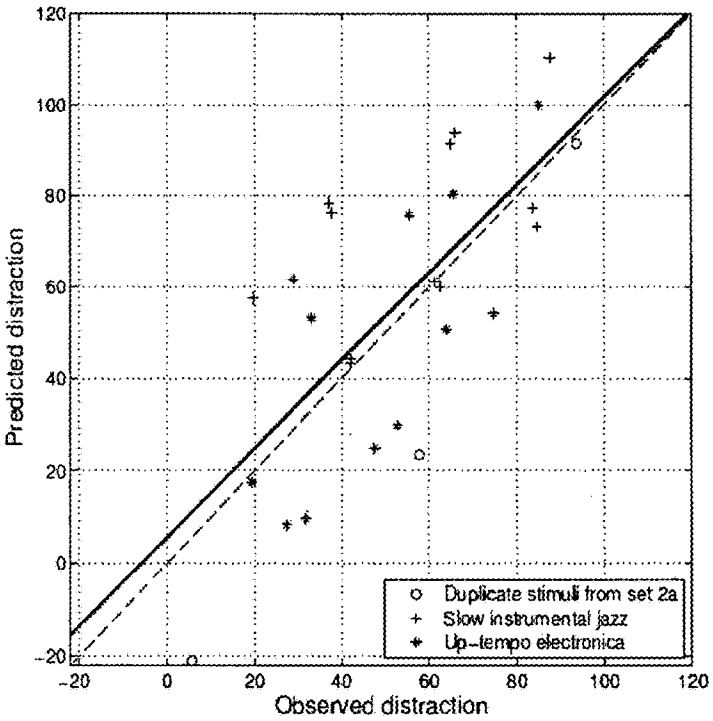
Figure 80C:
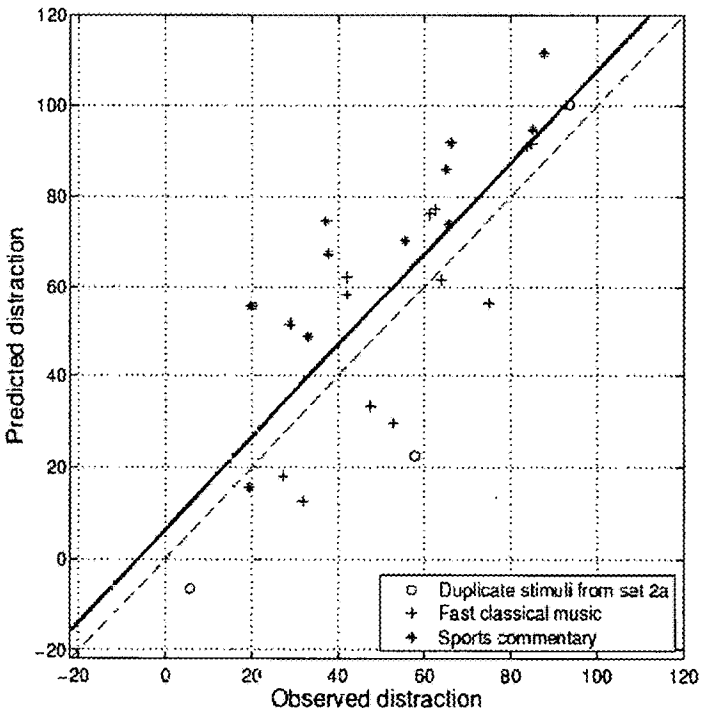
Figure 80D:
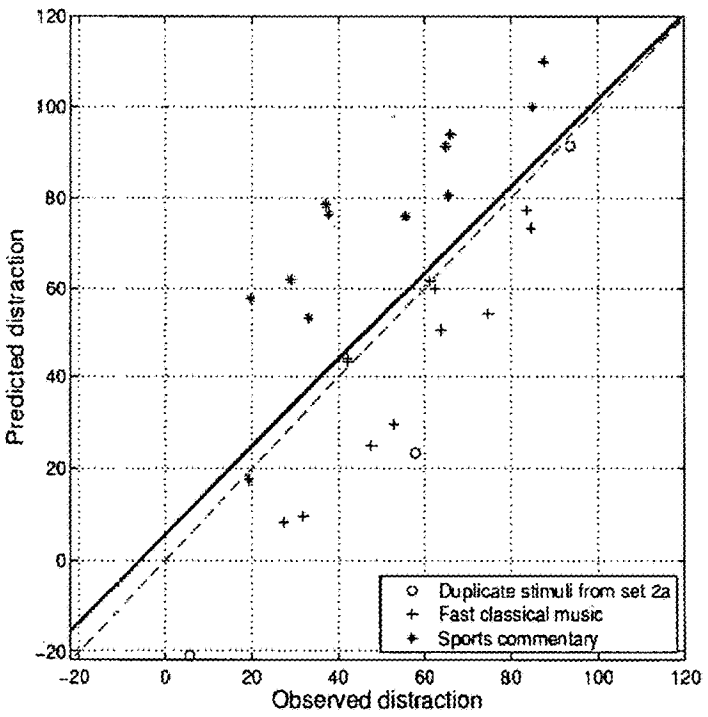
Figure 80E:
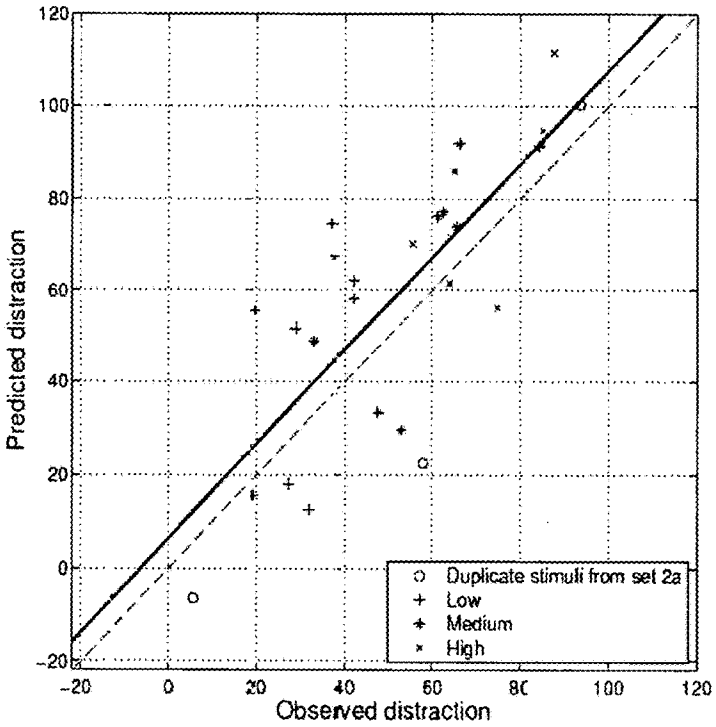
Figure 80F:
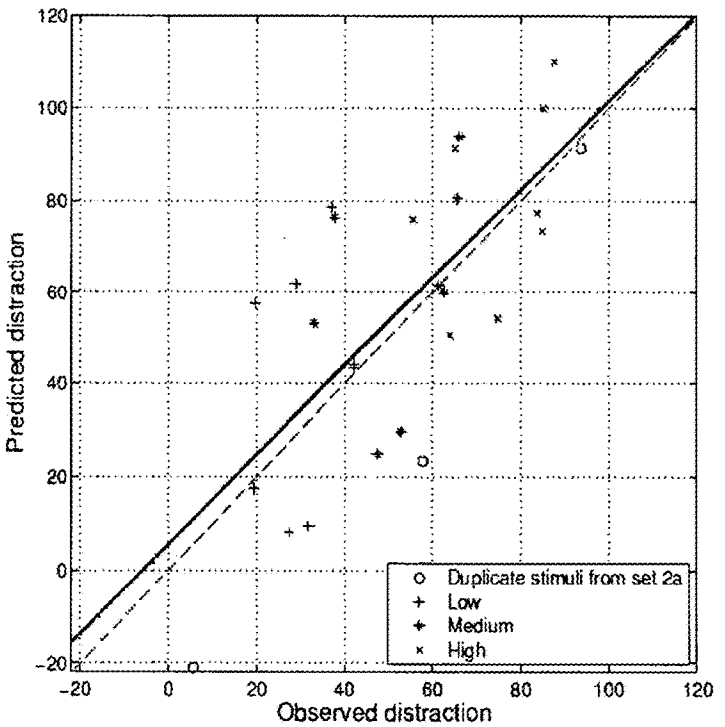
Figure 80G:
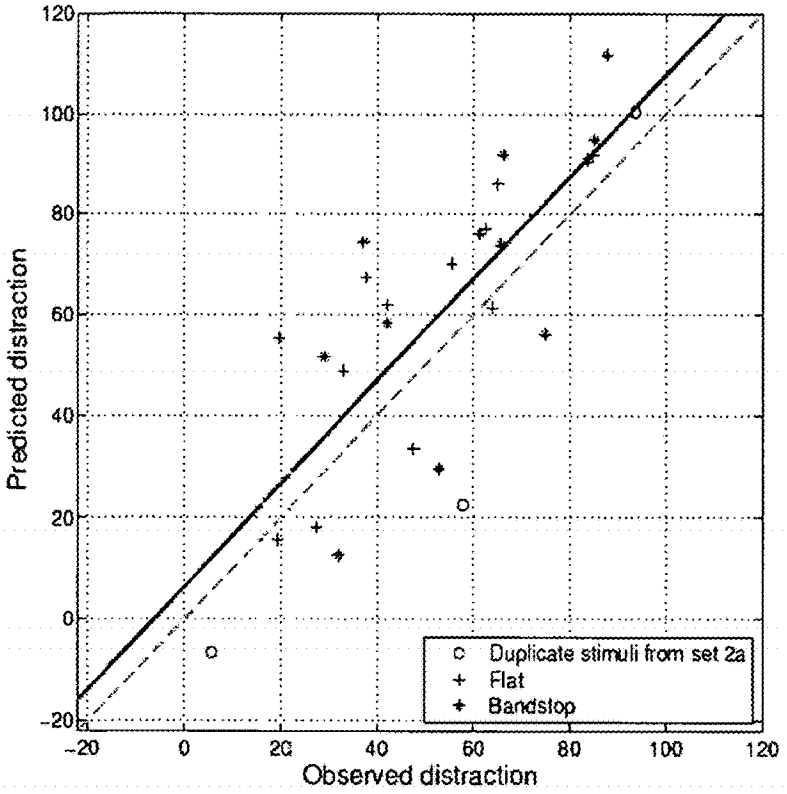
Figure 80H:
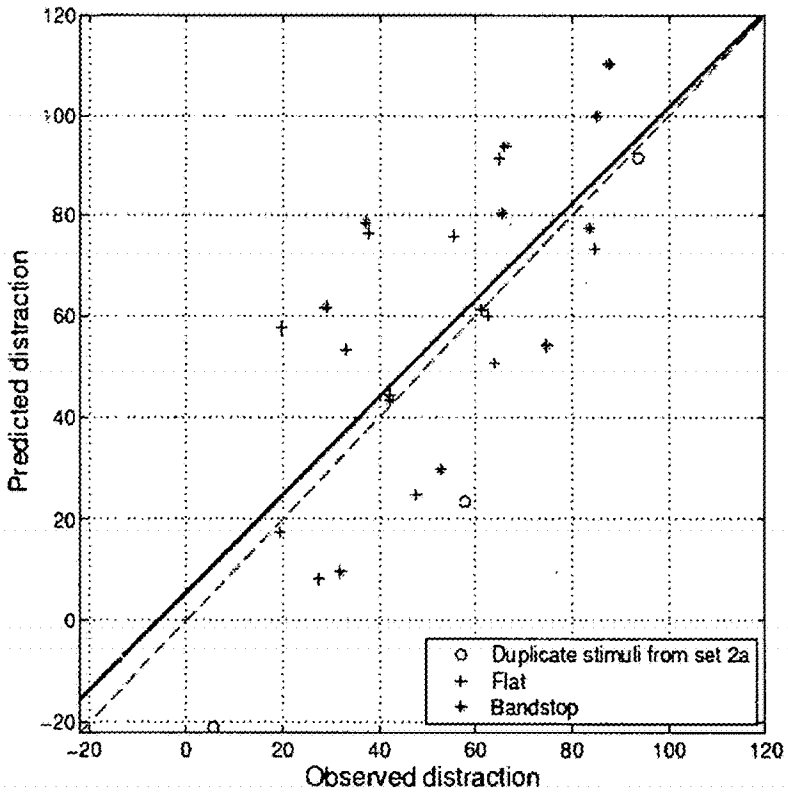

FIGS. 77A-FIG. 77B illustrate model fit to validation data set 2.

FIG. 78 describes RMSE and RMSE* for separated validation set 2 and training set.

FIGS. 79A, FIG. 79B, FIG. 79C, and FIG. 79D illustrate model fit to validation data set 2 with separated data sets.

FIGS. 80A, FIG. 80B, FIG. 80C, FIG. 80D, FIG. 80E, FIG. 80F, FIG. 80G, and FIG. 80H illustrate model fit to validation data set 2*b* delimited by factor levels (Continued below.).

Figure 1:
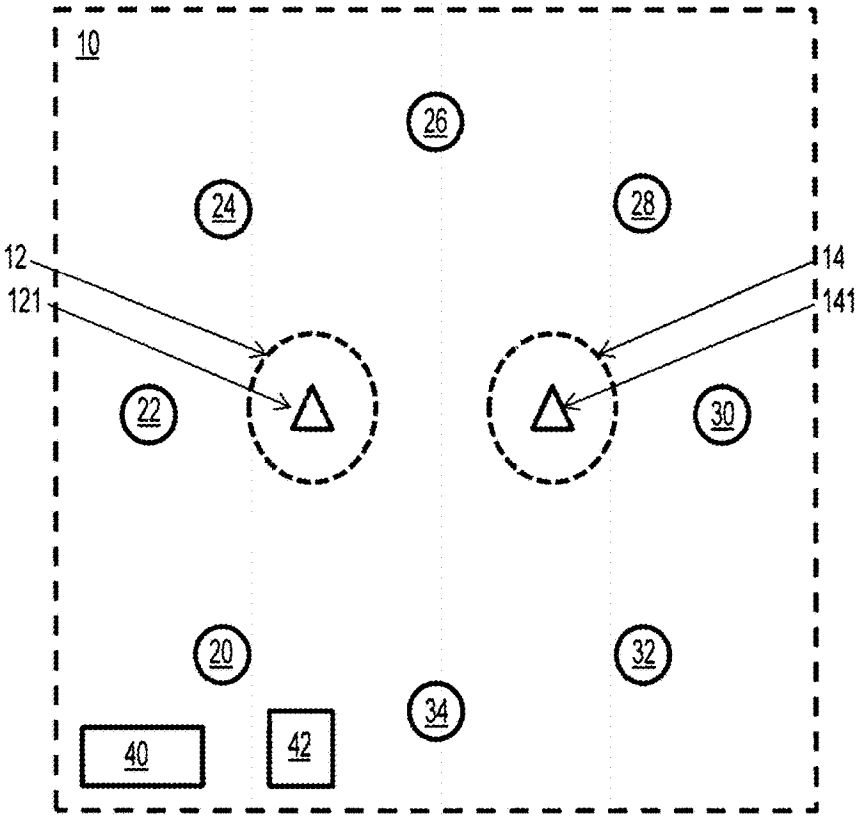
FIG. 1 illustrates a general set-up of a system 10 for providing sound to two areas or volumes

In FIG. 1, a general set-up of a system 10 for providing sound to two areas or volumes 12 and 14 is illustrated. The system comprises a space wherein the two areas 12/14 are defined. Speakers 20, 22, 24, 26, 28, 30, 32 and 34 are provided for providing the sound. In this embodiment, the speakers 20-34 are positioned around the areas 12/14 and are thus able to provide sound to each of the areas 12/14. In other embodiments, speakers may be provided e.g. between the areas so as to be able to feed sound toward only one of the areas.

Usually, the areas 12/14 are provided in the same space, such as a room, a cabin or the like. Usually, there is no dividing element, such as a wall or a baffle, between the two areas.

Microphones 121 and 141 are provided for generating a signal corresponding to a sound within the corresponding area 12/14. Multiple microphones may be used positioned at different positions within the areas and/or with different orientations and/or angular characteristics if desired.

The speakers 20-34 are fed by a signal provider 40 receiving one or more signals and feeding speaker signals to the speakers 20-34. The speaker signals may differ from speaker to speaker. For example, directivity of sound from a pair of speakers may be obtained by phase shifting/delaying sound from one in relation to that of the other.

The signal provider 40 may also receive signals from the microphones 121/141.

The signal provider 40 may receive the one or more signals from an internal storage, an external storage (not illustrated) and/or one or more receivers (not illustrated) configured to receive information from remote sources, such as via airborne signals, WiFi, or the like, or via cables.

The signal(s) received represents a sound to be provided in the corresponding area 12/14. A signal or sound may relate to music, speech, GPS statements, debates, or the like. One signal or one sound, naturally, may be silence.

As is usual, the signal received may be converted into sound where the conversion comprises A/D or D/A converting a signal, an amplification of a signal, a filtering of a signal, a delaying of a signal and the like. The user may enter desired characteristics, such as a desired frequency filtering, which is performed in the conversion so that the sound output is in accordance with the desired characteristics.

The signal provider 40 is configured to provide the speaker signals so that the desired sounds are generated in the respective areas. A problem, however, may appear when the sound from one area is audible in the other area.

Methods are described above of determining the interference in one area or zone from sound provided in another area or zone or a value representing a quality of the sound generated in one zone when sound is audible from another zone. Also below, such methods are described.

However, in addition to determining an interference or quality value, the signal provider determines a parameter or characteristic, of the conversion, which may be adapted or altered in order to reduce the interference or increase the acceptability of the sound provided in the first zone 12. This characteristic may be a characteristic of the first sound signal or the first signal on the basis of which the first sound signal is provided. The characteristic may alternatively or additionally be a characteristic of the second sound signal or the second signal on the basis of which the second sound signal is provided.

Naturally, in one situation, the signal provider may automatically alter the parameter/characteristic. Actually, the signal provider may select to not provide the second signal until such alteration is performed, so that no excessive interference is experienced in the first area/zone. For example, if a change is desired in the second signal, such as a change in song, source, volume, filtering or the like, a user in the second zone may enter this wish into the user interface. The signal provider may then determine an interference value from the thus altered second signal or second audio signal but may refrain from actually altering the second (audio) signal until the interference value has been determined and found to be below the threshold.

The threshold may be altered by e.g. a user in the first zone by entering into the user interface whether the second (audio) signal is found distracting or not. Thus, via the user interface, a user may increase or decrease the threshold.

The signal provider may alternatively propose this change in the parameter by informing the user on e.g. a user interface 42, which may comprise a display or monitor. Multiple parameter changes may be proposed between which a user may select by engaging the display 42 or other input means, such as a keyboard, mouse, push button, roller button, touch pad or the like.

Naturally, the parameter change may be proposed by providing an audio signal in the first and/or second zones. Selection may be discerned from oral instructions or the like from the user.

The user interface may be used for other purposes, such as for users in the first/second areas/zones to select the first/second signals, alter characteristics of the first/second sound/audio signals (signal strength, filtering or the like).

Below and above, different parameters/characteristics are described. It has been found that it is preferable for the signal provider to analyse the first signal and determine whether this signal is a speech signal. Speech may be identified in a number of manners, some of which are also described above. Subsequent to this analysis, parameters/characteristics may be selected from different groups of such parameters/characteristics depending on the outcome of the analysis.

This analysis may be performed intermittently, constantly or when the user selects a new first signals, such as using the user interface.

Below, tests performed and parameters derived will be described in two overall chapters where the first signal will be described as a target signal and the second signal as an interferer.

Building a Model to Predict Acceptability

In this chapter, the primary research question is "How can the acceptability of auditory interference scenarios featuring a speech target be predicted?". This chapter describes the construction of a model to answer this question. A first section introduces model construction in general, and outlines the data sets available for use and the metrics by which models can be compared. Next, a section constructs a first set of models, of which one is selected, by using features based on the internal representations of the CASP model. A benchmark model is also constructed, and the prediction accuracy and generalisability of the models are compared. Subsequently, in a subsequent section the process is repeated after generating further features based on stimuli levels and spectra, and manually coded features based on subject comments. In the following section the process is repeated once more, further including features derived from the Perceptual Evaluation methods for Audio Source Separation (PEASS) model. The various selected models are compared in the following section, and the findings are summarised and conclusions drawn in the last section.

Modelling Approach

Before constructing and evaluating various models of acceptability, it is important to introduce some general principles regarding the construction of models. It is also necessary to identify the available data for training and testing the models, as well as outlining the metrics by which models will be evaluated and compared.

Model Complexity

A range of possible acceptability models can be constructed, from a simple linear regression using one feature (such as SNR) to complex, hierarchical, multi-dimensional models. Some models will be more accurate, but at the cost of robustness to new listening scenarios or stimuli. In general when building models of prediction it is useful to include as many features as possible as long as this does not diminish robustness. This is because complex attributes, such as whether a listening scenario will be perceived as acceptable, depend upon a wide array of disparate contributing factors. Using too few features may result in a model with inaccuracies which fail to account for significant effects acting upon the attribute (in this case, acceptability). Conversely, a model including too many features may have an increased accuracy for the data upon which the model is trained, but fail to replicate this improved accuracy when tested upon new data. This latter error, known as 'overfitting', occurs because a regression simply fits the feature coefficients to the data in the optimal manner so a greater number of features will tend to improve prediction accuracy even if some features do not genuinely describe the prediction attribute. Overfitting can therefore be detected by comparing the accuracy of the model at predicting the training set with the accuracy of the model at predicting the test set. A reasonable compromise, therefore, needs to be achieved between the selection of sufficient features to accurately model the attribute and the selection of sufficiently few features to maintain the robustness of the model to a new data set (and to new test scenarios if desired).

For the prediction of acceptability, a very simple model using only the SNR of the listening scenario as a feature can be constructed. A model based on SNR is a sensible starting point because the acceptability of auditory interference scenarios is clearly bounded by the audibility of the target and interferer programmes. Such models are capable of predicting acceptability scores with reasonable accuracy, and the robustness both to new data and to new listening scenarios would be expected to be high due to the simplicity of the model. Conversely, however, such a model would be unlikely to represent the optimal accuracy of all models of the acceptability of sound zoning scenarios because the acceptability of auditory interference scenarios is likely to be a multi-faceted problem, dependent on multiple characteristics of both the target and interferer audio programmes. Put another way, it seems very likely that the sound zoning method and stimuli involved have some effect upon the acceptability of the listening scenario beyond the resultant SNR. If this assertion is true, a multi-feature model of acceptability will be capable of greater prediction accuracy (while maintaining robustness), and this will allow for a deeper understanding of those aspects which affect the listening scenarios under consideration. If the assertion is false, however, a single-feature model utilising SNR should represent the optimum model of acceptability, and there would be no reason to assume that any other features have a significant effect upon acceptability.

On the foundation of this argument, then, the appropriate benchmark against judge the performance of the constructed acceptability model would be the performance of the single-feature SNR based model of acceptability.

Data Sets for Training and Testing Models

Two experiments were conducted, the first of which was designed to produce acceptability data for the training of an acceptability model and the second of which was designed to produce a smaller quantity of acceptability data for the validation of the acceptability model. In addition to these, the acceptability data procured during a speech intelligibility experiment, and the masking and an acceptability experiment could potentially be utilised for either training or testing. The latter data set recorded acceptability thresholds rather than binary data, however, and would therefore be difficult to compare with the other data sets. The acceptability data gathered from the speech intelligibility experiment, however, could be utilised as an additional validation set.

The justification for this application of data sets is as follows: the widest range of ecologically valid stimuli were used in the acceptability experiment, making it ideal for training. The data gathered from the speech intelligibility experiment (hereafter referred to as 'validation 1') were produced using a methodology and stimuli fairly similar to that of the training data, which makes it ideal for validating that the model extrapolates well to new stimuli. The remaining data set (hereafter referred to as 'validation 2'), having been gathered using stimuli processed through a sound zoning system and auditioned over headphones makes it better suited to an extremely challenging type of validation: simultaneous validation to new stimuli and reproduction methods. Therefore, a model which validates well to validation 1 would be considered robust to new stimuli, whereas a model which validates well to validation 2 would be, to some degree, considered robust to sound zone processing techniques. The key differences between the three data sets are outlined in the table illustrated in FIG. 2.

Model Metrics

In training and testing the models constructed, metrics are required to describe both the accuracy and robustness of the predictions. This section describes the selected metrics, the justification of their selection, and their calculation. Subsequently, the schema for the application of these metrics across data sets is laid out.

Accuracy

To evaluate the prediction accuracy of the model there are broadly two groups of metrics which may be used: the error and the correlation. The error is a measure of the distance between the model predictions and the subjective data, whereas the correlation is a measure of the extent to which these two quantities vary in the same manner. These two approaches to describing accuracy are very similar and generally produce similar trends. It is possible, however, to have two sets of predictions with the same correlation yet with different error (or vice versa); for example, if all the predictions have a constant offset from the subjective data the correlation will be very high, even though the error may be high. When such occasions arise it is usually an indication that by making an appropriate adjustment to the model (or some of its features) the predictions can also have low error. Fundamentally, however, a model which makes accurate predictions is one which has low error, and this should therefore be the ultimate metric of importance.

Multiple metrics describing error and accuracy exist. In this work R is used for correlation whereas RMSE, and RMSE* are used to describe error.

Firstly, the denominator of the RMSE equation, n−k inherently penalises models with greater features; this is useful when building multi feature models because as the number of features increases a regression is more closely able to map the predictors to the response data. However even if the predictors are entirely random, the inclusion of greater features will allow a regression to more closely map the predictors to the response data. When tested on new data, however, the model is unlikely to generalise well because the features did not actually describe the phenomenon being modelled in a meaningful way. This is an example of overfitting and, in the extreme example, if k is equal to n the RMSE score will be calculated to be infinity.

Secondly, in order to calculate the RMSE* the confidence interval is required. The data under investigation here is binary, however, so the confidence intervals were calculated using the normal approximation to the binomial distribution calculated with:

$$z = 1.96 \times \sqrt{\frac{p(1-p)}{n}} \tag{8.1}$$

where p is the proportion of subjects describing the trial as acceptable. It should be noted that when using the normal approximation to the binomial distribution, confidence intervals will have width 0 for trials in which all subjects agree. As a result, the RMSE*s calculated during model training will be artificially inflated, and so should be interpreted with caution. However, since this bias is related to the subjective scores it will affect all constructed models equally and thus does not obstruct model training.

Robustness

It is desired that the model should be robust to new stimuli, and one way to help ensure this is to minimise the extent to which multiple features are utilised to describe a single cause of variance in the training data. For example, if SNR, target level, and interferer level are all found to correlate well with the subjective data, it may be wise to avoid using all three features in one model since the SNR is entirely contingent upon the target level and interferer level. In some cases it may be less clear when multiple features describe the same phenomena, and it is therefore useful to have an objective method for estimating this. One way to achieve this is to calculate the multicollinearity of the features in the model, i.e. the degree to which the actual feature values vary together. When multicollinearity is high, it is likely that both features are describing the same, or similar, characteristics of the data. The multicollinearity can be estimated using the Variance Inflation Factor (VIF), which is calculated with:

$$VIF_{i0} = \frac{1}{1 - R_i^2} \tag{8.2}$$

where $R_i^2$ is the coefficient of determination between features i and i0. Therefore, if two features have no correlation with one another the VIF will be 1, and if two features are perfectly linearly correlated (negatively or positively) the VIF will be infinity. A search for multicollinearity within a regression model can therefore be conducted by calculating the VIF for every pair of features.

Hair and Anderson (2010) recommend that the features in a model should have VIF no higher than 10 which correspond to the standard errors of the model features being 'inflated' by a factor three ($\sqrt{10}$=3.2) but they also warn for small training sets a more stringent threshold should be enforced. Such thresholds may be arbitrary and some contexts permit VIFs much higher than 10 whereas for other contexts a VIF of 10 represents extreme multicollinearity. Instead, it may be important to identify the cause of the multicollinearity and make a contextually informed decision about the validity of the model. Therefore, consideration may be given to the causes of high VIFs without imposing an arbitrary threshold. Although many of the features which would be ultimately excluded were known to describe similar phenomena, it is sometimes worthwhile to include multiple similar features to find which offer the best performance.

A Model Using CASP Based Features

One place to start modelling the prediction of acceptability would be to use features derived from the CASP model. This is a convenient starting point since CASP has already been used earlier in this work to model the human auditory system in a physiologically inspired way.

Features

The final step before model training is the construction of a list of features (sometimes called 'predictor variables'). In order to construct a model to predict acceptability features must be identified and combined into a cohesive model. The identification of features requires contextual understanding of the problem and is therefore difficult to entirely automate. As a result a 'complete' list of possible features is unachievable. Instead, a large number of features which might reasonably be expected to relate to the listening scenario are tested. It can never be guaranteed, therefore, that every relevant feature has been identified, but with a sufficiently large number of plausible candidate features there may be a reasonable degree of confidence that the relevant avenues of investigation have been considered.

The CASP model was used (excluding the final modulation filterbank stage) to produce internal representations of the target, interferer, and mixed stimuli. From these representations a wide range of features was derived. The stimuli were divided into 400 ms frames stepping through in 100 ms steps and each frame was processed using the CASP model. Three groups of features were derived from the resulting frames: standard framing (SF), no overlap (NO), and 50 ms no overlap (50 MS). SF features were obtained by time framing in the way previously found to be optimal for masking threshold predictions in chapter 4, NO features were based on the signals reconstructed by using only every fourth frame (i.e. as if the stimuli had been processed by CASP in 400 ms non-overlapping frames), and 50 MS features were derived using the NO internal representation signal broken into 50 ms frames. The 50 MS condition was included because short-time analysis is sometimes worthwhile for speech in order to capture information over one or several phonemes. It is important to note that the NO internal representation would not be identical to an internal representation produced by using CASP to process the entire signal in one chunk. This latter scenario, however, is not considered since for a real system it is likely that the stimulus duration would be indefinite, and thus some type of framing schema would be necessary. From these internal representations a large number of features were derived. In each case, the features were constructed due to an expected relationship with acceptability.

Time-Intensity Features

One set of features was based on the intensity of the internal representations across time, which is related to the perception of the level of the programmes, and thus would likely relate to acceptability. Three minimum level features were derived for the target, interferer, and mixture programmes: TMinLev, IMinLev, and MMinLev respectively. These features were calculated by summing across all time-frequency units of the internal representation within each 400 ms frames. The resulting vector indicates the total intensity of each 400 ms frame, and of these the lowest value was selected for use as a feature. These features therefore describe, for the target, interferer, and mixture programmes, the energy of the 400 ms frame with the least energy. By recording the intensity of the frame with the highest intensity three more features, TMaxLev, IMaxLev, and MMaxLev, were constructed. A further six features were constructed by taking the ranges and standard deviations of these frame vectors. These features indicate the variation of frame intensity over time and therefore describes the dynamic range of the programmes; these features are referred to as TRanLev, IRanLev, and MRanLev, TStdLev, IStdLev, and MStdLev. I total, there were 12 features in this group.

Frequency Intensity Features

Another set of features was based on the relative intensities across frequency. For these features the same process was followed as for the previous 12 features however instead of summing across frequency bands and samples within each frame (and then calculating quantities based on the frame vector), the internal representations were summed across samples within each frame and across frames (but not across frequency bands). In this way the TMinSpec, IMinSpec, and MMinSpec, and the TMaxSpec, IMaxSpec, and MMaxSpec features represent the minimum and maximum intensity in any frequency band respectively. In addition to these 6 features, it may also be useful to record the frequency band which had the highest and lowest intensities. Thus the TMinF, IMinF, and MMinF, and the TMaxF, IMaxF, and MMaxF are represented as the number of the frequency bin (i.e. 1-31) which had the highest intensity (averaged across and within all frames). For the range and standard deviation, the TRanSpec, IRanSpec, and MRanSpec, and the TStdSpec, IStdSpec, and MStdSpec, represent the change in intensity across frequency bands. To better understand the meaning of these features, it can be noted that broadband white noise, having equal energy across all frequencies, would have a StdSpec of 0, and a sine tone would have a fairly high StdSpec.

Some subjects reported that sibilance from interfering speech and cymbals in interfering pop music were particularly problematic, so it may be that high frequencies in the interferer programme are particularly noticeable. One way to account for this would be to record the ratio of energy in the higher frequencies to that in the lower frequencies. At precisely which frequency to draw the boundary between 'high' and 'low', however, is unclear. In the musical information retrieval toolbox, one of the many available features is similar to the process described here and is referred to as 'brightness'. Two cut-off thresholds are suggested in the toolbox: one at 1 kHz, and one at 3 kHz. For this work, therefore, both cut-off points were recorded and the cutoffs at 1 kHz are referred to as TSpec1, ISpec1, and MSpec1, and the cutoffs at 3 kHz are TSpec3, ISpec3, and MSpec3.

If both programmes have substantial high frequency content, the interfering high frequencies may be obscured by the target. To consider this, features were calculated by subtracting IMaxF from TMaxF, and by subtracting MMaxF from TMaxF; these are referred to as SpecFDiff and SpecFChange. The first gives an indication of the distance (in frequency bands) between the peak intensity of the interferer and the target, and the second gives a similar indication for the mixture and target. Another two features, AbsSpecFDiff and AbsSpecFChange, were calculated by taking the absolute value of each of these features, such that whichever programme had the higher frequency peak intensity was no longer relevant—merely the distance between the peaks. In total this constitutes a further 28 features.

Correlation Features

A cross-correlation feature, based on the μ value of the CASP model, is calculated by multiplying each time-frequency unit in the target programme by the corresponding unit in the mixture programme and summing across time and frequency (for each frame). These values are then divided by the number of elements in the matrix, and the resulting vector describes the similarity between the programmes over time. The mean and standard deviation of this vector were taken as features, 'XcorrMean' and XcorrStd.

In Huber and Kollmeier (2006), a model of audio quality is described based on a similar approach to the XcorrMean feature. The Dau et al. (1997) model, a variant of the CASP model, is used to process the reference and test signal, before the cross correlation is used to produce the Perceptual Similarity Measure (PSM) which is taken to be a measure of the audio quality because low correlation indicates that severe degradations are present in the test signal. In addition to the PSM, a measure called the $PSM_t$ is calculated, which is based on taking the 5% quantile of multiple cross correlations for the signals processed in 10 ms frames (but subsequently weighted using a moving average filter). In the paper, no explanation is given for the selection of the 5% quantile, but it seems reasonable that this choice produces a metric which describes the worst degradations in a way which balances both the severity of the degradations with the frequency of them.

In order to consider the possibility that this may be a more powerful feature than the mean cross correlation, a feature was produced based on both the 5% and 95% quantiles: Xcorr5per and Xcorr95per.

Thus, based on cross-correlation, a further four features were included in the pool.

SNR Based Features

Features based on the SNR of the internal representations were also calculated. For each frame, the target programme internal representation was summed across time and frequency and divided by the equivalent sum for the interferer programme. The mean and minimum of this vector were taken as the features, MeanSNR and MinSNR, to describe the relative intensities over time. Another way of investigating this internal SNR was also considered. Each unit in the time-frequency map of each frame of the target programme was divided by the equivalent time-frequency unit in the mixture internal representation. The resultant time-frequency map therefore gives the perceptual intensity ratio, where the intensity of each unit relates to perceived prominence of the target therein. Each time-frequency unit was then replaced with a 1 if it exceeded a fixed threshold, and a zero if it did not. The proportion of units marked with a 1 can then be used as a feature to describe the proportion of the mixture programme which is dominated, by at least a given threshold, by the target programme. The threshold then represents the percentage which must be dominated by the target; i.e. a threshold of 0.9 indicates that at least 90% of the intensity in the mixture is due to the presence of the target programme. Since the threshold is somewhat arbitrary, 10 thresholds were used in steps of 0.1 from 0 to 0.9. These features are named DivFrameMixT0-DivFrameMixT9. The types of features were also calculated for the interferer programme divided by the mixture, these are DivFrameMixI0-DivFrameMixI9. A further 22 features were thus added to the feature pool based on SNR.

Summary 66 features were calculated based on the 400 ms framed internal representations, and equivalent features were calculated for the NO and 50 MS conditions. In total, therefore, 198 features were calculated to describe relevant characteristics of the target, interferer and mixture.

Model Building Approach

With the training and validation data sets, the evaluation metrics, and the feature list described, the approach to constructing, evaluating and refining the models can now be outlined.

Assuming that sufficient high quality data has been obtained for model training and validation, there are two primary considerations in the construction of a model: feature combination and hierarchy. The feature combination relates to which features, from a pre-specified list, should be selected, and the hierarchy relates to the way those features should be combined to form the model. A common, and powerful, hierarchy is multi linear regression. The key advantage of multi linear regression is its simplicity. A multi linear regression model is one which is of the form:

$$y = \lambda_0 + \sum_{i=1}^{i=n} \lambda_i x_i \tag{8.3}$$

where $\lambda_i$ is the linear coefficient applied to each feature $x_i$, and $\lambda_0$ is a constant bias. When the features are normalised, the coefficients give an indication of the relative importance of each feature to the prediction accuracy of the model; for this reason the coefficients are sometimes referred to as 'weightings'. Additionally, feature coefficients can be used to identify poor feature selection; if two features are selected describing similar phenomena yet are assigned opposite coefficient signs this can imply that the model could be reconstructed replacing the two features with a single feature which captures the relevant information appropriately. One disadvantage to multi linear regression is that the resultant model is capable of producing predictions outside the range of acceptability scores (in this case less than zero and greater than one). While other, more sophisticated hierarchies do not suffer this disadvantage, a multi linear regression model is more easily justified (at least initially) because, failing the presence of contextual knowledge about the relationship between the features and the subjective data, there is no reason to assume any particular type of non-linearity. If, after the construction of some multi linear models, further investigation reveals that greater accuracy could be achieved by using more sophisticated hierarchies this can be done after the most useful features have been identified.

The feature combination problem can be optimally solved by an exhaustive search (brute-force), i.e. by combining every possible combination of features in the list and choosing the model which best meets the performance criteria. A serious practical limitation of this approach, however, may be expressed as: 'The problem with all brute-force search algorithms is that their time complexities grow exponentially with problem size. This is called combinatorial explosion, and as a result, the size of problems that can be solved with these techniques is quite limited'. To give an example of the combinatorial explosion within context, the total number of models to construct for a list of length η features is equal to:

$$N = \sum_{k=1}^{k=n} \binom{n}{k} \tag{8.4}$$

For a short list of only 5 features, therefore, N=31. For a longer feature set comprising of 30 features, however, $N=1.0737\times10^9$. If models could be constructed at a rate of 100 per second, it would still take around 1243 days to complete this processing. It is clear, therefore, that for feature lists of the order described in the previous section (i.e. hundreds of features) the problem quickly becomes intractable. In such cases a search algorithm is required to find the most accurate solutions within in a reasonable time frame.

Training

In this work the Matlab 'Stepwisefit' function was used as an implementation of a stepwise search algorithm for training an initial multi-linear regression model. This recursive algorithm works as follows:

1. fit initial model (this can be a constant),
2. If any features not currently selected has a p-value lower than an entrance tolerance (i.e. the feature would be unlikely to have a coefficient of 0 if added to the model), add the feature with the lowest p-value,
3. If any features currently in the model have a p-value greater than an exit tolerance, remove the feature with the largest p-value and return to step 2, otherwise end.

In this way the algorithm selects, one by one, new features which are most likely to improve the prediction accuracy of the model. Step 3 allows for the removal of features which have subsequently become obsolete; this can occur when the combination of two or more features describes the variance which was also already (less accurately) described by a single feature in the model. It is usual to use 0.05 for the entry and exit criteria, and these are the values used in this work.

After training a model using this algorithm, the history of steps was manually investigated to search for instances of multicollinearity and other signs of poorly selected features. From here, further manual adaptations could be made (e.g. by omitting or adapting features).

It was likely that the process would result in an over fitted model (since many features on the list were similar). This possibility of over "fitting necessitates a cross validation step.

Cross Validation

During training, the robustness of the models to new stimuli was considered by using a 2-fold cross validation method on the training data. This involves randomly shuffling the 200 trials and splitting the data set into two 100 trial 'folds'. The model was trained on one fold and the RMSE of the predictions for the other fold was calculated, before swapping the folds and repeating. The two RMSEs were averaged and this mean RMSE was reported. In this way a 2-fold cross validation procedure gives an indication of how the trained model is likely to perform when used to predict new test data. It is worth noting that even for models which generalise very well, the 2-fold cross validation procedure will tend to produce RMSEs which are higher than calculated on the full model, since the procedure has only half the data on which to train.

It is possible that when the stimuli are randomly shuffled, each fold may contain stimuli with very different characteristics for one or more of the features in the model. When this happens, the cross validation accuracy will be artificially diminished, and the scores will give an unreasonably pessimistic indication of the generalisability of the model. The optimal solution to this problem involves exhaustively evaluating every possible pair of stimulus-fold assignments. This process, however, is subject to a similar type of combinatorial explosion as in the model training stage. In this case an exhaustive search would require $$\binom{200}{100} = 9.0549\times10^{58}$$

combinations to be evaluated. This is impracticably large, however a simple solution exists to the practical problem of obtaining the mean cross validation score: the mean score can be estimated by taking a random sample of all possible combinations. In this work, ten thousand 2-fold cross validations were performed for each model under test, and the mean RMSEs (across folds and samples) was compared with the RMSE reported in the training stage to give an indication of the robustness of the model to new data.

Validation

Finally, for each model of interest, predictions were made for the data sets from validation 1 and validation 2. These predictions were tested for error and correlation, giving an indication of the robustness of the model to new contexts, listening scenarios, and sound zone processing.

A Benchmark Model

When evaluating a model it can be useful to have a benchmark against which to compare the model to aid in interpreting the performance. For a complex model, a good benchmark will often be a simple model, for if a simple model can achieve equal accuracy and robustness the additional complexity becomes unwarranted. In this work a simple benchmark model can be constructed based on a linear regression of SNR, since SNR is known to correlate well with acceptability scores and is a quantity which is fundamental to the sound zoning problem. The correlation between SNR and subject scores was R=0.91 and $R^2$=0.83. Training a linear regression model to SNR based on the 200 trials in the acceptability experiment produces the model:

$$A_p=(0.0264\times SNR)-0.0492 \quad (8.5)$$

Where $A_p$ is the predicted acceptability. The predicted acceptability scores have RMSE=15.97% and RMSE*=9.45%. It is worth noting that 34 of the 200 predictions fall outside the range $0<A_p<L$.

Cross Validation

Figure 3:
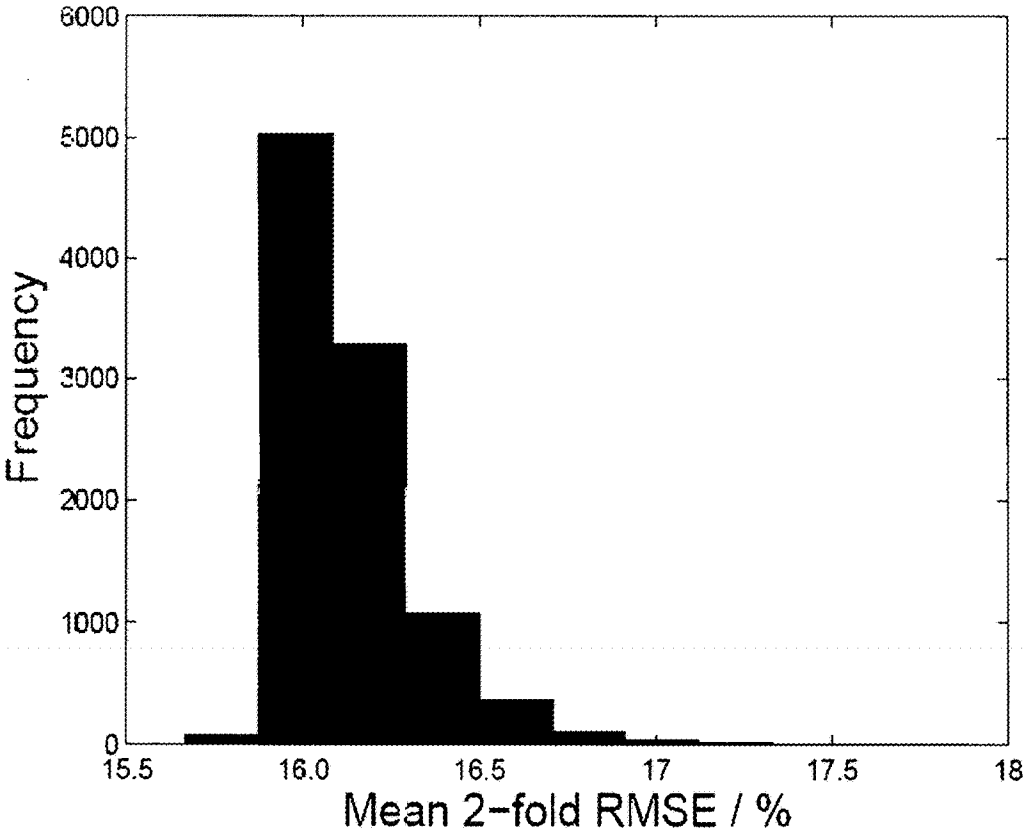
FIG. 3 illustrates a histogram showing the distribution of mean RMSEs produced by the ten thousand 2-fold models.

Ten thousand 2-fold models were produced and the mean RMSE was 16.22%. The standard deviation of the RMSEs was 0.2%, although a histogram shows that the scores were skewed towards lower RMSEs (see FIG. 3). The skew occurs because on some repeats many of the data points least well predicted by SNR are clustered into the same fold, whilst in most repeats the less well predicted data points are more evenly split between the folds. Because of the skewed distribution, the standard deviation describes a slight over-estimate of the variation across the repeats.

The cross validation shows that, as expected, the simple benchmark model which utilises only SNR generalises well to new stimuli.

Validation

The benchmark model was used to produce predictions for validation 1. The predictions had correlation R=0.7839 and $R^2$=0.6145 with RMSE=19.95% and RMSE*=6.55%. FIG. 4A shows the model predictions and acceptability scores.

Since there were only seven listeners the mean acceptability scores are coarse (8 steps spaced by 12.5%); as a result the model is likely to be more accurate than indicated by the correlation and error statistics given. The speech intelligibility listening test, from which the validation 1 data set was derived, featured 'repeat' trials, across which the target sentence differed but all other characteristics (e.g. SNR, target speaker, interferer programme) were identical. By averaging across these trials the number of data points may be halved, as is the spacing between mean acceptability scores. It should be noted that this approximation, while increasing the resolution of mean acceptability scores, does not increase the number of listeners (although the number of judgements per mean acceptability score is doubled).

The benchmark model predictions were repeated for the mean acceptability scores averaged across subjects and repeats. FIG. 4B shows the model predictions and acceptability scores for these cases. These predictions had correlation R=0.8634 and $R^2$=0.7455, with RMSE=16.69% and RMSE*=5.20%. The improved correlation and reduced error imply that the large steps in the mean acceptability scores are at least partially responsible for the reduced correlation and increased error obtained before averaging.

The RMSE (16.69%) was very similar to that obtained in the cross-validation (16.22%), implying that this model is stable and robust to new stimuli with only a small decrease in accuracy compared with the training data (15.97%).

The benchmark model was subsequently used to produce predictions of acceptability for validation 2. The predictions had correlation R=0.1268% and $R^2$=0.0161%, with RMSE=21.56% and RMSE*=10.9%. FIG. 5 shows the model predictions and acceptability scores. When the data point identified as likely to be an outlier, is excluded the predictions for the remaining 23 data points have R=0.3485 and $R^2$=0.1215%, with RMSE=17.32% and RMSE*=6.44%.

Since the SNR was dictated by the sound zoning method for validation 2 the range of SNRs was much smaller than in the training data set. The SNRs ranged from 2.7 to 18.7 dB with a mean of 11.4 and a standard deviation of 4.9, whereas the training data set had SNRs ranging between 0 and 45 dB with a mean of 22.7 and a standard deviation of 13.2. Since the range of SNRs was relatively small for the validation experiment, it is likely that listeners weighted other characteristics of the listening scenario as being more important to their judgement of acceptability than in the training set. It is also possible that the impression of spatial separation, or new artefacts introduced by the sound zoning method, are partly responsible for the poor validation.

Summary

In summary, therefore, the benchmark model based on SNR performs well with correlation R=0.91 and RMSE=16% for training and cross-validation. For validation 1 the performance was very similar with R=0.86 and RMSE=16.6% for data averaged across subjects and repeats. For validation 2, however, the correlation was small to moderate (R=0.35) and the RMSE was reduced to 17% (with one outlier excluded). These scores imply that the model generalises very well to new stimuli, but rather less well to the listening scenario featuring the sound zoning method.

As previously stated, the benchmark model is unable to distinguish between sound zoning systems and programme items which result in identical SNRs. More complex models of acceptability would need to exceed the accuracy of this model, and match the robustness in cross-validation and validation, in order to be considered superior.

Constructing the Model

A series of models were constructed using the procedure and features described above. FIG. 6 shows the accuracy and generalisability of the models produced in each step compared with the benchmark model above. From steps 2 until 15 the RMSE, RMSE*, and 2-fold RMSE are lower for the constructed acceptability model than for the benchmark model.

Generally when adding more features, if the RMSEs and RMSE*s decrease while a cross-validation metric (such as the 2-fold SNR) increases this is a good indication that further improvements in accuracy to the prediction of the training data are simply over-fitting (and should therefore not be considered generalisable). In this case, the 2-fold RMSE increases from 14.06% on step 8, to 14.07% on step 9, however the 2-fold RMSE subsequently continues falling after this on every step. This, alone, is therefore insufficient to exclude any of the models. An investigation into the features selected is therefore worthwhile.

The table illustrated in FIG. 7 shows the selected features, their ascribed coefficients, and the calculated VIF for steps 1-3. On step 2 the highest VIF is 2.61, whereas on step 3 the highest VIF is 29.71, one order of magnitude greater. The reason for the sudden increase in multicollinearity seems to be due to the inclusion of the DivBadFrameMixI9 (NO) feature, which correlates very well with the already included DivBadFrameMixT8 (NO) feature (R=0.97). This is unsurprising because one feature describes the proportion of time-frequency units in which the target programme accounts for more than 80% of the intensity, whereas the other feature does the same but for the interferer programme and with the threshold set at 90%. Considerable overlap would therefore be expected. This, in itself, may not be sufficient grounds for the exclusion of the model (or either feature), however since the coefficients of the two features are both positive (yet describe opposed phenomena) it is reasonable to suggest that the model is an overfit to the data.

The model produced in step 2 was therefore selected as a candidate model since it was prior to any coefficient reversals and prior to inflated VIFs, as well as being prior to a divergence between RMSE and 2-fold RMSE. The model features include:

1. $x_1$: DivBadFrameMixT8 (NO), and
2. $x_2$: IStdLev (NO)

As discussed above, the first of these features describes the proportion of time-frequency units in the internal representation of the mixed programmes can said to be accounted for by more than 80% by the equivalent time-frequency unit in the internal representation of the target programme. Specifically, this was for internal representations with no time frame overlaps, with time-frequency units calculated as samples by frequency bins. The second feature represents the standard deviation of the intensity of the internal representation of the interferer programme, averaged across frequency; thus this feature describes the constancy of the overall level of the interferer programme over all samples. The positive coefficient for the first feature, and the negative coefficient for the second feature indicate that as more of the mixture can be accounted for by the target programme, and as the interferer level varies less over time, the likelihood that the listening scenario will be considered acceptable increases.

The correlation between the training acceptability data and the DivBadFrameMixT8 feature for these programmes was R=0.8952. For the IStdLev (NO) the correlation was R=0.8357. Scatter plots of the feature values and the training acceptability data are presented in FIG. 8A-FIG. 8B. The linear regression model for the raw (without normalising) features is given by the equation:

$$A_p=1.7565x_1-0.0002x_2-0.3477. \quad (8.6)$$

Validation

The model was used to produce predictions for validation 1. The predictions had correlation R=0.7584 and R=0.5752, with RMSE=23.80% and RMSE*=8.94%. As before the data were averaged across repeats and predictions were made for these new data. The predictions had correlation R=0.8420 and $R^2$=0.7090, with RMSE=20.89% and RMSE*=8.43%. All of these metrics of model accuracy were poorer than those of the benchmark model, which had R=0.8634, with RMSE=19.95% and RMSE*=5.20% for the averaged data. The original and average predictions are shown in FIG. 9A-FIG. 9B.

The model was subsequently used to produce predictions of acceptability for validation 2. The predictions had correlation R=0.0333 and $R^2$=0.0011, with RMSE=83.85% and RMSE*=64.81%. These predictions were extremely poor because all predicted values were below 0. The correlation, however, was also very low and this seems to be due to the poor correlation between the IStdLev (NO) features and the validation 2 acceptability scores of R=−0.0091. By contrast, the DivBadFrameMixT8 feature had a small to moderate positive correlation with acceptability scores of R=3997.

Summary

A stepwise regression method was utilised to identify 18 possible models for predicting acceptability, each producing greater accuracy on the training data. The multicollinearity, coefficients, and features were carefully examined and there was good evidence to exclude models 3-18. Model 2 was therefore selected for validation testing because it did not include features describing similar phenomena with opposed coefficients. The model performance exceeded the accuracy of the benchmark model for the training and cross-validation data, but generally performed poorer than the benchmark model for the two validation data sets.

The good cross-validation performance, and the reasonably high correlation with validation 1 indicate that the features may be useful to include in a more extensive model.

A Search for Further Features

In the previous section the construction of a model was described using features derived from the CASP model. While it is clear that some of these features offer promising initial results, it is also clear that these features alone were not able to produce a model superior to the benchmark linear regression to SNR. In this section a range of additional non-CASP based features are introduced to the feature pool and the model training procedure is repeated to see if more accurate and robust predictions are possible.

Features

In addition to the previously discussed CASP based features, a further set of features was produced by considering the level, loudness, and spectra of the programmes (without any auditory processing). This section gives an overview of these additional features.

Level and Loudness Based Features

A range of features were calculated to describe the level of the stimuli. Simplistic features based on the RMS level of the items were obtained including the target level (RMS-TarLev), the interferer level (RMS-IntLev), and the SNR (RMS-SNR). In addition to these, a range of features were produced describing the proportion of the stimuli for which the SNR fell below a fixed threshold. These were calculated by dividing the programmes into 50 ms frames, and calculating the RMS SNR for each frame. The features were then taken as the proportion of frames in which the SNR did not exceed a fixed threshold. Thresholds ranged from 0 dB to 28 dB in steps of 2 dB. These features therefore incorporate some time-varying information, and since they describe the proportion of frames which had a poor SNR, were referred to as RMS-BadFrame0, RMS-BadFrame2, . . . RMS-BadFrame28.

It was considered possible that psychoacoustically based loudness features might perform better than standard measures of level. For this reason a range of features were obtained using the loudness model in the Genesis toolkit. These included TLoud, the loudness level exceeded during 30 ms of the signal (the default duration), TLoud50, the loudness level exceeded during 50 percent of the signal, TMax, the maximum instantaneous loudness of the target, and the equivalent features for the interferer (ILoud, ILoud50, and IMax). In addition to these, the loudness ratio LoudRat (TLoud−ILoud), the peak loudness ratio LoudPeakRat (TMax−IMax), and the peak to loudness target and interferer ratios TMaxRat and IMaxRat (TMax−TLoud, and IMax−ILoud), were calculated.

A further 28 level and loudness based features were therefore added to the total feature pool.

Spectral Centroid Features

It was also considered likely that the relative frequency spectra of the stimuli would be relevant to the acceptability. In line with this, subjects had occasionally commented that higher frequency interference was especially problematic. The mean and standard deviation of the spectral centroid for each stimulus was therefore calculated using Matlab code. By default, a vector of spectral centroids is produced based on frames of 2048 samples (4.6 ms at 44100 Hz) with 80% overlap. The means and standard deviations of these were taken to be used for the features TSpecMean, ISpecMean, TSpecStd, ISpecStd, as well as the Euclidian distances of these quantities SpecMean (TSpecMean−ISpecMean), and SpecStd (TSpecStd−ISpecStd). A further 6 features were therefore added to the pool.

Manual Features

Although in principle all features can be derived from the stimuli directly, in practice the acquisition of some 'higher level' (i.e. cognitive) features from the stimuli are very difficult problems which represent fields of study in their own right. Instead, such high level features can be produced by a human listener identifying the relevant traits.

In this work, three such features were directly coded by the author based on auditioning the stimuli. Since during experiments, subjects commented that speech is a more problematic interferer than music when the target programme is also speech, it was deemed worthwhile to obtain features describing this aspect of the target and interferer programmes. No computational models are known to the author capable of accurately detecting whether an arbitrary audio sample contains speech, whereas humans are adept at this process. The task is somewhat complicated by defining the boundaries of the feature (e.g. do musical vocals count as speech?). Three manual features were therefore coded to describe the extent to which a target or interferer programme is 'speech-like'. These were: ManSpeech, ManSpeechOnly, and ManInst. The first feature was coded as a 1 when the interferer contained speech (excluding musical vocals), and 0 otherwise, the second feature was coded as a 1 when the interferer contained only speech (e.g. with no background music), and 0 otherwise, and the third feature was coded as a 1 when the interferer contained only instrumental music (i.e. did not contain any linguistic content), and 0 otherwise.

The correlation between the mean acceptability scores and the manually coded features were R=0.0048, R=0.0099 and R=0.0057 respectively. The correlations were very low, and so these features are unlikely to be very important for predicting acceptability. Nonetheless, subjects occasionally reported that interfering speech was more problematic than interfering music, so it is possible that a covariate exists which predicts acceptability well yet occurs more commonly with speech interferers than with musical interferers (e.g. high frequency content or temporal sparsity). Three manually encoded features were therefore included in the feature pool.

Summary

A further 37 features were therefore collected describing the level, loudness, and spectra of the stimuli, as well as accounting for subjective comments about speech-speech interactions. These were added to the CASP based features producing a total feature pool of size 235.

Constructing the Model

Again, a series of models were constructed using the procedure described in section 8.2.2, and the features described above. FIG. 10 shows the accuracy and generalisability of the models produced in each step compared with the benchmark model discussed above. This time all steps had lower RMSE, RMSE*, and 2-fold RMSE than the benchmark model. For this new set of models, the cross validation error increased from 13.00% on step 7 to 13.03% on step 8. The table illustrated in FIG. 11 shows the selected features, their ascribed coefficients, and the calculated VIF for each of the first 7 steps. On step 6, the highest VIF is 5.65 whereas on step 6 the highest VIF is 17.83: more than three times as high. On step 7 the DivBadFrameMixT7 feature is included, which is very similar to the DivBadFrameMixT9 feature already included. While similar features may itself not be reason for exclusion, the coefficients of these two features have opposed signs, and thus step 6 is a more appropriate choice of model. On step 5 the IStdLev feature is included, when on step 2 the IStdLev (NO) feature was already introduced. These two features describe the standard deviation of interferer intensity across 400 ms frames and across samples respectively. Though the features seem similar, the change in time frame over which they operate constitutes an important difference between them. For the training data, these features had only a weak positive correlation of R=0.3410. Furthermore, the coefficients for the normalised features are not opposed, so there is no strong evidence to suggest that the introduction of the IStdLev (NO) feature is an overfit to the training data). The correlation between the training acceptability data and the first three features selected, RMS-BadFrame18, IStdLev (NO), and DivBadFrameMixT9, was very high with R=−0.9252, R=−0.8366, and R=0.8065 respectively. The remaining three features, TSpecMean, IStdLev, and TMaxSpec, had lower correlations with R=0.1570, R=0.1683, and R=0.2669 respectively.

The model features therefore include:

1. $x_1$: RMS-BadFrame18,
2. $x_2$: IStdLev (NO),
3. $x_3$: DivBadFrameMixT9,
4. $x_4$: TSpecMean,
5. $x_5$: IStdLev, and
6. $x_6$: TMaxSpec RMS-BadFrame18 indicates the proportion of 50 ms frames within which the SNR of the target and interferer programme was less than 18 dB. IStdLev (NO) and IStdLev indicate the standard deviation of the intensity of the internal representation of the interferer across samples and frames respectively. DivBadFrameMixT9 indicates the proportion of the time-frequency units in the internal representation of the mixture programme of which at least 90% of the intensity can be accounted for by the equivalent time-frequency units in the internal representation of the target programme. TSpecMean indicates the mean spectral centroid of the target programme. Finally, TMaxSpec indicates the maximum intensity of the target programme in any frequency bin across 400 ms frames.

The linear regression model for the raw (without normalising) features is given by the equation:

$$A_p=-(6.13\times10^{-1}x_1)-(5.84\times10^{-5}x_2)+(4.55\times10^{-1}x_3)+(6.86\times10^{-4}x_4)-(1.53\times10^{-8}x_5)-(9.61\times10^{-9}x_6)+9.57\times10^{-1}. \quad (8.7)$$

The model predicts the training data with R=0.9505 and $R^2$=0.9035, with RMSE=12.09% and RMSE*=5.65%. The mean 2-fold RMSE was 13.03%. For all of these metrics, this model was more accurate than the benchmark model.

Validation

The model was used to produce predictions for validation 1. The predictions had correlation R=0.7785 and $R^2$=0.6061, with RMSE=17.02% and RMSE*=8.93%. As before the data was averaged across repeats and predictions were made for these new data. The predictions had correlation R=85.64 and $R^2$=0.7335, with RMSE=13.09% and RMSE* 5.94%. In comparison with the benchmark model, the RMSEs for the original (19.95%) and averaged (16.69%) data were lower, yet the RMSE*s for the original (6.55%) and averaged (5.20%) data were slightly higher. Correlations for the original (0.7839) and averaged (0.8634) data were slightly lower than the benchmark as well. The original and average predictions are shown in FIG. 12A-FIG. 12B.

The model was subsequently used to produce predictions of acceptability for validation 2. The predictions had correlation R=0.4294 and $R^2$=0.1844, with RMSE=27.55% and RMSE* 11.52%. While the correlation and accuracy are fairly poor here, the correlation is nonetheless much higher than the benchmark model which had R=0.1268 and $R^2$=0.0161. indicating that some of the features are likely to be generalisable. FIG. 13 shows the predictions for validation 2.

Summary

A stepwise regression method was utilised to identify 8 possible models for predicting acceptability, each producing greater accuracy on the training data. The multicollinearity, coefficients, and features were carefully examined and there was good evidence to exclude models 6-8. Model 5 was therefore selected for validation testing. The model performance exceeded the accuracy of the benchmark model for the training and cross-validation data. For validation 1, the correlations and RMSE*s were slightly poorer, although the RMSE was improved. For validation 2, the performance was greatly improved over the benchmark model.

While the model did not produce more accurate scores for every metric on every data set, it did produce some more accurate scores on all data sets, and large improvements for validation 2 (the data set including a sound zoning method). It seems, therefore, that this extended model is more generalisable than the simpler SNR based benchmark model.

Including PEASS

PEASS (Emiya et al. 2011) is a toolkit for analysing source separation algorithms. The source separation problem, which entails separating two streams of audio which have been mixed together, can be considered to be a similar problem to the sound zoning problem. The PEASS toolkit, which may be used to evaluate the overall perceptual quality of separated audio after running a source separation algorithm, is therefore a potentially useful approach to evaluating the effectives of a sound zoning system which, rather than separating two streams of audio, aims to keep two streams of audio from mixing.

In contrast, however, it is worth noting that the types of artefacts introduced by a sound zoning system may be quite different from those introduced by source separation methods. For example, the so called 'musical noise' that is introduced by separating via an ideal binary mask is not introduced by any of the more prominent sound zoning methods.

Despite the differences between the source separation and the sound zoning problems, it may be useful to include features based on PEASS. The PEASS model produces four outputs: the Interferer Perceptual Score (IPS), the Overall Perceptual Score (OPS), the Artefact Perceptual Score (APS), and the Target Perceptual Score (TPS). These four features were added to the previous pool of features, resulting in a feature pool of 239 features describing aspects of the stimuli, their relation to one another, subjective comments, and the internal representations of the stimuli.

Constructing the Model

Once again the method outlined above was used to construct models of acceptability, this time including all features discussed thus far. FIG. 14 shows the accuracy and generalisability of the models produced in each step compared with the benchmark model discussed above. For all steps the RMSE, RMSE*, and 2-fold RMSE are lower for the constructed acceptability model than for the benchmark model with one exception: the 2-fold RMSE for step eight was 385.27% (and therefore could not fit on the plot within a reasonable scale). The 2-fold RMSE increased from 11.93% in step 5 to 11.94% in step 6, and then fell to 11.81% in step 7 before rising steeply to 385.27% in step 8. Step 5 therefore seems to be an initially appropriate model to select pending further examination of the selected features, their multicollinearity, and the feature weightings.

The table illustrated in FIG. 15 shows the selected features, their ascribed coefficients, and the calculated VIF for each step for steps 1-6. Prior to step 6 all VIFs remain below 6, but on step 6 the VIFs for two of the features exceed 70. The very high multicollinearity is explained by noting that these two features were describing the proportion of time frames with SNRs under 18 and 20 dB respectively. These two features are assigned coefficients with opposing signs, and so it seems likely that from step 6 onwards the regression is over fitting to the training data.

It is also worth noting that there is a small jump in VIF from step one to step two, and it seems likely that the RMS-BadFrame18 and PEASS-Overall Perceptual Score (PEASS-OPS) features may be describing similar phenomena. PEASS-OPS is primarily determined by the cross-correlation between a reference and degraded signal which, in this context, are equivalent to the target and mixture programmes respectively. RMS-BadFrame18, on the other hand, is determined by the time-varying SNR of the target and interferer programmes. For the training data the correlation between the features is R=0.89. In this case, however, the model coefficients have opposite signs, yet they are also describing related phenomena in the opposite manner (i.e. the Bad Frame feature describes the proportion of frames which fails to exceed a particular SNR). For this reason, therefore, it is not clear that the features are mutually redundant. Given this, the model produced in step 5 was selected as a candidate model. The model is defined as:

1. $x_1$: RMS-BadFrame18
2. $x_2$: PEASS-OPS
3. $x_3$: IStdLev
4. $x_4$: DivBadFrameMixT9
5. $x_5$: MSpecMax The features in this model were selected in the prior models with the exception of PEASS-OPS, the overall preference score of the PEASS model. The linear regression model for the raw (without normalising) features is given by the equation:

$$A_p=-(4.46\times10^{-1}x_1)+(3.52\times10^{-3}x_2)-(2.02\times10^{-8}x_3)+(2.32\times10^{-1}x_4)-(1.01\times10^{-8}x_5)+0.82. \quad (8.8)$$

The model predictions had accuracy with R=0.9583 and $R^2$=0.9183, with RMSE=11.09% and RMSE*=4.99%. the mean 2-fold RMSE was 11.93%. As with the previous models, on these metrics the model exceeds the accuracy of the benchmark model.

Validation

The model was used to produce predictions for validation 1. The predictions had correlation R=0.7678 and $R^2$=0.5894, with RMSE 17.47% and RMSE*=8.14%. As before the data was averaged across repeats and predictions were made for these new data. The predictions had correlation R=0.8462 and $R^2$=0.7161, with RMSE=13.56% and RMSE*=5.69%. In comparison with the benchmark model, the RMSE for the original (19.95%) and averaged (16.69%) data were lower, and the RMSE* for the averaged data (5.20%) and the original data (6.55%) were slightly higher. The correlations were slightly lower than those of the benchmark model. The original and average predictions are shown in FIG. 16A-FIG 16B.

The model was subsequently used to produce predictions of acceptability for validation 2. The predictions had correlation R=0.5743 and $R^2$=0.3298, with RMSE=17.83% and RMSE*=5.00%. FIG. 17 shows the predictions for validation 2. The RMSE and RMSE* of the predictions was lower than the benchmark model. The correlation scores were also much higher than benchmark model.

Summary

A stepwise regression method was utilised to identify eight possible models for predicting acceptability, each producing greater accuracy on the training data. The multicollinearity, coefficients, and features were carefully examined and there was good evidence to exclude models 6-8. The accuracy of model five was examined on the training, cross-validation, and validation data sets. In most cases the model had greater accuracy than the benchmark model, and where it did not the accuracy was approximately equal.

The feature selected in step one was RMS-BadFrame18. The second feature selected was PEASS-OPS. The multicolinearity between these scores was VIF=4.796. For only two features this is relatively high. It may be that, if only one of these features is included a better solution may exist among the array of features.

SNR Based Hierarchy and Model Adjustments

Upon observing the scatter plot of acceptability scores against SNRs, it may be argued that for relatively low SNRs the acceptability scores were generally determined by the SNR and would therefore usually be close to 0, and for relatively high SNRs the acceptability scores were generally determined by the SNR and would therefore usually be close to 1. For cases in between, however, other features played a larger role, and so the variation was greater. Under this hypothesis, a more powerful model architecture could involve first identifying whether the SNR fell below a fixed low threshold, or above a fixed high threshold. If either threshold were exceeded, the acceptability score would be set at 0 or 1 appropriately; where neither threshold is exceeded, other features, selected by a model training procedure, would be used.

This approach was implemented, selecting 12.5 and 29 dB SNR as the low and high thresholds respectively. These were selected since acceptability scores in the training data below 12.5 dB SNR never exceeded 0.2, and acceptability scores in the training data above 29 dB SNR never fell below 0.7. Upon constructing a model using the previously discussed procedure training on the middle 76 data points, the first two selected features were DivBadFrameMixI0 (NO) and IStdLev (NO); features describing very similar phenomena to those selected in the previous models. The correlation with the training data for all steps of the model construction procedure fell below R=0.91 (the benchmark correlation), and so this approach was not developed further. Although this modelling approach did not produce a more successful acceptability model, it does highlight a small improvement which can be made to the previous acceptability models. Since the previous three acceptability models were constructed using multiple linear regression, it is possible to produce predictions of acceptability which exceed 1 or fall below 0. Such predictions are not meaningful because an acceptability score of 1 indicates a probability of 100% that a listener selected at random will find the listening scenario to be acceptable, and an acceptability score of 0 indicates a probability of 0%. Acceptability predictions can therefore be improved, and meaningless results avoided, if predictions exceeding 1 are set to 1, and predictions below 0 are set to 0. Expressed mathematically this is:

$$A'_p = \begin{cases} 1 & A_p > 1 \\ A_p & 0 < A_p < 1 \\ 0 & A_p < 0 \end{cases} \tag{8.9}$$

where $A_p$ and $A'_p$ represent the acceptability prediction and adjusted acceptability prediction respectively. This modification would not be likely to make large differences to the accuracy of well-trained models, however the modification is worth implementing for the sake of more meaningful results in practical applications.

For the CASP-based model, this modification reduced the prediction error on the training data from RMSE=15.03% to 14.16% and RMSE*=8.91% to 8.19%, while increasing the correlation from R=0.9208 to 0.9321. For validation 1 the prediction error reduced from RMSE=23.80% to 22.27% and from RMSE*=8.94% to 8.42%, yet the correlation slightly reduced from R=0.7584 to 0.7546. When averaged across repeats the error reduced from RMSE=20.89% to 19.19% and from RMSE*=8.43% to 7.27%, while again decreasing the correlation from R=0.8420 to 0.8377. These decreases in correlation reflect the reduction in linearity of correlation between predictions and observations which are caused by bounding the predictions at 0 and 1, even though this reduces the prediction error. For validation 2 the prediction error reduced substantially from RMSE=83.85% to 35.36% and from RMSE*=64.81% to 18.51%, however since the unmodified predictions were all negative values these metrics describe the accuracy of predicting 0 acceptability in all cases.

For the extended acceptability model, this modification reduced the prediction error on the training data from RMSE=12.09% to 11.75% and from RMSE*=5.65% to 5.36%, while increasing the correlation from R=0.9505 to 0.9536. For both validation data sets none of the predictions exceeded 1 or fell below 0 therefore these scores were unaffected.

In the case of the PEASS-based acceptability model, the modification reduced the error of the predictions for the training data from RMSE=11.09% to 11.05% and from RMSE*=4.99% to 4.96%, and increased the correlation from R=0.9583 to 0.9587. The difference in model accuracy is so small because only 13 of the 200 predictions exceeded 1 or fell below 0, and all of these fell within the range 0.05599 and 1.0433. Since for the PEASS-based acceptability model for both validation data sets the predictions did not included any values exceeding 1 or below 0 these scores were unaffected. Since the latter two models performed reasonably well for all data sets, the effect of this modification to predictions was very small.

Model Selection

The table illustrated in FIG. 18 shows a comparison of metrics for the benchmark model with the three models produced, including the model adjustments described in section 8.5. All three models performed better than the benchmark on the training data and cross-validation. The importance of this result should be considered, however, noting that a better model "t is often possible when more features are available, even if the features are not the best possible features with which to build a model. Generally speaking, however, when multiple poorly selected features are used in regression the accuracy of the cross-validation will be low. For validation 1, the CASP based model performed poorly, failing to surpass the accuracy of the benchmark model in terms either of correlation or error. The other two models, however, performed similarly to the benchmark, with superior RMSEs, yet with marginally inferior RMSE*s and correlations. This trend was consistent regardless of whether the data was averaged across repeats.

For validation 2, the CASP based model again performed poorer than the benchmark. The extended model represented a large improvement over the CASP based model, and the predictions had much better correlation with the data than the benchmark predictions. The RMSE was higher than the benchmark, however, because the predictions ranged from −0.1 to 0.3; this can be explained by a linear offset caused by only a partial agreement between feature weights in the training and validation data sets. The PEASS based model performed markedly better on all metrics than the benchmark, and had improved scores compared with the extended model as well.

The PEASS based model had the best overall performance, although its performance only exceeded the extended model for the validation 2 data set. This indicates that the sound zone processing was better accounted for when using the PEASS based model. For the validation 1 data set, none of the models performed substantially better than benchmark SNR based model. The benchmark model predictions for the validation 2 data were very poor. The PEASS based model is therefore selected as the best combination of accuracy and generalisability.

Model Comparison

It is worth comparing the model with existing computational models which might be brought to bear on the problem. The two most likely groups of models to apply are those which assess speech quality, and those which assess source separation. The PEASS model, which has already been considered as a useful resource from which to draw features, offers the OPS metric which can be considered a reasonable prediction from a source separation model. For speech quality models, Perceptual Evaluation of Sound Quality (PESQ) is the most likely choice although it is worth considering the more recent Perceptual Objective Listening Quality Assessment (POLQA) (which assesses audio quality, rather than simply speech quality) as well.

PEASS Comparison

The PEASS OPS scores correlated with the training data with R=0.91.36. By way of contrast the extended and PEASS based models had correlation R=0.95 and R=0.96 respectively. For validation 1, the OPS had correlation R=0.6814, whereas the extended and PEASS based models had correlation R=0.78 and R=0.77 respectively. When the data was average across repeats the OPS correlation increased to R=0.7597, whereas the extended and PEASS based models had correlation R=0.86 and R=0.85 respectively. Finally, for validation 2, the OPS had correlation R=0.5462, whereas the extended and PEASS based models had correlation R=0.45 and R=0.57 respectively. The PEASS OPS performed poorer than the extended model on all but the validation 2 data set, and performed poorer than the PEASS based model on all data sets. The prediction of acceptability, therefore, benefits from including OPS as a feature, but can be made far more accurate and generalisable by the inclusion of the other features discussed.

PESQ and POLQA Comparison

The PESQ and POLQA models were utilised to make predictions about the acceptability data sets via the PEXQ audio quality suite of tools provided by Opticom. The accuracy of the predictions are shown in the table illustrated in FIG. 19.

For the training data, the extended and PEASS based acceptability models had better correlation than the PESQ and POLQA model predictions. The OPS metric alone had slightly higher correlation than the POLQA predictions, but lower correlation than the PESQ scores.

For validation 1, the extended and PEASS based models again had higher correlation than the PESQ and POLQA model predictions. When the data were averaged across repeats the PESQ and POLQA correlations increased to R=0.83 and R=0.84; these relationships are shown in FIG. 20A-FIG. 20B. The averaged extended and PEASS based models still had higher correlations however. For these data the OPS did not correlate as well with the mean acceptability scores as either the PESQ or POLQA scores.

FIG. 20A-FIG. 20B shows an apparent outlier in both the PESQ and POLQA predictions, where for an acceptability score of 1 the predictions are only 2.4 and 3.8 respectively. These scores refer to the same trial. Since the data shown are based on averaged scores, it is first worth noting that the outlier is not due to an averaging of disparate scores; the PESQ predictions for the two trials were 2.25 and 2.51 individually. With further inspection, however, one can see that the same outlier exists for the trained acceptability models and can be seen in FIG. 20B. Since these two trials, upon auditioning, do not appear to differ drastically from the pairs of trails with similar SNRs, it seems that this outlier is a case of listener inconsistency. Finally, for validation 2, the PESQ and POLQA scores had very poor correlations with R=−0.2808 and R=−0.1704 respectively. Here the extended and PEASS based models had correlation R=0.45 and R=0.57, and the OPS had correlation R=0.55.

Since PESQ performed better than POLQA on the training data, and POLQA performed better than PESQ on validation 1, and since both performed very poorly on validation 2, neither model is clearly more appropriate for use in the prediction of acceptability. The OPS scores did not correlate consistently higher than either model, yet they correlated well with validation 2 and so represent a more generaliseable measure than either PESQ or POLQA. In all but one case, the predictions of the extended acceptability model correlated with the acceptability scores better than PESQ, POLQA, and OPS. If OPS is included in the feature training, however, the PEASS-based acceptability model can be constructed which outperforms all the other predictors for all data sets. Thus the PEASS-based acceptability model had the greatest accuracy and generalisability of all the models tested.

Summary and Conclusion

This chapter began by posing the question 'How can the acceptability of auditory interference scenarios featuring a speech target be predicted?'. To answer this question several models of acceptability were constructed. In doing so, training and validation data sets were prepared, an objective method for constructing models of acceptability was detailed, and a benchmark model based on a linear regression to SNR was established. An initial model was constructed by selecting features from a large pool produced by analysing internal representations produced by processing the target, interferer, and mixture through the CASP model. The acceptability models were compared with the benchmark model and all models exceeded the accuracy of the benchmark for the training data. Over a range of validation data the extended model had equal or better correlation with acceptability scores than the benchmark predictions, although the error was higher in some cases. The PEASS based model, however, performed similar to or better than the benchmark in all cases, and was therefore selected as the most accurate and robust of the produced models.

A small adjustment was introduced to all of the models. Since all of the models are based on linear regressions, it is possible for the predicted acceptability scores to exceed 1 or fall below 0, yet such predictions are not meaningful. In such cases, therefore, predictions are capped at 1 or 0.

Finally, the produced model was compared with existing state of the art models of audio and speech quality (POLQA and PESQ), and with the overall preference score produced by the source separation toolkit PEASS. Between PESQ, POLQA, and PEASS a best model could not be easily selected; when sound zone processing was applied the PESQ and POLQA models performed very poorly, for the training data PESQ performed very well, whereas for the validation 1 data set POLQA performed best. In all cases the PEASS-based acceptability model produced predictions with greater correlation to the mean acceptability scores than any of these existing models.

With a model for the prediction of the acceptability of speech in auditory interference scenarios established, it remains only to piece together this work with the models described in the previous chapters to produce an overall strategy for the prediction of acceptability. In the next chapter this is discussed, along with example applications and notes for practical implementation.

Distraction Modelling

This chapter relates to the determination of a predictive model of the subjective response of a listener to interference in an audio-on-audio interference situation.

In this chapter, the creation of a model is described, in order to answer the remaining two research questions:

What are the most perceptually important physical parameters that affect distraction in a sound zone?

What is the relationship between distraction and the relevant physical parameters?

In a first section, a specification of criteria that the model should adhere to is outlined; such a criteria is necessary as the potential range of audio-on-audio interference situations is limitless, therefore it is necessary to specify boundaries on the application area of the model. In a next section, the design of a listening test in order to collect subjective ratings on which to train the model is outlined, including collecting of a large stimulus set intended to cover the perceptual range of potential audio-on-audio interference situations adhering to the model specification. In a following section, the subjective results of the experiment are summarised. In a subsequent section, the audio feature extraction process is detailed, followed by the training and evaluation of a number of perceptual models in the next section. The final model is detailed in the last section, providing an answer to the research questions stated above.

Model Specification

Creating a model of the perceptual experience of a listener in an audio-on-audio interference scenario is a potentially limitless task when considering the vast range of audio programmes that may be replayed in a personal sound zone system, the potential application areas of such systems, and the range of listeners. It is therefore necessary to imply constraints to the application area of the model in order to design a suitable and feasible data collection methodology. The following considerations are intended to specify the application areas and performance of the model. The perceptual model should:

be applicable a to wide range of music target and interferer programmes, i.e. any audio programme that may be listening to for entertainment purposes in domestic or automotive spaces;

be applicable to situations where the listener is listening to the target programme for entertainment purposes in a domestic or automotive environment:

the target programme should be presented from 0 degrees;

the interferer programme may come from any location;

be applicable to audio-on-audio interference situations that have arisen with or without sound zone processing1; and generalise well to new stimuli, i.e. those outside of the set on which the model is trained.

The subjective experiment described in the following sections was designed to collect data suitable for training a model to fit the above specification.

Training Set Data Collection Experiment

The following sections outline the procedure for collection of subjective data on which to train the proposed distraction model.

A significant weakness of the preliminary distraction model was its lack of generalisability to new stimuli. This was attributed to the relatively small training set, but also the fact that due to the full factorial combinations used to train the model, the number of audio programmes used to create the 54 combinations was in fact only three target and three interferer programmes. Three target programmes (made up of one pop music item, one classical music item, and one speech item) is evidently far too few to try to represent the full range of potential music items; there are wide varieties between musical items even within the same genre. The small number of target and interferer programmes also mean that features extracted from the individual target or interferer programmes (as opposed to the combined target and interferer) act as classifiers rather than continuous features, diminishing their utility in a linear regression model.

It was also felt that using full factorial combinations in which the same target and interferer programme items were used multiple times with other factors varied (such as interferer level, location etc.) could potentially bias subjects by making the distinction between the factor levels obvious and creating artificially large differences in ratings based on these factors, potentially inflating the importance of the factors. For example, when the target programme was held constant for each item on a test page, three of the stimuli under test featured the same target and interferer combination with the only difference being the interferer level, potentially inflating the importance of this factor.

Therefore, it was desired to vastly increase the number of programme items. However, this had to be achieved whilst maintaining a feasible experiment design. To avoid the two problems highlighted above, a large pool of programme items was collected, and the items were not repeated at different factor levels. Rather, the factor levels were varied randomly over the programme items. This method vastly increases the number of different programme items for which ratings can be collected in a reasonable time frame, whilst reducing the chance of biasing listeners towards particular independent variables. However, this comes at the cost of reduced potential for analysis of the importance of the experimental factors in the resulting dataset through methods that assume a full factorial design (such as ANOVA) as the experimental factors are confounded with the programme material. This was felt to be a reasonable trade-off as the primary reason for collecting the data set was the training of regression models for which a separate, non-factorial feature set is extracted from the stimuli.

In order to select the pool of programme material items, a random sampling procedure was designed; this is described below. The length of each stimulus was reduced from previous experiments in order to reduce variability over the stimulus duration and make the rating task simpler for participants. Through experience conducting various rating experiments, a stimulus duration of 10 seconds was felt to be appropriate. The stimuli were converted to mono by summing the left and right channels.

Audio-on-audio interference situations can occur 'naturally' or 'artificially'. In the artificial case, i.e. with sound zone processing, various artefacts may be introduced into target and/or interferer programmes. Such artefacts may include sound quality degradations, spectral alterations, spatial effects, and temporal smearing. It is desirable for the model to work well for audio-on-audio interference situations including such alterations.

Test Duration and Number of Stimuli

As mentioned above, it was important to balance collection of a large training set of a wide range of programme items with designing a test of a feasible length in order to reduce participant fatigue and boredom. Based on comments from subjects following the multiple stimulus methodology used in other experiments and pilot tests, a number of approximate parameters were determined. It was felt that a single page with between 8 to 10 stimuli was feasible and took participants approximately 5 minutes to perform. A reasonable session length of 45 minutes accommodates nine such pages.

The test was designed with two sessions of eight pages, each containing seven test items and one hidden reference, with one practice page in each session. This gave a total of 112 test stimuli per subject. Twelve of these stimuli were assigned as repeats in order to facilitate assessment of subject consistency, leaving 100 unique stimuli. Creation of 100 stimuli required collection of a pool of 200 programme items (a target and an interferer programme for each stimulus). An additional 16 programme items were required for the hidden references, alongside 30 items for the familiarisation pages, requiring a total collection of 246 programme items.

Collection of Programme Material

In order to produce a selection of stimuli covering a wide range of ecologically valid programme material within the constraints outlined above, a random sampling procedure was designed. Selecting programme material items at random reduces potential biases inherent in manual selection of programme material; if stimuli are included or excluded for any particular reason determined by the experimenter, this may bias the feature selection and modelling towards particular features, increasing the likelihood of overfitting and reducing generalisability of the resultant model.

Radio Stations

In order to select a wide and representative range of audio stimuli, various radio stations were used as the programme material source. The stations were selected from the 20 stations with the largest audience according to the Radio Joint Audience Research (RAJAR) group. The stations playing primarily music content were selected, and these stations were further reduced during a pilot of the sampling procedure in which it was found to be impossible to obtain programme material from a number of stations as they were not available online to 'listen again'. The final stations, detailed in the table illustrated in FIG. 21, exhibit a wide range of different musical styles.

Sampling Times

To further broaden the selection of different programme items samples were taken at different times throughout the day, as the same radio station may play appreciably different music to a different target audience at different times. To produce the 200 stimuli required for the full experiment, the day was split into six periods (12 a.m. to 4 a.m., 4 a.m. to 8 a.m., 8 a.m. to 12 p.m., 12 p.m. to 4 p.m., 4 p.m. to 8 p.m., and 8 p.m. to 12 a.m.), and random times generated (to the nearest second) within each of these periods. With 9 stations and 6 time periods, it was necessary to perform the sampling on 4 days to produce the desired number of items; the random times were different for each day.

As discussed above, the desired application area of the model is music target and interferers. It was therefore necessary to reject non-music items selected using the random sampling procedure. To minimise experimenter bias in terms of the items that were permitted or rejected, only samples that consisted of music for their entire duration were included; interrupted speech, radio announcements, adverts, news, documentaries, and any other sources of non-music content were rejected. It was therefore necessary to perform the sampling across more days; a total of 8 days were required to procure useable programme items at each of the sampling times.

The 16 hidden reference stimuli were obtained from a pilot of the sampling procedure and used a reduced range of stations (1 to 5 from the table illustrated in FIG. 21) as fewer programme items were required. Similarly, the selection of programme items for the familiarisation pages took place on 2 separate days and used radio stations 1 to 6.

Obtaining the Audio

At each sampling point, the audio was obtained using Soundflower to digitally record the output of the online 'listen again' radio players for each of the stations. Where possible, artists and track names were manually identified by listening to the radio announcer, information provided in the web player, or searching based on lyrics in the song. It was not possible to obtain this information for all tracks.

It was considered that by using only audio that had been broadcast over the radio, the specific processing applied (e.g. compression and bit rate reduction) could limit the generalisability of the resulting model. A pilot experiment was performed comparing subjective distraction scores for items obtained using the radio sampling method and the same items recorded from Spotify. No significant differences between ratings were found, but due to obvious differences in the waveform of the recordings (for example, see FIG. 22) and the clear difference in sound between the recordings, it was felt prudent to include both types of stimuli in the full experiment (both are ecologically valid as they represent common methods for listeners to consume audio).

Therefore, 50% of the stimuli were re-recorded from Spotify (Ogg Vorbis lossy bit rate reduction at 320 kb/s). The Spotify stimuli were selected by taking the first 100 items from a randomly ordered list; where the exact recording was not available on Spotify (e.g. live recordings, unique remixes, or different performances of classical works) or it was not possible to identify the track, that programme item was skipped until a total of 100 recordings had been made from Spotify.

Loudness Matching

The stimuli were perceptually loudness matched in the same manner as those in the threshold of acceptability experiment. All stimuli were roughly pre-balanced by ear and replayed through the experiment setup at approximately 66 dB LAeq(10 s). The stimuli were recorded using an omnidirectional mono microphone at the listening position calibrated to 0 dB FS=1 Pa. The recorded files were run through the GENESIS loudness toolbox implementation of Glasberg and Moore's loudness model for time-varying sounds. The files were processed to match maximum long-term loudness (LTL) level, and the new files re-recorded through the playback system. The same procedure was followed again and the gains adjusted accordingly to give files of approximately equal perceptual loudness.

Experimental Factors

As detailed above, the stimuli were not created as a full factorial combination of factor levels. However, the following factors were varied in order to produce a diverse set of stimuli. These factors were selected based on independent variables that had been found to cause significant changes in distraction scores in previous experiments (interferer level) as well as factors that had not been fully investigated but affected perceived distraction in informal listening tests (target level, interferer location).

Target Level

The contribution of target level to perceived distraction has not been fully investigated although it has been found to have a small effect in informal listening tests. In the threshold of acceptability experiment, a replay level of 76 dB $LA_{eq(20s)}$ was set based on reported preferred listening levels in a car with road noise at 60 dB(A). This level was found to be uncomfortably loud given the duration of the listening test, and was reduced to 70 dB $LA_{eq(20s)}$ for the elicitation experiment.

To account for the wide range of preferred listening levels for different situations (including different types of programme materials, listening environments, or background noise levels), listening levels were drawn randomly from a uniform distribution ±10 dB ref. 66 dB $LA_{eq(10s)}$.

Interferer Level

The interferer level has been found to have the most pronounced effect on perceived distraction in all experiments performed as part of this project. As systems that are intended to reduce the level of the interfering audio are of primary concern, the interferer level was constrained to being no higher than the target level. In the threshold of acceptability experiment it was found that 95% of listening situations were acceptable in the entertainment scenario with a target-to-interferer ratio of 40 dB. However, on generating the stimulus combinations, it was found that using 40 dB as the maximum TIR resulted in a large number of situations in which the interferer was inaudible (with target levels as low as 56 dB $LA_{eq(10s)}$, a 40 dB TIR could result in very quiet interferers, increasing the likelihood of total masking). Through trial-and-error, the maximum TIR was set at 25 dB. Consequently, the interferer level was drawn randomly from a uniform distribution between 0 dB ref. target level and −25 dB ref. target level.

Interferer Location

In a sound zone application, the interferer programme could potentially come from any direction. For example, in the automotive environment the layout of the seats makes it likely for the interferer to be located at 0 or 180 degrees (where 0 degrees refers to the on-axis position in front of the listener) whilst in a domestic setting, any angle is possible. Whilst interferer location was found to be the least important factor in the threshold of acceptability experiment, it was felt to be worth investigating the effect of interferer location on perceived distraction. The interferer location was therefore randomly assigned for each stimulus with an equal number of cases replayed from 0, 90, 135, 180, and 315 degrees; these angles were selected to give a reasonable coverage of varying angles in front of and behind the listener and on both sides.

Stimulus Combinations

The target and interferer programmes were randomly selected from the pool of items and factor levels were randomly assigned to the combinations. FIG. 23 shows a scatter plot of target level against interferer level, grouped by interferer location, for the 100 stimuli used in the main experiment. The plot shows that a wide range of points across the whole perceptual range were produced using the random assignment method described above.

Repeats

In order to assess the reliability of subjects, it is desirable to include a number of repeat judgements. Due to the experiment design in which each target and interferer programme was only used once (i.e. not repeated with different factor levels as in previous experiments) it was felt to be less appropriate to include a repeat of every trial, as it would be easier for participants to detect the repeats and give the same judgement based on memory rather than reliability. Therefore, it was felt to be beneficial to reduce the number of repeats in order to reduce the likelihood of two repeat stimuli being presented close to each other in time or of the participants recognising the presence of repeats. Twelve stimuli were selected at random from the pool and used as repeats (the same stimuli were repeated for each participant).

Physical Setup

The setup for the experiment was similar to that used in the threshold of acceptability and elicitation experiments. Five loudspeakers were positioned at 0, 90, 135, 180, and 315 degrees at a distance of 2.2 m from the listening position and a height of 1.04 m (floor to woofer centre). The target was replayed from the 0 degree loudspeaker, whilst the interferer was replayed from one of the five speakers. All loudspeakers were concealed from view using acoustically transparent material.

Experiment Procedure

A multiple stimulus test was used to collect distraction ratings. The user interface was modified from an ITU BS.1534 [ITU-R 2003] multiple stimulus with hidden reference and anchor (MUSHRA) interface and featured unmarked 15 cm scales with end-point labels positioned 1 cm from the ends of the scale; a screenshot of the interface is shown in FIG. 24. Each page consisted of eight items comprising seven test stimuli and a hidden reference (just a target with no interfering audio). Participants were instructed to rate at least one item (i.e. the hidden reference) on each page at 0.

In previous tests, the target programme was kept constant for each item on the page and a reference stimulus provided to which subjects could refer in order to aid their judgements. However, with no repeats of target programme material, this was not possible. Therefore, participants were given the opportunity to listen to just the target audio for each of the stimuli to act as an individual reference for each stimulus. This was controlled by a toggle button on the interface.

A number of methods of controlling the interface were available to participants: the mouse could be used to click buttons and move sliders on the screen; key-board shortcuts were available for auditioning the various stimuli and turning the reference on and off; and a MIDI control surface was provided enabling full control of the test without use of keyboard or mouse. The control surface featured 8 motorised faders that were used to give the rating for each stimulus, as well as buttons to select the stimulus, toggle the reference, play/pause/stop the audio, and move to the next page. All markings were covered to minimise distractions or biases.

Participants

A total of 19 listeners participated in the 2 test sessions. Previous experiments suggested that experienced and inexperienced listeners were able to make re-liable distraction ratings, therefore there were no restrictions on the subjects recruited for the experiment. However, following the test participants were asked to give some details about their prior listening experience in order to facilitate further analysis.

Questionnaire

Following each test session, participants were asked to fill in a short questionnaire with the following questions.

1. Please write any reasons you encountered for giving particular distraction ratings, i.e., things about the programme material combinations that were particularly distracting or not distracting.
2. Do you have any other thoughts or comments about any aspect of the test?
3. Please tick all that apply:
   a) I'm a Tonmeister [University of Surrey Music and Sound Recording undergraduate student
   b) I'm a musician
   c) I produce/record music
   d) I've participated in listening tests before The first question was intended to collect written data on which verbal protocol analysis (VPA) could be performed in order to help to determine potentially useful features for the modelling process. The second question was intended to collect any relevant information about the test procedure to inform future listening test design and also provide insights into aspects of the data analysis. The third question enables some categorisation of listeners for further results analysis.

Experiment Design Summary

An experiment was designed in order to collect distraction ratings for a wide range of randomly selected stimuli intended to cover the range of potential music items in an entertainment scenario. The experiment eschewed a full factorial design in favour of facilitating a wider range of programme material from which features could be extracted for performing predictive modelling. The programme material items were determined at random by sampling various popular radio stations, and the following factor levels were randomly assigned to create 100 stimuli: target programme, interferer programme, target level, interferer level, and interferer location.

Results

In this section, some analysis of the results of the experiment described in the previous section are presented. As discussed above, it was not possible to perform a detailed factorial analysis of the results as a full factorial design was not used. However, it is possible to analyse subject performance and look at the stimulus scores in order to produce the most reliable subjective scores for the regression modelling procedure. For all analysis not specifically involving the repeat judgements, the repeats were removed to ensure a balanced data set.

Subject Performance

Hidden Reference Stimuli

Each test page featured a hidden reference stimulus (just a target programme with no interferer) that participants were instructed to rate at 0. The hidden reference stimulus was only rated incorrectly in five cases out of 304 (1.6%), and by four different participants. The purpose of the hidden reference was to anchor the low end of the scale and confirm that participants were genuinely performing the required task; the high percentage of correct ratings indicated that this was indeed the case. The references were therefore removed from the data set for all further analysis.

Reliability by Subject

FIG. 25 shows absolute mean error across stimulus repeats for each participant, alongside the mean and standard deviation of absolute error over all subjects and repeats. The grand mean of 12 points shows reasonable consistency, and the majority of participants are at approximately this level. Subjects 6, 10, 16, and 18 all lie more than one standard deviation above the mean. However, in the cases of subjects 6 and 16 this is a small distance and can be attributed to one stimulus being poorly judged; this can be seen in FIG. 26, which shows a heat map with the colour representing the size of the absolute error for each subject and stimulus. For subject 18, two stimuli stood out as being rated inconsistently, whilst for subject 10 performed poorly on a number of stimuli.

Reliability by Stimulus

It is possible that the repeat stimuli selected (at random) were particularly difficult to judge. To see if any of the repeats were particularly difficult, absolute mean error was plotted by stimulus (FIG. 27), again with mean and standard deviation of absolute error over all subjects and repeats shown with horizontal lines.

There seems to be a larger discrepancy between the stimuli than the subjects, with stimuli 105, 106, and 111 being rated particularly badly. In combination with the results presented above, this suggests that subjects 6, 16, and 18 performed particularly badly on stimuli for which a number of participants found it difficult to make consistent judgements, however, subject 10 performed poorly on stimuli for which the repeats were generally rated similarly by the majority of participants (102, 103, 108, 112).

Subject Grouping

Clustering analysis can be used to determine whether the subjects fall into two or more groups, i.e. whether there are different 'types' of subject. This can be performed by observing the distribution of results across all stimuli, considering each subject as a point in an n-dimensional space (where n is the number of stimuli) and comparing the distance between subjects on some metric.

Agglomerative hierarchical clustering was used to build clusters. In this method, each subject is initialised as an independent cluster and the nearest two clusters are merged at each stage. The Euclidean distance was used as the metric, and the scores given by each subject were standardised to account for differences in scale use and focus on differences in rating schemas. The 'average' method was used to determine the distance between clusters; this accounts for the average distance given by pairwise comparisons between all subjects in 2 clusters.

There are various methods for determining the number of clusters in the data depending on the reason for performing the analysis or underlying assumptions about why the clusters may be created. One method is to set a distance threshold; separate clusters are determined where the distance is over a certain threshold. Alternatively, a number of clusters n can be pre-determined by the experimenter; the threshold is determined by finding the cutoff point at which n clusters are produced.

In this case, the purpose of the analysis was twofold: to see if any subjects stood out as rating particularly differently from the group; and to determine potential groups of subjects which may help when fitting regression models to the data. Iteratively increasing the number of clusters that are extracted suggests that the subjects to the right of FIG. 21 stand out in a number of small groups. This suggests that these subjects performed quite differently to the majority.

This outlying group includes subjects 10 and 16, both of whom performed poorly in the reliability analysis described above. Ratings from these subjects were removed from further analysis because of their potential unreliability as judged by their lack of test-repeat reliability and also the apparent difference from the group. Subject 10 was an experienced listener whilst subject 16 was an inexperienced listener.

Reliability by Subject Type

FIG. 29 shows the absolute mean error between repeat judgements averaged over subject and stimulus and separated by listener type (experienced or in-experienced listeners; nine experienced listeners and 8 inexperienced listeners). As expected, there is no evidence that experienced listeners are able to make distraction ratings significantly more reliably than inexperienced listeners. This was found to be the case for all subject categories for which the data detailed above was collected.

Summary 12 stimuli from the experiment were repeated in order to analyse subject performance. A number of subjects were found to perform poorly, and 2 subjects (10 and 16) were removed from the data before further analysis as they performed poorly on stimuli that were generally rated well and were also shown in a clustering analysis to perform differently from the majority of participants. There were no significant differences between the performance of subjects with different levels of listening experience.

Distraction Ratings

FIG. 30 shows mean distraction for each of the 100 stimuli, with error bars showing 95% confidence intervals calculated using the t-distribution. The results have been ordered by mean distraction. It is apparent that the stimuli created using the random sampling and experimental factor assignment procedure successfully covered the full perceptual range of distraction. The error bars show reasonable agreement between subjects (mean width of 17.93 points) and suggest that participants were able to discriminate between stimuli. The error bars are longer towards the middle of the distraction range, suggestion greater agreement between subjects in the cases with least or most distraction.

The following figures show the relationship between the experimental factors described above and the distraction scores. The experiment design used does not facilitate a detailed analysis of the results using these factors, however it is possible to observe the relationship to suggest potential trends.

Target Level

FIG. 31 shows distraction scores plotted against target level. The small positive correlation ($R=0.13$) is non-significant ($p=0.20$) indicating no significant relationship between the target level and perceived distraction.

Interferer Level

FIG. 32 shows distraction scores plotted against the absolute interferer level. There is a significant large correlation ($R=0.65$, $p<0.01$), indicating a significant relationship between the interferer level and perceived distraction.

FIG. 33 shows distraction scores plotted against the difference between target and interferer levels. There is a marginally larger positive correlation ($R=0.68$, $p<0.01$), indicating that the relationship between target and interferer levels is important for perceived distraction.

Interferer Location

FIG. 34 shows mean distraction for each interferer location. It is not possible to draw firm conclusions from this plot as the interferer location is confounded by target and interferer programme and level. However, the figure suggests that there is potentially a small effect of interferer location, with a slight increase in distraction caused by the interferer being presented from 135 or 315 degrees.

Results Summary

Above, results analysis from the distraction rating experiment was presented. Subject reliability was quantified using the absolute mean error between judgements on a set of 12 stimuli that were repeated within the experiment design. It was found that a number of the repeated stimuli were generally found more difficult to rate consistently, but even accounting for this, a number of participants stood out as performing particularly unreliably. This analysis was coupled with a clustering of the subjects using agglomerative hierarchical clustering, which revealed a number of participants that performed differently to the majority. The subjects that fell into this external group as well as performing unreliably (subjects 10 and 16) were removed from all further analysis.

Whilst the experiment design did not facilitate comprehensive analysis of distraction results according to factor levels, some preliminary analysis was performed. It was shown that the stimuli selected covered the range of perceptual distraction, and subjects exhibited reasonable agreement on ratings. As expected, the interferer level and target-to-interferer ratio showed significant relationships with perceived distraction.

Feature Extraction

In order to perform regression modelling and develop a predictive model of perceived distraction, it is necessary to determine the features of the audio-on-audio interference situation that are pertinent to the rating given. In the first instance it was assumed that target-to-interferer ratio was the most important factor and therefore preliminary models focussed on features relating to time-frequency TIR maps. The results presented above suggested that TIR is an important factor but not sufficient to explain all of the variance in the subjective distraction ratings ($R^2=0.46$). It is therefore necessary to determine additional features from the target and interferer audio programmes that can be used to model perceived distraction.

The range of potential features that could be extracted from the audio data was prohibitively large. It was therefore felt desirable to determine potential features based on reasons that participants gave for finding the audio-on-audio interference situations distracting, in order to limit the feature set to a more manageable size whilst determining potentially relevant features. VPA is a technique by which qualitative data can be categorised in order to draw useful inferences. A VPA procedure was performed using the qualitative responses given by subjects to the questionnaire described above. The subjective responses were coded into categories, which were then used to motivate a search for suitable features.

Coding

Written responses from the questionnaire described above were subjected to VPA performed by the author; the responses to questions 1 and 2 (referring to reasons for giving a particular distraction rating and listening test design respectively) were coded (using NVivo qualitative analysis software) into groups of similar reasons for the level of perceived distraction according to the subjective responses. Responses to question 2 were included in the coding in order to collect information about the experiment design and also statements that would have been more relevant as an answer to question 1.

The table illustrated in FIG. 35 contains the group titles and number of statements coded into each group. The groups were used as the motivation for the features selected above.

Stimulus Recording and Data File Generation

In order to perform the feature extraction, all stimuli were recorded at the listening position as they were reproduced in the experiment. The target and interferer programmes were recorded separately in order to allow extraction of features just relating to either signal in addition to those related to the target interferer combination.

Features

Audio features felt to be relevant to the categories described in Section 7.4.1 were selected by the inventor. Features were based on output from a number of toolboxes: CASP model time-frequency TIR maps and masking predictions; the Musical Information Retrieval (MIR) toolbox; the Perceptually Motivated Measurement of Spatial Sound Attributes (PMMP) toolbox; the Perceptual Evaluation of Audio Source Separation (PEASS) toolbox; and the GENESIS loudness toolbox. These toolboxes are briefly described below.

CASP Model

The CASP model was used to produce internal representations of the target audio and interferer audio, time-frequency TIR maps as detailed in Section 6.2, and masking threshold predictions.

MIR Toolbox

The MIR toolbox comprises a large number of MATLAB functions for extracting musical features from audio. The toolbox contains both low- and high-level features, i.e. those that aim to quantify a simple energetic property of a signal such as RMS energy in addition to those that perform further processing based on the low-level features in an attempt to predict psychoacoustic percepts such as emotion. The features are related to musical concepts, including tonality, dynamics, rhythm, and timbre. Such features are potentially relevant to the categories elicited in the VPA described above.

PMMP Toolbox

The Perceptually Motivated Measurement Project (PMMP) aimed to relate physical measurements of audio signals to perceptual attributes of spatial impression and resulted in a MATLAB software package that predicts perceived angular width and direction from binaural recordings. The PMMP software was used to generate predictions of the interferer location; the predicted angle was averaged across time and frequency. However it must be noted that location prediction was not the primary goal of the project.

PEASS Toolbox

The perceptual evaluation for audio source separation (PEASS) toolbox contains a set of objective measures designed to evaluate the perceived quality of audio source separation, alongside test interfaces for collecting subjective results. The toolbox is designed to make objective and subjective measurements of:

Four corresponding scores are produced by the toolbox: the overall perceptual score (OPS); the target-related perceptual score (TPS); the interference-related perceptual score (IPS); and the artefact-related perceptual score (APS). The predictions are generated by calculating various perceptual similarity metrics (PSMs) based on different aspects of the signal; the PSM is generated using the PEMO-Q algorithm. The resulting PSMs are then mapped to the OPS, TPS, IPS, and APS predictions by a non-linear function (one hidden layer feed forward neural network) trained on listening test results.

GENESIS Loudness Toolbox

The GENESIS loudness toolbox provides a set of MATLAB functions for calculating perceived loudness from a calibrated recording. Specifically, Glasberg and Moore's model of the loudness of time-varying sounds was used to predict loudness.

Extracted Features

FIG. 36, FIG. 37, and FIG. 38 describe features extracted for distraction modelling. T: Target; I: Interferer; C: Combination. M: Mono; L: Binaural, left ear; R: Binaural, right ear; Hi: Binaural, ear with highest value; Lo: Binaural, ear with lowest value.

Where frequency ranges are indicated specific bands of the CASP model output were used, with centre frequencies as detailed in FIG. 39.

Feature Extraction Weaknesses

The method of feature extraction described above has a number of weaknesses. Whilst a large number of potentially relevant features were produced, there is no guarantee that the selected features cover the percepts implied by the VPA categories. The feature set is also incomplete in that a number of categories were not possible to represent based on features extracted from the audio. For example, subjective factors that relate to the participant rather than the signal, such as familiarity and preference, cannot be extracted. Finally, it is possible that some of the features do not accurately convey the percept that they were selected to represent. For example, the PMMP toolbox was used in an attempt to predict the interferer location. As the interferer location was known for the training set, the accuracy of this feature can be directly determined. FIG. 40 shows a plot of actual stimulus location against predicted stimulus location. It is clear that this feature failed to accurately predict the interferer location (this was not felt to be a critical failure given the apparent lack of importance of interferer location).

Feature Extraction Summary

In order to suggest features that could be used to predict perceived distraction, written data was categorised using VPA. The categories were used as the basis for determining a large set of features, which were extracted from monaural and binaural recordings of the target and interferer audio programmes. The features were created using a range of toolboxes with different representations of the audio and in different frequency ranges. The feature set comprised a total of 399 features.

Model Training

In this section, the procedure of mapping audio features to subjective distraction ratings in order to develop a predictive model of distraction is discussed. In order to produce models in which the coefficients are interpretable and can therefore be used to provide information about the perceptual experience as well as accurate predictions, linear regression was selected as the primary modelling method, as opposed to non-linear techniques such as artificial neural networks (ANNs), in which the relationships between features and predictions are not explicit.

With a large number of features (399 in this case), selection of the appropriate features is difficult and it is important to avoid overfitting (i.e. selecting features that produce a strong fit to the training set but do not explain the underlying cause of the subjective response and will therefore not generalise well to new data sets). There are a number of ways of attempting to minimise overfitting and therefore ensure generalisability: considering cross-validation scores and metrics that account for the number of features used (e.g. adjusted R2) is desirable when evaluating model performance, and it is also beneficial to interpret the selected features with a knowledge of psychoacoustics and the relevant literature in order to make suggestions as to why a particular feature is found to be useful in a prediction.

Linear regression was used as the modelling method. Evaluation metrics were used, with the number of iterations of the k-fold cross-validation procedure at 5000.

Model 1 Stepwise Model

1) Fit the initial model.
2) If any features not in the model have p-values less then $p_e$ (i.e. would significantly improve the prediction of the model at a specified probability $p_e$), add the feature with the lowest p-value to the model. Repeat this step until the stated condition is no longer true.
3) If any features in the model have p-values greater than $p_r$ (i.e. do not significantly improve the model performance at a specified probability $p_r$), remove the feature with the largest p-value and return to step 2.
4) End.

When the stepwise modelling algorithm was run with no initial model and all features made available, with $p_e$=0.05 and $p_r$=0.1, the following selections were made:

169: RMS level of target
207: Loudness ration (mono)
208: Loudness ratio (binaural)
219: PEASS interference related perceptual score
263 Model range, interferer, high frequency range (mono)
295 Model range, interferer, high frequency range (ear with lowest range)
316: Percentage of temporal windows with TIR<5 dB (best ear. ie. lowest percentage from L and R signals.

FIG. 42 shows the model fit, and performance statistics are given in the table illustrated in FIG. 41. The model fit is good (RMSE 9.03), especially considering the uncertainty in the subjective scores (the 95% confidence intervals around the subjective scores had a mean of 17.93). When the error in the subjective scores is accounted for (using RMSE*), the fit improves to 4.33. The cross-validation performance is also encouraging, with only a small increase in RMSE when using leave-one-out cross-validation and the stricter 2-fold cross validation. However, the large mean and maximum VIF values suggest significant multicolinearity between 2 or more features; in this case, there is unsurprisingly high correlation between the mono and binaural loudness ratio. This suggests that the model would be more robust using just one of these features.

FIG. 43 shows standardised coefficient values for each feature in the model. The problem with including the 2 loudness ratio features becomes immediately obvious when observing the coefficient values as they have the opposite sign indicating that what should be essentially the same feature is acting differently.

The mono loudness ratio coefficient is only just significantly different from 0 and acts in a counterintuitive manner (i.e. as mono loudness ratio increases, distraction increases, which is contrary to previous findings). Therefore, it is possibly beneficial to remove this feature from the model.

The coefficients for the other features show an intuitive relationship with the distraction scores. As the target level increases, distraction shows a small increase. As the PEASS interference-related perceptual score improves, distraction decreases. The interferer model range in the high frequency bands is more difficult to interpret; although the VIF due to these features was not unduly high, the features are significantly positively correlated (R=0.84, p<0.01) and therefore the parameter weights having opposite signs is again worrying and suggests potential overfitting. Finally, as the number of temporal windows with TIR less than 5 dB in the ear with highest TIR decreases, the distraction score increases; again, in order to simplify the feature extraction procedure it may be beneficial to replace this feature with the monophonic equivalent, which shows a strong positive correlation (R=0.92, p<0.01).

A further evaluation method consists of observing the distribution of residuals (the difference between the model predictions and observed distraction scores).

FIG. 44A-FIG. 44C shows a number of ways of visualising the residuals. The residuals have been studentized, that is, the value of the ith residual is scaled by the standard deviation of that residual (in linear regression, the standard deviation of each residual is not equal, hence the need for studentization rather than standardisation in which the residuals are all scaled by the overall standard deviation).

In linear regression, the residuals are assumed to be normally distributed and homoscedastic (that is, the variance is equal across the range of predictor variables). FIG. 44A indicates that in this case, the residuals are heteroscedastic; they have greater variance in the middle of the predicted distraction range than at the ends of the range. However, it is interesting to interpret this plot in conjunction with FIG. 45, which shows a scatter plot of subjective distraction ratings against the width of the 95% confidence interval for each rating. It can be seen that uncertainty in the subjective scores increases in the middle of the distraction range, which could go some way towards explaining the greater variance in the residuals in this range of the model predictions.

The residuals are approximately centred around zero, and the histogram in FIG. 44B shows that the residuals are approximately normally distributed with the exception of a slight bias towards the lower tail of the distribution. This observation is supported by the lower tail of the Q-Q plot (FIG. 44C). These plots therefore combine to indicate that the model may not be appropriate as the assumptions for linear regression are not fully satisfied. This suggests that further refinement of the features selected is necessary.

Model 2: Adjusted Model

In an attempt to correct some of the problems exhibited in the model above (i.e. the multicollinearity introduced by very similar features, uncertain and contradictory coefficients, and non-normal and heteroscedastic residuals), the features selected in the stepwise procedure were refined in order to produce a simpler model. The binaural versions of the duplicated features were retained as they were generally more significantly different from 0 in the full stepwise model. The RMS level feature was switched to the monophonic version, as there was no apparent justification for using the left or right ear signals, however, where the features included the best or worst ear signals, these were retained. Therefore, the new feature set consisted of:

169: RMS level of target
207: Loudness ratio (mono)
208: Loudness ratio (binaural)
219: PEASS interference related perceptual score
263 Model range, interferer, high frequency range (mono)
295 Model range, interferer, high frequency range (ear with lowest range)
316: Percentage of temporal windows with TIR<5 dB (best ear. ie. lowest percentage from L and R signals.

FIG. 46 shows the model fit, and performance statistics are given in FIG. 47. As would be expected when removing 2 features, the goodness-of-fit is slightly reduced, although the RMSE* is very similar between the two models. The adjusted model performs marginally better when considering the difference between RMSE and cross-validation RMSE, suggesting the possibility of improved generalisability. The variance explained (adjusted $R^2$) is very similar between the two models, whilst the multicollinearity between features is much reduced with the maximum VIF falling below the acceptable tolerance of 10 suggested by Myers [1990]. The loudness ratio and PEASS IPS have the highest VIF scores (5.60 and 4.65 respectively) indicating that these features may duplicate some of the necessary information.

FIG. 48 shows standardised coefficient values for each feature in the model. The relationships shown are similar to those for the full stepwise model (above).

The studentized residuals are visualised in FIG. 49A-FIG. 49C. The apparent deviations from normality and homoscedacitity are still present; again, there is greater variance towards the middle of the predicted distraction range, and a tendency for the model to over-predict (i.e. pronounced negative residuals). 5 points lie outside of ±2 standard deviations (stimuli 16, 45, 3, 31, and 26) and can therefore be considered outliers. These outlying stimuli are considered further in the next section.

Model 3: Adjusted Model with Outliers Removed

The adjusted model was re-trained with a reduced stimulus set i.e. with the outliers (detailed in FIG. 50) removed from the training se, in order to assess the influence of the outlying points on the model and evaluate the model without the difficult cases. Statistics for the adjusted model with outliers removed are given in FIG. 51; the model fit is shown in FIG. 52; and studentized residuals are visualised in FIG. 53A-FIG. 53C. As may be expected, the model fit was improved by re-training without the outlying stimuli; RMSE was reduced by over 1.5 points to 7.89, with RMSE* reduced to 2.55. The studentized residuals plot (FIG. 53A) shows a more even distribution of residuals over the range of predictions, indicating better homoscedasticity (although there is still greater variance in the residuals towards the middle of the prediction range). It is interesting to note that more stimuli stand out as having high studentized residuals (±2 standard deviations). The Q-Q plot (FIG. 53C) shows small deviations from normality but a reduction in the long tails, particularly the under-predicting seen for the adjusted model in FIG. 49C.

The table illustrated in FIG. 50 shows outlying stimuli from adjusted model. y is the subjective distraction rating, $\hat{y}'$ prediction by the adjusted model (full training set), and $\hat{y}'$ is the prediction by the adjusted model trained without the outlying stimuli. It is interesting to observe the parameter values for the same model trained with or without the outlying stimuli; standardised coefficients for both models are shown in FIG. 54. There are no significant differences in the parameter values, indicating that the presence of the outlying stimuli in the training set does not affect the coefficient estimates. This is reflected in the similar predictions made for the outlying stimuli with the adjusted model and the adjusted model with no outliers (respectively $\hat{y}$ and $\hat{y}'$ in FIG. 50).

FIG. 51: Statistics for adjusted model trained without the outlying stimuli. For the k-fold cross-validation, k=5 for the model trained without outliers, as the 95 training cases could not be divided evenly into 2 folds.

Outlying Stimuli Details

The similarity between model parameters suggests that the selected features can be used to predict distraction well for the majority of stimuli but fail under particular conditions. In order to ascertain the reason for the failure of the selected features on a small number of stimuli, the outlying stimuli were auditioned by the author (details of the combinations are presented in FIG. 50).

For the over-predicted stimuli (16, 5, 31, and 45), there were musical similarities between target and interferer programmes that had the effect of 'hiding' the interferer; whilst the energetic content of the interferer may have suggested that the interferer was distracting, particular musical features helped to alleviate this distraction. For example, the strings in the stimulus 5 interferer blended particularly well with the target programme; the timing, style, and key signatures were not conflicting. Similarly with stimulus 31, the combination of the target and interferer sounded like a fairly messy and discordant rock song, which works fairly well given the style; the interferer is audible but not particularly distracting because of the musical combination.

Conversely, the under-predicted stimulus (26) featured a prominent beat in the interferer programme that nearly fits with the pulse of the target programme; the contrasting genres and slight rhythmic disparity create a large and obvious clash with the classical target programme, regardless of TIR.

Such musical features are very difficult to extract, and this problem is compounded by the fact that for the majority of stimuli, the energy-based features are sufficient for making accurate predictions. Whilst the VPA procedure used for suggesting potential features considered musical features such as key clashes, the features indented to model such aspects did not prove particularly beneficial in the modelling process and were not selected by the stepwise algorithm; most such features exhibited low correlation with the subjective scores. It should also be noted that a number of aspects considered in the VPA could not be measured by features extracted from the audio; for example, preference or familiarity were both regularly mentioned by subjects but it is not possible to obtain data for such subjective quantities.

A visual analysis of scatter plots of observed distraction scores against feature values was performed in order to determine any features that grouped the outlying stimuli, in an attempt to find features to improve the model. Features that grouped the outlying points could potentially be used to determine the stimuli for which the model could not make accurate predictions, and therefore suggest the use of a different model (as in piecewise regression). The features that showed a close grouping for the outliers are shown in FIG. 55A-FIG. 55C. However, in many of the cases, the outlying stimuli do not stand out as many other stimuli have similar values. In a number of cases, this is due to very low correlation with the subjective score. Nevertheless, the adjusted model was re-trained including 1 of the extra features at each iteration, with and without interaction terms. None of the extra features improved the model; a small gain in accuracy was produced by including interaction terms, but the large number of features led to inflated 2-fold cross-validation scores. To reduce the number of features, the stepwise algorithm was used for each of the feature sets (i.e. the adjusted model features with 1 of the extra features identified above, and all interaction terms); again, there were no significant improvements with any small gains in accuracy tempered by an increase in complexity and cross-validation RMSE.

It is apparent that the majority of variance in the data set can be modelled with a small set of energy-related features. In a number of cases with particular musical combinations, these features are insufficient for accurate predictions. However, with the current feature set, it is not possible to suggest features that will help in this area, motivating the development of further predictive features for description of musical interactions between target and interferer programmes.

The adjusted model suggested above still predicts well for the majority of stimuli, and tends to over-predict distraction in the outlying cases; this provides a degree of safety as in a practical implementation of the model, it would be unlikely to predict a better perceptual experience than a listener would perceive.

Model 4: Adjusted Model with Altered Features

Using the stepwise modelling algorithm gives a chance of selecting suboptimal features; it may be the case that features are 'nested', that is, features are selected to go well with earlier features, where in fact in reality, different feature groups may give more valid and generalisable models. It is also possible that particular features give the best least-squares solution to the training set but are not actually the most relevant descriptors of the underlying perceptual experience. One way to avoid this is by analysing the features selected and training new models with similar features. In this case, models with varying versions of the same features can be trained to assess if, for example, monophonic or binaural versions of the features are more successful, or if different frequency ranges make a difference. This can help to produce a model that is not overfitting as the features have a clearly understandable relationship with the dependent variable and are not simply mathematically optimal.

Therefore, a number of feature sets were created as variants of the adjusted model features, swapping features from the original model to features that were felt to be similar but potentially more perceptually relevant.

In the loudness-related models, features considering signal level were replaced with similar metrics based on loudness rather than level. In the limited frequency range versions, level/loudness features used the CASP model versions as these were extracted in the different frequency ranges.

Model performance statistics for linear models created using each of the above feature sets are given in FIG. 56. A number of conclusions can be drawn. The models based solely on a particular frequency range (M7, M8, M9, M10) performed poorly, as did the models that only used monophonic features (M2, M5). This suggests that useful information is provided by considering different frequency ranges as well as binaural factors.

Using loudness in place of RMS level (M1) produced a model that performed very similarly to the adjusted model. It may therefore be considered beneficial to use the loudness-related feature, as using perceptually-motivated metrics where possible is likely to be more broadly beneficial. This comes at a trade-off of longer calculation time, although in this case, the loudness metric must be calculated anyway for the loudness ratio feature. Again, the fully binaural models (M3, M4) performed very similarly to the adjusted model; the same argument applies in that given little difference between the results and the necessity of collecting binaural measurements for other features, it seems appropriate to use binaural information where possible. It therefore seems that M6 (loudness-related and binaural features) is the most suitable adaptation to the adjusted model. The features in M6 were:

Maximum loudness of target (binaural)

208: Loudness ratio (binaural)

219: PEASS interference related perceptual score

295: Model, range, interferer, high frequency range (ear with lowest range)

316: Percentage of temporal windows with TIR<5 dB (best ear, ie. lowest percentage from the L and R signals)

The fit for this model is shown in FIG. 57 and studentized residuals are shown in FIG. 58A-FIG. 58C. The shape of the residuals shown in FIG. 58A is similar to that for the adjusted model shown in FIG. 58A, indicating the presence of some heteroscedasticity. However as before, this can be attributed to the presence of a number of outliers as well as greater subjective uncertainty in the middle of the scale range. There are more outlying points for the adjusted model with altered features; these include the same stimuli as for the adjusted model (detailed in FIG. 50) as well as two additional points. However, the Q-Q plot (FIG. 58C) shows a more even distribution of the residuals in the middle and top of the range, with the heavy tail (i.e. over-predicting) still present.

Investigation of feature substitutions In order to justify the substitution of binaural loudness-based features, the stepwise modelling procedure was repeated with only these features available for the algorithm to select (for features for which a binaural loudness-based version was available). The features selected were very similar to those used in the adjusted model with altered features described above:

128: Model level, interferer, low frequency range, ear with highest level

188: Maximum loudness of target and interferer combination (binaural)

208: Loudness ratio (binaural)

219: PEASS IPS

295: Model range, interferer, high frequency range (ear with lowest range)

335: Percentage of temporal windows with TIR<10 dB, high frequency range (worst ear, i.e. highest percentage from the L and R signals)

339: Percentage of temporal windows with TIR<10 dB, high frequency range (best ear, ie. lowest percentage from the L and R signals)

Features 208, 219, and 295 were all included in the adjusted model with altered features. Features 335 and 339 are very similar to feature 316; they consider the number of temporal windows with low TIR. However, the threshold was slightly different and the new features only considered the high frequency range. As feature 316 (i.e. the feature used in the adjusted model with altered features) exhibited the strongest individual correlation with the subjective scores ($R_{316}$=0.62, $R_{335}$=0.58, $R_{339}$=0.58), it was maintained in the model.

The maximum loudness of the target was not selected in the new model, but was replaced by the CASP model level of the interferer (low frequency range) and the maximum loudness of the target and interferer combination. It seems that these features are representing the overall level of the audio in the room; there is a high correlation between the target loudness and the combination loudness (R=0.99). The adjusted model with altered features was retrained replacing 184 with 186 (interferer maximum loudness), 188 (combination maximum loudness), and 128 (CASP model level, interferer, LF, highest ear). The best performance, accounting for cross-validation RMSE, was with the combination loudness. Therefore, this feature was included in the final model, replacing 184 (target loudness).

The fit for the final adjusted model is shown in FIG. 60, statistics (with comparison against M6) are presented in FIG. 59, and studentized residuals are visualised in FIG. 61A-FIG. 61C. The performance is a marginal improvement on M6, with a very similar distribution of residuals.

Features Used in Adjusted Model with Altered Features

The features used in the final version of the adjusted model were:

188: Maximum loudness of combination (binaural)

208: Loudness ratio (binaural)

219: PEASS interference related perceptual score

295: Model range, interferer, high frequency range (ear with lowest range)

316: Percentage of temporal windows with TIR<5 dB (best ear, ie. lowest percentage from the L and R signals)

One benefit of linear regression is that the coefficient values can provide information about the relationship between the features and the dependent variable, helping to explain the relationship and therefore enable optimisation of systems. Model coefficients for the adjusted model with altered features are shown in FIG. 62, and FIG. 63A-FIG. 63E shows scatter plots of observations against feature values for the 5 features in the adjusted model with altered features.

The target and interferer combination loudness shows a small positive correlation with subjective distraction; as the overall loudness increases, perceived distraction increases. This is reflected in the small positive coefficient value.

Loudness ratio shows a strong negative correlation with distraction, i.e. the louder the target relative to the interferer, the less distracting.

PEASS IPS also shows a strong negative correlation with distraction; as the PEASS toolbox predictions suggest that the quality due to suppression of the interferer improves (i.e. reaches 100), distraction decreases.

The difference in level between the highest level and lowest level band in the high frequency range (detailed in FIG. 39) of the interferer showed a negative correlation, indicating that a greater difference caused less distraction. It is difficult to suggest clear reasons for this relationship and listening to the stimuli with extreme ratings did not clarify the situation. However, there are a number of notable outlying points, the far right of which represents stimulus 26, the under-predicted outlier (see FIG. 50; this feature could be a significant contribution to the under-prediction i.e. it has a high value with a negative coefficient, resulting in a lower distraction score).

The percentage of temporal windows in which the TIR was less than 5 dB exhibited a positive correlation with distraction scores; as a higher percentage of the file had a low TIR, the interferer was more distracting. However, in the regression model the coefficient has a negative sign, indicating that higher percentages reduce the predicted distraction. This suggests that the feature could potentially be limiting the effect of the negative sign of the loudness ratio coefficient in order to prevent over-predicting.

Model 5: Interactions Model

The models described above featured simple linear combinations of the features. It is also possible to consider interactions between the features, as well as non-linear terms (i.e. fitting polynomials to the data).

Feature Selection

The features matrix was expanded by creating squared terms for all features, and then producing all 2-way interactions between the first and second order terms. This process greatly expanded the feature set from 399 potential features to 323610 features. Again, the stepwise algorithm was used to determine the most appropriate features. With the larger feature set, it was necessary to reduce the p-values at which features would be added or removed from the model; with the original values of $p_e$=0.05 and pr=0.1, the stepwise algorithm selected 81 features, overfitting the data ($R^2$=1, RMSE<0.01). To determine suitable values for $p_e$ and $p_r$, the original values of 0.05 and 0.10 were reduced by a factor of 10 at each step for a total of 5 steps. FIG. 64 shows RMSE, leave-one-out RMSE, and 2-fold RMSE[3] for decreasing values of $p_e$ and $p_r$.

The model fit and cross-validation are reasonably close for all iterations of the selection (with the exception of the original values of $p_e$ and $p_r$). This is surprising given the high number of features selected. The third model produced 9 features; even with the reasonable cross-validation performance, this was considered too complex a model. Therefore, values of $p_e$=5e-5 and $p_r$=0.1e-5 were selected.

It is noted that 2-fold RMSE is omitted for the first model as there were more features selected (81) than data points in each fold (50) and therefore it was not possible to fit a regression model.

The features chosen by this implementation were as follows:

1) 162*219: Interferer bandwidth (lowest ear)*PEASS IPS
2) 208*259: Loudness ratio (binaural)*Model range, interferer, right ear, HF
3) 229*1862: Interferer 'activity' emotion*Interferer maximum loudness, binaural, squared term Feature Alteration As before, there was considered to be little justification for using the right ear version of a feature (in this case, the interferer model range at HF). The model was retrained using the mono and lowest ear versions of this feature (the lowest ear version was also a feature in the adjusted model). Both new features reduced the goodness-of-fit (statistics are presented in FIG. 65), however, it was considered beneficial to use the lowest ear version of the feature as it was shown to be useful in the adjusted model and is potentially more psychoacoustically valid than a monophonic or single-ear version. The reduction in goodness-of-fit for this feature was small, and the VIF statistics were improved. It was also felt to be important that the lowest ear version was selected for the adjusted model and has more perceptual justification than a single ear signal (which is likely to be beneficial simply because of the particular combinations used in the training experiment). Therefore, the feature set for the interactions model was as follows:

1) 162*219: Interferer bandwidth (lowest ear)*PEASS IPS
2) 208*295: Loudness ratio (binaural)*Model range, interferer, lowest ear, HF
3) 229*1862: Interferer 'activity' emotion*Interferer maximum loudness, binaural, squared term Model Fit and Statistics The model fit for the interactions model with adjusted features is shown in FIG. 66; studentized residuals are visualised in FIG. 67A-FIG. 67C. The model fit is very similar to the adjusted model. FIG. 66 shows an obvious outlying point, and the residuals plot in FIG. 67A confirms the existence of 3 pronounced outliers. Interestingly, these are the same stimuli that were over-predicted by the adjusted model. These points significantly skew the distribution of residuals, producing a long tail towards the lower end. Again, this indicates a tendency to over-predict.

The features selected show some overlap with the features in the adjusted model with 3 features appearing in both models. This provides supporting evidence that these features are providing useful information about the perceptual experience. Model coefficients for the interaction model are shown in FIG. 68. It is more difficult to interpret the interaction terms, and with the high number of interactions it becomes more likely that the good fit is simply a mathematical chance rather than a description of the underlying perceptual structure of the data. Whilst this would often be reason to use a simpler model, in this case the small number of features and the fact that a number of the same features are present in the simpler model suggest that the interactions may be relevant.

Conclusions

In this first part of the chapter, the design and results of an experiment designed to collect a large data set for training a model to conform to the specifications outlined in the first section were presented. The primary aim of the research presented in this chapter was to answer the remaining two research questions:

1) What are the most perceptually important physical parameters that affect distraction in a sound zone?
2) What is the relationship between distraction and the relevant physical parameters?

To answer the first of these questions, qualitative data were collected from subjects in the form of a written questionnaire following the experiment, and VPA was used to determine the physical parameters that subjects reported as affecting perceived distraction (see FIG. 35).

To further refine the important features as well as answering the second question, a regression modelling procedure was undertaken. Two iterations of the model performed well and were selected for further validation.

The 'adjusted model with altered features' consisted of an intercept term and 5 features:

1) 188: Maximum loudness of combination (binaural)
2) 208: Loudness ratio (binaural)
3) 219: PEASS interference-related perceptual score
4) 295: Model range, interferer, high frequency range (ear with lowest range)
5) 316: Percentage of temporal windows with TIR<5 dB (best ear, i.e. lowest percentage from the L and R signals)

The regression model is given to 2 decimal places in Equation 7.1:

$$\hat{y}=24.19+1.04x_1-2.04x_2-0.41x_3-0.95x_4-0.16x_5. \quad (7.1)$$

The 'interactions model' consisted of an intercept term and 3 features:

1) 162*219: Interferer bandwidth (lowest ear)*PEASS IPS
2) 208*295: Loudness ratio (binaural)*Model range, interferer, lowest ear, HF
3) 229*1862: Interferer 'activity' emotion*Interferer maximum loudness, binaural, squared term The regression model is given to 2 decimal places in Equation 7.2:

$$\hat{y}=47.93-12.64x_1-8.74x_2+6.65x_3. \quad (7.2)$$

These models showed a similar fit (RMSE of 9.51 and 10.03 for the adjusted and interactions models respectively); a full comparison of statistics is shown in FIG. 69. Both models also exhibited a tendency to over-predict for particular outlying stimuli. This was attributed to the musical relationship between target and interferer programmes, which could not be described by the current feature set. It was considered acceptable for the model to over-predict as it would not suggest that a system was performing better than it actually was.

Distraction Model Validation

As discussed above, it is important that a predictive model is able to generalise well to new stimuli. This can be encouraged during the model training phase (i.e. by selecting a simple model with a small number of features and good cross-validation performance). However, the most reliable way to test the generalisability of the model is validation on an independently collected data set, that is, new data points on which the model was not trained but should be able to predict accurately. The goodness-of-fit between model predictions and subjective scores for the test set can then be used to measure the generalisability of the model.

Two validation data sets were available.

1) The practice cases from the distraction experiment described in this chapter
2) Distraction ratings from an elicitation experiment and a validation set The validation presented in this chapter aims to confirm the answers to the second and third overall research questions:

What are the most perceptually important physical parameters that affect distraction in a sound zone?

What is the relationship between distraction and the relevant physical parameters?

Specifically, the validation procedure was intended to select the optimal model from the two presented in the previous chapter, therefore confirming the relevant physical parameters and their relationship with perceived distraction.

Validation Data Set 1: Practice Stimuli

The practice stimuli comprise 14 items generated using a similar random radio sampling procedure to that used in the full experiment. Ratings were collected prior to the main experiment session; all subjects performed a practice page with 7 stimuli and 1 hidden reference1. The stimuli are different to those on which the model was trained but were collected using the same methodology and therefore fall within the range of items that the model should accurately predict.

As the practice task was intended for subjects to get used to using the interface and performing the rating task, it is possible that the subjective ratings collected may be dissimilar to those collected in the full experiment. The has the potential effect of increasing the width of the confidence intervals about the subjective scores and potentially inflating the validation RMSE. This is not considered to be a major problem as if there is an effect, it will be biased towards making the validation perform less well i.e. a more difficult validation.

Subjective Ratings

Mean subjective distraction scores and 95% confidence intervals for the practice stimuli are shown in FIG. 70; the stimuli are ordered according to mean distraction (ascending), and the two left-most points are the hidden references. The confidence intervals are of similar magnitude to those for the full experiment, and again a reasonable range of the distraction scale has been covered, suggesting that these data points are suitable for validation of the model.

Validation

FIG. 71A-FIG. 71B shows the fit between observations and predictions for the validation set for the adjusted and interactions models described above. RMSE and RMSE* for the training and validation sets are given in FIG. 72. There is an obvious inflation of RMSE for the validation set, however, observation of the fit plots shows that a single point (stimulus 10) is particularly badly predicted, having the effect of considerably skewing the fit between observations and predictions.

FIG. 73A-FIG. 73B shows the adjusted fit with stimulus 10 removed; RMSE and RMSE* are given in the table illustrated in FIG. 74. For both models, the fit is greatly improved. In fact, RMSE* is better for the validation set, although as considered above, this could be because of greater uncertainty in the subjective ratings. The adjusted model has a tendency to under-predict (as seen in FIG. 73A by the regression line falling below the y=x line); this is strange given the tendency of the models to over-predict during training, but could potentially be attributed to differences in ratings during the full experiment and the practice stage. The interactions model shows a very linear fit to the data (R=0.91).

Outlying Stimulus

FIG. 75 contains details of the outlying stimulus. During model training it was found that stimuli with particular musical combinations were not predicted well by the models. In the poorly predicted stimulus, the interferer vocal line is very pronounced and intelligible whilst the music underlying the interferer vocal is completely masked. Combined with the prominent vocal line of the target, this creates a confusing scene, and there is additionally of a combination of keys where some notes in the interferer are appropriate whilst some are clashing.

It is possible that the model prediction is low based on energetic content, whilst the informational content of the interferer programme is causing more pronounced subjective distraction. As noted above, it is challenging to extract features that relate to musical or informational aspects of the programme items, and the models using energy-based features predict accurately for the majority of stimuli. Subjective characteristics such as personal preference or familiarity are also not considered during the modelling, but were often mentioned by listeners and therefore may be important.

Summary

With the exception of one stimulus that was predicted particularly badly, both models performed well in the validation, with only a small inflation of RMSE compared with the training set. When the outlying point was removed, the interactions model performed slightly better in terms of the linearity of the fit as well as RMSE, although RMSE* was lower for the adjusted model. For the full stimulus set, the adjusted model had a slightly lower RMSE with a more pronounced improvement in RMSE* over the interactions model.

Validation Data Set 2: Previous Experiment Stimuli

The subjective results from a previous distraction rating experiment and validation can also be used to validate the model. The training set comprised 54 stimuli. The validation set comprised 27 stimuli (including 3 duplicates from the training set).

There are a number of differences between the data set on which the model described in this chapter was trained and the second validation data set: the programme items were longer (55 seconds), although subjects were not required to listen to the full duration of the stimuli and previous models were successful without considering the full stimulus duration; the target was always replayed at 90 degrees; road noise was included for a number of the stimuli; a number of the interferer stimuli were processed with a band-stop filter; and the stimuli were created using full factorial designs, therefore particular target and interferer programme combinations were repeated at different factor levels. However, the scale and rating methodology were the same, and the data sets should be similar enough for the model to make accurate predictions.

Validation

FIG. 77A-FIG. 77B shows the fit between observations and predictions for the validation set for the adjusted and interactions models described above. RMSE and RMSE* for the training and validation sets are given in the table illustrated in FIG. 76. As with validation set 1, the RMSE is greatly inflated. However, this inflation is even more pronounced for the interactions model. For the adjusted model, the inflation in RMSE* is not as pronounced, indicating that the model fits the validation set reasonably well given the uncertainty in the subjective scores. It is notable that the predictions do not always fall inside of the range $0 \leq \hat{y} \leq 100$ for either model.

The second validation set consisted of 2 separately collected data sets: a training set (set 2*a*) and validation set (set 2*b*) from previous modelling phases. The fit to the two separate data sets is shown in FIG. 79A-FIG. 79D, and RMSE statistics given in the table illustrated in FIG. 78. The model showed a much better fit to set 2*a* than to set 2*b*, with a moderate increase in RMSE* compared to both the training and validation set 1 performance. The model performed particularly poorly for set 2*b*, although the pronounced difference between RMSE and RMSE* suggests that the subjective uncertainty in the set 2*b* data is high.

Analysis of Poor Fit for Validation Set 2*b*

In order to ascertain the reasons for the poor fit shown to validation set 2*b*, the model fit was plotted with points delimited according to their factor level in the data set design (FIG. 80A-FIG. 80H).

It was notable that 2 of the duplicated points (the low and medium distraction points) were predicted particularly poorly (under-predicted). However, the repeated stimuli were predicted very similarly in sets 2*a* and 2*b* for both models, suggesting that the new models are rather robust to small differences in recordings.

Aside from the repeated stimuli, the most obvious relationships are shown for target programme (top row of FIG. 80A-FIG. 80H) and interferer programme (second row of FIG. 80A-FIG. 80H). The programme material items tend to cluster together; for ex-ample, the slow instrumental jazz target programme is generally over-predicted whilst the up-tempo electronica programme is under-predicted. Similarly, the sports commentary interferer is generally over-predicted, whilst the fast classical music is under-predicted. This result suggests that validation of the model on a full factorial stimulus set inflates the RMSE, as individual programme items that are poorly predicted are duplicated multiple times within the data set, and this is unrepresentative of the wider range of programme items for which the model should make reasonably accurate predictions. Combined with the uncertainty due to large confidence intervals about the subjective data, the increased RMSE for the validation set is not considered overly problematic. The apparent robustness of the model to variations in interferer level and filtering are promising, suggesting that the model may generalise well to audio-on-audio interference situations engendered by a personal sound zone system (as currently available sound zoning method introduce frequency shaping and other artefacts into audio programme material).

Summary

The performance on validation set 2 was worse than for validation set 1, however, when the set was separated into original training and validation sets (denoted 2*a* and 2*b* respectively), it was apparent that the drop in performance could be primarily attributed to set 2*b*. There appeared to be a relationship between the model predictions and specific programme items, therefore, the large increase in RMSE was attributed to the repeated use of these programme items in set 2*b*. The pronounced difference between RMSE and RMSE* also suggested considerable uncertainty in the subjective scores. The adjusted model was found to perform marginally better than the interactions model for both partitions of the data set. Both models produced predictions outside of the range of the subjective scale (i.e. 0 to 100).

Conclusions

In this latter part of the chapter, the distraction models were validated using two separately collected data sets. The first data set used items from the practice page before the training data set collection. The second data set used items from a previous distraction rating experiments.

The two models showed a slightly reduced goodness of fit to both validation sets compared to the training set. However, both models still performed well, especially when considering subjective uncertainty; RMSE* never exceeded 10% for the adjusted model and was generally lower, especially when removing outlying points. A single point from validation data set 1 was found to be an outlier; as in the training set, the programme combination was potentially the cause of this, with informational content clashing more than might have been suggested by the energy-based features. The second validation set was partitioned into two sets based on the original data collection, and the second set was shown to be predicted particularly poorly. This was attributed to individual programme items being repeated multiple times with different factor levels, leading to an inflation in RMSE should those programme items be predicted badly. However, the applicability of the model to various interferer level and filter shapes was promising.

The two models performed similarly, however, the adjusted model generally showed a slightly better fit, especially to the poorly predicted data set (2*b*). The adjusted model is also easier to interpret as it does not feature interactions between features. Therefore, the adjusted model was selected as the final model for predicting distraction due to audio-on-audio interference. The output from the model will be limited to the range of the subjective scale, that is, $0 \leq \hat{y} \leq 100$. The final model is described below in Equations 8.1 and 8.2, and included the following features.

1) 188: Maximum loudness of combination (binaural)
2) 208: Loudness ratio (binaural)
3) 219: PEASS interference related perceptual score
4) 295: Model range, interferer, high frequency range (ear with lowest range)
5) 316: Percentage of temporal windows with TIR<5 dB (best ear, i.e. lowest percentage from the L and R signals)

The regression model, which produces an intermediate distraction score $\hat{y}$, is given to 2 decimal places in Equation 8.1:

$$\hat{y}=28.64+1.04x_1-2.04x_2-0.41x_3-0.95x_4-0.16x_5, \tag{8.1}$$

where x1 to x5 are the raw values of the features detailed above. The final model predictions are limited to the range of the subjective scale, that is, between 0 and 100. The distraction prediction $\hat{d}$ is therefore given $\hat{y}$ by:

$$\hat{d} = \begin{cases} 0, & \text{if } \hat{y} < 0 \\ 100, & \text{if } \hat{y} > 100 \\ \hat{y} & \text{otherwise} \end{cases} \tag{8.2}$$

The invention claimed is:

1. A system for providing sound into two sound zones, the system comprising:

a plurality of speakers configured to generate a first audio signal in a first of the sound zones and a second audio signal in a second of the sound zones; and a controller configured to access a first signal and a second signal and convert the first and second signals into a speaker signal for each of the speakers, receive an input indicating a specified change in a parameter of at least one of the first audio signal and the second audio signal, derive, from at least the input and at least one of the second audio signal and the second signal, an interference value, and adapt the conversion in accordance with the input, based on a determination that the interference value is less than or equal to a threshold.

2. A system according to claim 1, wherein the controller is configured to derive the interference value also on the basis of the first audio signal and/or first signal.

3. A system according to claim 1, wherein the controller is configured to determine a change of a number of parameters of the conversion.

4. A system according to claim 1, wherein the controller is configured to output or propose the determined parameter change and to, thereafter, receive an input acknowledging the parameter change.

5. A system according to claim 4, wherein the controller is further configured to receive a second input identifying one or more parameter settings, the controller being configured to derive the interference value on the basis of also the second input and adapt the conversion also in accordance with the one or more parameter settings of the second input.

6. A system according to claim 1, wherein the controller is configured to, during the deriving step, determine whether the second audio signal comprises speech.

7. A system according to claim 1, wherein the controller is configured to derive the interference value on the basis of one or more of:

a signal strength of the second audio signal and/or the second signal, a signal strength of the first audio signal and/or the first signal, a PEASS value based on the first and second audio signals and/or the first and second signals, a difference in level between the levels of different, predetermined frequency bands of the second signal and/or the second audio signal, and a number of predetermined frequency bands within which a predetermined maximum level difference exists between the level of the first signal and/or audio signal and the level of the second signal and/or audio signal.

8. A system according to claim 1, wherein the controller is configured to derive the interference value on the basis of one or more of:

a proportion, over time, where a level of the first signal or first audio signal exceeds that of the second signal or the second audio signal by a predetermined threshold, an Overall Perception Score of a PEASS model based on the first and second audio signals and/or the first and second signals, a dynamic range of the second signal and/or the second audio signal over time, a proportion of time and frequency intervals wherein a level of the first signal or first audio signal exceeds a predetermined number multiplied by a level of a mixture of the first and second signals or first and second audio signals, and a highest frequency interval of a number of frequency intervals where a level of a mixture of the first and second signals or first and second audio signals is the highest at a point in time.

9. A system according to claim 1, wherein the controller is configured to determine a change in one or more of:

a level of the second signal or the second audio signal, a level of the first signal or the first audio signal, a frequency filtering of the second signal or the second audio signal, a delay of the providing of the second signal vis-à-vis the providing of the first signal, and a dynamic range of the second signal and/or the second audio signal.

10. A method of providing sound into two sound zones, the method comprising:

accessing a first signal and a second signal, converting the first and second signals into a speaker signal for each of a plurality of speakers configured to provide, on the basis of the speaker signals, a first audio signal in a first zone of the two sound zones and a second audio signal in a second zone of the two sound zones, receiving an input indicating a change in a parameter of at least one of the first audio signal and the second audio signal;

deriving, from at least the input and at least one of the second audio signal and the second signal, an interference value, and adapting the conversion in accordance with the input, based on a determination that the interference value is less than or equal to the threshold.

11. A method according to claim 10, wherein the deriving step comprises deriving the interference value also on the basis of the first audio signal and/or first signal.

12. A method according to claim 10, wherein determining the step comprises determining a change of a number of parameters of the conversion.

13. A method according to claim 10, wherein the determining step comprises outputting or proposing the determined parameter change and wherein the adapting step comprises initially receiving an input acknowledging the parameter change.

14. A method according to claim 10, further comprising the step of receiving a second input identifying one or more parameter settings, the deriving step comprising deriving the interference value on the basis of also the one or more parameter settings, and the adapting step comprising adapting the conversion also in accordance with the one or more parameter settings of the second input.

15. A method according to claim 10, wherein the deriving step comprises determining whether the second audio signal comprises speech.

16. A method according to claim 10, wherein the deriving step comprises deriving the interference value on the basis of one or more of:

a proportion, over time, where a level of the first signal or first audio signal exceeds that of the second signal or the second audio signal by a predetermined threshold, an Overall Perception Score of a PEASS model based on the first and second audio signals and/or the first and second signals, a dynamic range of the second signal and/or the second audio signal over time, a proportion of time and frequency intervals wherein a level of the first signal or first audio signal exceeds a predetermined number multiplied by a level of a mixture of the first and second signals or first and second audio signals, and a highest frequency interval of a number of frequency intervals where a level of a mixture of the first and second signals or first and second audio signals is the highest at a point in time.

17. A method according to claim 10, further comprising:

determining a change in one or more of a level of the second signal or the second audio signal, a level of the first signal or the first audio signal, a frequency filtering of the second signal or the second audio signal, a delay of the providing of the second signal in relation to the providing of the first signal, and a dynamic range of at least one of the second signal and the second audio signal.

18. A method of providing sound into two sound zones, the method comprising:

accessing a first signal and a second signal, converting the first signal and the second signal into a speaker signal for each of a plurality of speakers configured to provide, on the basis of the speaker signals, a first audio signal in a first zone of the two sound zones and a second audio signal in a second zone of the two sound zones, and concurrently with the conversion of the first signal and the second signal, receiving an input indicating a new first signal, accessing the new first signal, and deriving, from at least the new first signal, an interference value, and adapting the conversion to convert the new first signal and the second signal to provide the speaker signals, based on a determination that the derived interference value is less than or equal to a threshold.

* * * * *